US010183495B2

(12) United States Patent
Kudo et al.

(10) Patent No.: US 10,183,495 B2
(45) Date of Patent: Jan. 22, 2019

(54) LIQUID SUPPLY DEVICE, PRINTING APPARATUS AND LIQUID EJECTION SYSTEM

(71) Applicant: Seiko Epson Corporation, Tokyo (JP)

(72) Inventors: Shoma Kudo, Shiojiri (JP); Munehide Kanaya, Azumino (JP); Naomi Kimura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/440,746

(22) Filed: Feb. 23, 2017

(65) Prior Publication Data

US 2017/0246879 A1 Aug. 31, 2017

(30) Foreign Application Priority Data

Feb. 29, 2016 (JP) ..... 2016-036515
Feb. 29, 2016 (JP) ..... 2016-036743
Oct. 26, 2016 (JP) ..... 2016-209512

(51) Int. Cl.
*B41J 2/175* (2006.01)
*B41J 2/19* (2006.01)
(Continued)

(52) U.S. Cl.
CPC ..... *B41J 2/19* (2013.01); *B41J 2/175* (2013.01); *B41J 2/1721* (2013.01); *B41J 2/1752* (2013.01);
(Continued)

(58) Field of Classification Search
CPC ..... B41J 2/17503
See application file for complete search history.

(56) References Cited

U.S. PATENT DOCUMENTS 9,403,371 B2 8/2016 Koike et al.
2002/0118242 A1* 8/2002 Tajima ..... B41J 2/17556 347/17
(Continued)

FOREIGN PATENT DOCUMENTS

JP 2011-240706 A 12/2011
JP 2011-240707 A 12/2011
(Continued)

*Primary Examiner* — Shelby L Fidler
(74) *Attorney, Agent, or Firm* — Foley & Lardner LLP

(57) ABSTRACT

A technique of reducing the possibility that a liquid remains in a buffer chamber is provided. There is provided a liquid supply device configured to supply a liquid to a liquid ejection head. The liquid supply device comprises a liquid containing chamber configured to contain the liquid; an air communication path configured to include a first connection portion at one end that is connected with the liquid containing chamber and an air outlet port at the other end that is open to the atmosphere; and a buffer chamber provided in the middle of the air communication path. The air communication path includes a connection path that is located on a downstream side of the buffer chamber in the air communication path in a flow direction of a fluid from the air outlet port toward the liquid containing chamber and is configured to include a second connection portion at an upstream end connected with the buffer chamber. When the first connection portion is exposed to the liquid in the liquid containing chamber, the second connection portion is placed in a lower area in a vertical direction of the buffer chamber.

2 Claims, 41 Drawing Sheets

(51) Int. Cl.

| | |
|---|---|
| ***B41J 2/17*** | (2006.01) |
| ***B41J 2/185*** | (2006.01) |
| ***B41J 29/02*** | (2006.01) |
| ***B41J 29/13*** | (2006.01) |

(52) U.S. Cl.
CPC ..... *B41J 2/17509* (2013.01); *B41J 2/17513* (2013.01); *B41J 2/17553* (2013.01); *B41J 2/185* (2013.01); *B41J 29/02* (2013.01); *B41J 29/13* (2013.01); *B41J 2002/1856* (2013.01)

(56) References Cited

U.S. PATENT DOCUMENTS

| | | | | |
|---|---|---|---|---|
| 2006/0132560 | A1* | 6/2006 | Silverbrook | B41J 2/04541 347/86 |
| 2010/0123756 | A1* | 5/2010 | Yamada | B41J 2/185 347/36 |
| 2014/0043108 | A1* | 2/2014 | Tanaka | H03H 7/42 333/26 |
| 2015/0109378 | A1* | 4/2015 | Koike | B41J 2/175 347/85 |
| 2015/0109386 | A1 | 4/2015 | Koike et al. | |
| 2016/0009100 | A1* | 1/2016 | Kudo | B41J 2/17553 347/92 |

FOREIGN PATENT DOCUMENTS

| | | | | |
|---|---|---|---|---|
| JP | WO 2014132634 | A1 * | 9/2014 | B41J 2/17553 |
| JP | 2015-080907 | A | 4/2015 | |

* cited by examiner

LIQUID SUPPLY DEVICE, PRINTING APPARATUS AND LIQUID EJECTION SYSTEM

CROSS-REFERENCE TO RELATED APPLICATIONS

The present application claims priority from Japanese patent application 2016-036743 filed on Feb. 29, 2016, Japanese patent application 2016-036515 filed on Feb. 29, 2016 and Japanese patent application 2016-209512 filed on Oct. 26, 2016, the entireties of the disclosures of which are hereby incorporated by reference into this application.

BACKGROUND

The disclosure relates to technology with regard to a liquid supply device. The disclosure also relates to a printing apparatus and a liquid ejection system that are equipped with the liquid supply device.

A conventionally known liquid supply device is configured to supply a liquid to a liquid ejection head (for example, JP 2011-240706A and JP 2011-240707A). The conventional liquid supply device includes a liquid containing chamber configured to contain a liquid, an air communication path configured to make the liquid containing chamber communicate with the atmosphere, and a buffer chamber (air containing chamber) provided in the middle of the air communication path.

A known liquid ejection system includes a printer serving as a liquid ejection apparatus and a liquid supply device configured to supply a liquid (for example, ink) to the printer. JP 2011-240706A and JP 2011-240707A describe the configuration that the liquid supply device is attached to a side wall of the printer in this liquid ejection system. This liquid supply device includes a liquid containing chamber configured to contain the liquid and an air containing chamber configured to contain the air and include an air outlet port.

JP 2015-80907A discloses a liquid container including a liquid containing chamber and a buffer chamber, as a liquid container (liquid supply device) configured to supply ink to a printer. The buffer chamber is configured to suppress leakage of a liquid contained in the liquid containing chamber to the outside in response to a change in environment (for example, a change in atmospheric pressure, a change in temperature or a change in attitude). In the configuration of JP 2015-80907A, the buffer chamber is located above the liquid containing chamber.

In the conventional liquid supply device, in response to a change in atmospheric pressure or a change in temperature, there is a likelihood that the liquid contained in the liquid containing chamber is pressed out to flow into the buffer chamber provided in the middle of the air communication path and that the inflow liquid is not returned to the liquid containing chamber but remains in the buffer chamber. When the liquid remains in the buffer chamber, this may cause problems, for example, leakage of the liquid through the air communication path to the outside and reduction in the amount of the liquid supplied to the liquid ejection head. With regard to the conventional liquid supply device, there is accordingly a demand for a technique that reduces the possibility that the liquid remains in the buffer chamber. With regard to the conventional liquid supply device, there is also a demand for a technique that flexibly responds to a use condition, for example, the volume of the liquid contained in the liquid containing chamber and a use environment in which the liquid supply device. With regard to the conventional liquid supply device, other demands include cost reduction, resource saving, easy manufacture and improvement of usability.

Both the liquid ejection systems described in JP 2011-240706A and JP 2011-240707A are configured to enable the liquid to be filled into the liquid supply device. In the process of liquid refill, the user changes the attitude of the liquid supply device. In the configuration that the liquid supply device is built inside of the housing of the printer, there is a need to provide a space required for a change in attitude in the liquid refill process, inside of the housing of the printer. In the liquid ejection systems described in JP 2011-240706A and JP 2011-240707A, the liquid containing chamber is integrated with the air containing chamber. A large space is thus required to be provided inside of the housing of the printer, in order to allow for a change in attitude during the liquid refill process.

The air containing chamber serves to store the liquid flowing out (flowing back) to the outside of the liquid containing chamber, so that it is preferable that the air containing chamber has a maximum possible capacity. In the liquid ejection system described in JP 2011-240706A, however, the liquid containing chamber is integrated with the air containing chamber. There is accordingly a difficulty in providing a large capacity of the air containing chamber. Another problem is the low flexibility in design with regard to the arrangement of the air containing chamber.

In the liquid supply device configured to change the attitude of the liquid containing chamber in the process of filling the liquid into the liquid containing chamber, there is a need to reduce the space required for a change in attitude. There is also a need to improve the flexibility in design (for example, capacities, locations and numbers) of the liquid containing chamber and the air containing chamber in the liquid supply device.

JP 2015-80907A describes the configuration that the buffer chamber is provided in the liquid container. There is, however, still a room for improvement with regard to the configuration and the arrangement of the liquid supply device including the liquid containing chamber and the buffer chamber as described below.

Firstly, there is a need for a configuration of the liquid supply device that suppresses leakage of the liquid to the outside. More specifically, there is a need for a configuration that suppresses leakage of the liquid in response to a change in environment (for example, a change in atmospheric pressure, a change in temperature and a change in attitude) in which the liquid supply device is placed. There is also a need for a configuration that enables the liquid stored in the buffer chamber to be readily returned to the liquid containing chamber and thereby reduces the volume of the unused liquid remaining in the buffer chamber.

Secondly, there is a need for a liquid supply device that suppresses expansion of the placement area of the entire printing apparatus. More specifically, it is desired, for example, to efficiently place a plurality of liquid containing chambers and flow path members connected with the plurality of liquid containing chambers in a space-saving manner.

The above problems are not characteristic of the liquid supply device for the printer but are commonly found in liquid supply devices configured to supply various other types of liquid and liquid ejection apparatuses using such liquid supply devices.

SUMMARY

In order to solve at least one of the problems described above, the disclosure may be implemented by aspects and applications described below.

(1) According to one aspect of the disclosure, there is provided a liquid supply device configured to supply a liquid to a liquid ejection head. This liquid supply device comprises a liquid containing chamber configured to contain the liquid; an air communication path configured to include a first connection portion at one end that is connected with the liquid containing chamber and an air outlet port at the other end that is open to the atmosphere; and a buffer chamber provided in the middle of the air communication path. The air communication path includes a connection path that is located on a downstream side of the buffer chamber in the air communication path in a flow direction of a fluid from the air outlet port toward the liquid containing chamber and is configured to include a second connection portion at an upstream end connected with the buffer chamber. When the first connection portion is exposed to the liquid in the liquid containing chamber, the second connection portion is placed in a lower area in a vertical direction of the buffer chamber.

In the liquid supply device of this aspect, the second connection portion is located in the lower area in the vertical direction of the buffer chamber, while the first connection portion is exposed to the liquid in the liquid containing chamber. Even in the case where the liquid flows into the buffer chamber, this configuration makes it likely that the inflow liquid flows to the downstream side (i.e., the liquid containing chamber) of the buffer chamber via the second connection portion. This configuration accordingly reduces the possibility that the liquid remains in the buffer chamber.

(2) In the liquid supply device of the above aspect, the buffer chamber may be configured to have a volume that is equal to or greater than an expected volume increase of a gas present in the liquid containing chamber, which is calculated based on an amount of the liquid contained in the liquid containing chamber and at least one of an amount of change in temperature and an amount of change in atmospheric pressure expected in an environment where the liquid supply device is placed.

In the liquid supply device of this aspect, even when the gas present in the liquid containing chamber is increased to make the liquid in the liquid containing chamber flow into the air communication path, this configuration enables the inflow liquid to be stored in the buffer chamber. This configuration reduces the possibility that the liquid flows into the upstream side of the buffer chamber.

(3) In the liquid supply device of the above aspect, a plurality of the buffer chambers may be provided in series in the middle of the air communication path. A plurality of the connection paths may be provided corresponding to the respective buffer chambers. Respective second connection portions of the respective connection paths may be located on identical sides in a horizontal direction and in the vertical direction in the respective buffer chambers.

In the liquid supply device of this aspect, even when the liquid flows from the liquid containing chamber into the air communication path, this configuration enables the inflow liquid to be stored in the plurality of buffer chambers. This configuration accordingly reduces the possibility that the liquid flows out through the air communication path. The respective second connection portions are located on the same sides in the respective buffers. Even when the liquid flows into the buffer chamber, this configuration makes it likely that the inflow liquid flows into the downstream side (i.e., the liquid containing chamber-side) of the buffer chamber via the second connection portion.

(4) In the liquid supply device of the above aspect, each of the buffer chambers may be formed in an approximately rectangular parallelepiped shape. The plurality of connection paths may include a middle connection path that is arranged to connect adjacent buffer chambers with each other in the flow direction and is configured to include the second connection portion at the upstream end connected with an adjacent buffer chamber on an upstream side and a third connection portion at a downstream end connected with an adjacent buffer chamber on a downstream side. The air communication path may include a most upstream-side communication path configured to include the air outlet port and an air-side connection portion that is connected with a most upstream-side buffer chamber located on a most upstream side in the flow direction out of the plurality of buffer chambers. In the most upstream-side buffer chamber, the air-side connection portion may be arranged diagonally to a most upstream-side second connection portion that is the second connection portion connected with the most upstream-side buffer chamber. In a downstream-side buffer chamber located on a downstream side of the most upstream-side buffer chamber in the flow direction out of the plurality of buffer chambers, the third connection portion and the second connection portion may be arranged diagonally to each other.

This configuration provides a long flow path length from the first connection portion to the air outlet port and thereby reduces the possibility that the liquid in the liquid containing chamber flows through the air communication path to reach the upstream side of the most upstream-side buffer chamber.

(5) In the liquid supply device of the above aspect, the liquid containing chamber and the buffer chamber may be provided as different members.

This configuration enables the number or the volume of the buffer chambers to be readily changed and thereby improves the flexibility in design of the liquid supply device.

(6) In the liquid supply device of the above aspect, the liquid containing chamber may be integrated with the buffer chamber.

This configuration enables the liquid supply device to be readily manufactured.

(7) According to another aspect of the disclosure, there is provided a liquid ejection system. This liquid ejection system comprises the liquid supply device of any of the above aspects; the liquid ejection head; and a liquid supply flow path configured to make the liquid supply device communicate with the liquid ejection head.

In the liquid ejection system of this configuration, the second connection portion is located in the lower area in the vertical direction of the buffer chamber, while the first connection portion is exposed to the liquid in the liquid containing chamber. Even in the case where the liquid flows into the buffer chamber, this configuration makes it likely that the inflow liquid flows to the downstream side (i.e., the liquid containing chamber) of the buffer chamber via the second connection portion.

(8) According to another aspect of the disclosure, there is provided a liquid supply device configured to supply a liquid to a head that is provided to eject the liquid onto an object. This liquid supply device comprises a liquid containing chamber configured to contain the liquid; a liquid injection portion arranged to communicate with the liquid containing chamber and configured to inject the liquid into the liquid containing chamber; an air inlet port provided as an opening of the liquid containing chamber to introduce the air into the liquid containing chamber; an air flow path configured to generate air bubbles in the liquid contained in the liquid containing chamber and introduce the air into the air containing chamber and arranged to have one end that communicates with the air inlet port and the other end that is open to the atmosphere; and an air containing chamber configured to contain the air and provided in part of the air flow path. The liquid containing chamber and the air containing chamber are provided as different bodies. The air inlet port of the liquid containing chamber is provided in a lower part in a vertical direction of the liquid containing chamber, in a first attitude taken by the liquid supply device in a use state.

In the liquid supply device of this aspect, the liquid containing chamber is provided as a different body from the air containing chamber (i.e., independently of the air containing chamber). In the liquid supply device configured to change the attitude of the liquid containing chamber in the process of filling the liquid into the liquid containing chamber, this configuration reduces the space required for a change in attitude, compared with a configuration that the liquid containing chamber is integrated with the air containing chamber. The liquid containing chamber and the air containing chamber are provided as different bodies. This configuration improves the flexibility in design (for example, capacities, locations and numbers) of the respective chambers. Additionally, in the first attitude taken in the use state, the air inlet port is located in the lower part in the vertical direction of the liquid containing chamber. In the use state, this configuration suppresses the liquid from flowing out (flowing back) from the air inlet port to the outside of the liquid containing chamber.

(9) In the liquid supply device of the above aspect, the air flow path arranged from the liquid containing chamber to the air containing chamber may include an upper portion that is arranged to pass through vertically above an upper limit position of the liquid containable in the liquid containing chamber.

In the liquid supply device of this aspect, the upper portion of the air flow path is arranged to pass through vertically above the upper limit position of the liquid in the liquid containing chamber in the pathway from the liquid containing chamber to the air containing chamber. This configuration suppresses the liquid flowing out (flowing back) to the outside of the liquid containing chamber to enter the air containing chamber.

(10) In the liquid supply device of the above aspect, the air flow path arranged from the liquid containing chamber to the air containing chamber may be formed from a material having flexibility.

In the liquid supply device of this aspect, the air flow path between the liquid containing chamber and the air containing chamber is formed from the material having flexibility. In the liquid supply device configured to change the attitude of the liquid containing chamber in the process of filling the liquid into the liquid containing chamber, this configuration enables the attitude of only the liquid containing chamber to be readily changed.

(11) In the liquid supply device of the above aspect, a flow path extended from the air inlet port to be part of the air flow path may be formed in the liquid containing chamber, and the upper portion may be included in the flow path in the liquid containing chamber.

In the liquid supply device of this aspect, the upper portion may be provided in the flow path formed in the liquid containing chamber. This configuration enables the upper portion to be readily provided.

(12) In the liquid supply device of the above aspect, the upper portion may be included in the air containing chamber.

In the liquid supply device of this aspect, the upper portion may be provided in the air containing chamber. This configuration enables the upper portion to be readily provided.

(13) In the liquid supply device of the above aspect, a gas-permeable liquid-proof member may be placed in the upper portion in the air containing chamber to suppress the liquid from flowing into an upstream side.

In the liquid supply device of this aspect, the gas-permeable liquid-proof member is placed in the upper portion in the air containing chamber. This configuration reduces the possibility that the gas permeation ability of the gas-permeable liquid-proof member is damaged by wetting the gas-permeable liquid-poof member with the liquid.

(14) The liquid supply device of the above aspect may further comprise a liquid-proof chamber provided in the upper portion in the air containing chamber to place the gas-permeable liquid-proof member therein and configured to be replaceable independently of the air containing chamber.

In the liquid supply device of this aspect, the gas-permeable liquid-proof member is placed in the liquid-proof chamber that is replaceable independently of the air containing chamber. In the case where the gas-permeable liquid-proof member in the liquid-proof chamber is wet, this configuration enables only the liquid-proof chamber to be readily replaced and reduces the cost required for replacement.

(15) In the liquid supply device of the above aspect, a valve mechanism may be provided in the air flow path to open and close the air flow path.

In the liquid supply device of this aspect, the air flow path may be opened and closed by the valve mechanism. This results in improving the flexibility in design of the respective components (for example, the liquid containing chamber and the air containing chamber) of the liquid supply device. For example, the valve mechanism may be provided in the air flow path from the liquid containing chamber to the air containing chamber. Closing the valve mechanism suppresses the liquid from flowing from the liquid containing chamber into the air containing chamber. This enables the attitude of only the liquid containing chamber to be readily changed.

(16) In the liquid supply device of the above aspect, the valve mechanism may be configured to open and close the air inlet port of the liquid containing chamber and to separate the liquid containing chamber and the air containing chamber from each other in a closed state of the air inlet port.

In the liquid supply device of this aspect, closing the air inlet port of the liquid containing chamber by the valve mechanism enables the attitude of only the liquid containing chamber to be readily changed. Additionally, the valve mechanism is configured to separate the liquid containing chamber and the air containing chamber from each other in the closed state of the air inlet port. Detachment of only the liquid containing chamber from the liquid supply device facilitates the operation of filling the liquid in the liquid containing chamber.

(17) In the liquid supply device of the above aspect, the valve mechanism may be configured to open and close one end of the flow path in the liquid containing chamber.

The liquid supply device of this aspect enables both the upper portion and the valve mechanism to be provided in the liquid containing chamber.

(18) According to another aspect of the disclosure, there is provided a liquid ejection system. This liquid ejection system comprises the liquid supply device of any of the above aspect; a liquid ejection apparatus including the head; and a flow tube arranged to connect the liquid supply device with the head and configured to flow the liquid in the liquid containing chamber to the head.

In the liquid ejection system including the liquid supply device configured to change the attitude of the liquid containing chamber in the process of filling the liquid in the liquid containing chamber, the configuration of this aspect reduces the space in the liquid ejection apparatus required for a change in attitude, compared with a configuration that the liquid containing chamber is integrated with the air containing chamber.

(19) According to another aspect of the disclosure, there is provided a liquid supply device configured to supply a liquid to a liquid ejection portion. This liquid supply device comprises a liquid tank configured to contain the liquid; a connection flow path member connected with the liquid tank; and a buffer tank provided as a different body from the liquid tank and connected with the liquid tank via the connection flow path member to communicate with the atmosphere. The liquid tank comprises a liquid containing chamber provided inside of the liquid tank and a liquid injection portion configured to inject the liquid into the liquid containing chamber. The buffer tank comprises a buffer chamber configured such that a bottom face of the buffer chamber is located at a position higher than a maximum liquid level in the liquid tank.

In the liquid supply device of this aspect, the buffer tank is connected with the liquid tank. This configuration advantageously reduces the possibility of leakage of the liquid to the outside. The buffer chamber is configured such that the bottom face of the buffer chamber is located at the position higher than the maximum liquid level in the liquid tank. This configuration makes it less likely that the liquid flows out from the liquid containing chamber to the buffer chamber. This configuration also makes it likely that the liquid flowing out from the liquid containing chamber to the buffer chamber is returned to the liquid containing chamber and thereby reduces the amount of the unused liquid. Additionally, the liquid tank and the buffer tank are provided as different bodies. This configuration advantageously enables each of the volume of the liquid containing chamber and the volume of the buffer chamber to be readily increased and decreased.

(20) In the liquid supply device of the above aspect, the connection flow path member may be held above the maximum liquid level.

The configuration of this aspect makes it less likely that the liquid flows out from the liquid containing chamber to the buffer chamber and also makes it likely that the liquid is returned from the buffer chamber to the liquid containing chamber. Additionally, this configuration advantageously enables the connection flow path member to be readily attached in manufacture of the liquid supply device.

(21) In the liquid supply device of the above aspect, the liquid tank may comprise a plurality of the liquid containing chambers arrayed in a first direction and configured to contain multiple different types of liquids. The buffer tank may comprise a plurality of the buffer chambers arrayed in a direction parallel to the first direction.

The configuration of this aspect suppresses excessive size expansion of the liquid supply device in the direction intersecting with the first direction.

(22) In the liquid supply device of the above aspect, the liquid tank may comprise a plurality of the liquid containing chambers arrayed in a first direction and configured to contain multiple different types of liquids. The buffer tank may comprise a plurality of the buffer chambers arrayed in a second direction intersecting with the first direction.

The configuration of this aspect suppresses excessive size expansion of the liquid supply device in the first direction.

(23) According to another aspect of the disclosure, there is provided a liquid supply device configured to supply a liquid to a liquid ejection portion. This liquid supply device comprises a liquid tank configured to contain the liquid; a connection flow path member connected with the liquid tank; and a buffer tank provided as a different body from the liquid tank and connected with the liquid tank via the connection flow path member to communicate with the atmosphere. The liquid tank comprises a liquid containing chamber provided inside of the liquid tank and a liquid injection portion configured to inject the liquid into the liquid containing chamber. A first liquid level is set in the liquid tank at a height that is not higher than an end of the liquid injection portion that is open to the liquid containing chamber, as a guide indicating an upper limit of liquid capacity of the liquid tank. The buffer tank comprises a buffer chamber configured such that a bottom face of the buffer chamber is located at a position lower than the first liquid level. The connection flow path member is arranged to pass through a position higher than the first liquid level and connect the liquid tank with the buffer tank.

In the liquid supply device of this aspect, the buffer tank is connected with the liquid tank. This configuration reduces the possibility of leakage of the liquid. The connection flow path member is arranged to pass through the position higher than the first liquid level and connect the liquid tank with the buffer tank. This configuration advantageously makes it less likely that the liquid flows out from the liquid containing chamber to the buffer chamber. Additionally, the liquid tank and the buffer tank are provided as different bodies. This configuration advantageously enables each of the volume of the liquid containing chamber and the volume of the buffer chamber to be readily increased and decreased.

(24) In the liquid supply device of the above aspect, the buffer tank may comprise the buffer chamber, an air chamber including an air outlet port, and a partition wall configured to partition the buffer chamber from the air chamber. The buffer chamber and the air chamber may communicate with each other via an opening provided above the partition wall.

This configuration suppresses the liquid from flowing out to the air chamber unless the liquid is filled up to the upper part of the buffer chamber and thereby advantageously makes it less likely that the liquid flows out from the air outlet port.

(25) According to another aspect of the disclosure, there is provided a printing apparatus comprising a liquid ejection portion and the liquid supply device of any of the above aspect.

The printing apparatus of this aspect advantageously makes it less likely that the liquid is leaked out of the printing apparatus, like the above aspects.

(26) In the printing apparatus of the above aspect, in downward projection of the printing apparatus other than the liquid supply device, at least part of the liquid supply device is included inside of an outer circumference of the printing apparatus.

This configuration suppresses excessive expansion of the placement area of the printing apparatus.

(27) According to another aspect of the disclosure, there is provided a printing apparatus comprising a liquid ejection portion configured to be movable; the liquid supply device described in the above (21); a media discharge portion configured to discharge a printing medium printed by ejection of the liquid from the liquid ejection portion, in a second direction intersecting with the first direction; and an operation panel provided above the media discharge portion. In this printing apparatus, at least part of the liquid tank is arranged on an identical side with the media discharge portion relative to a movable area of the liquid ejection portion moving in the first direction, and at least part of the buffer tank is placed between the operation panel and the movable area.

This configuration suppresses size expansion of the printing apparatus in the second direction that is the discharge direction of the printing medium. Vacant spaces are likely to be present in the periphery of the movable area of the liquid ejection portion of the printing apparatus. This configuration enables the liquid tank and the buffer tank to be placed by using such vacant spaces. Additionally, in the printing apparatus of this aspect, at least part of the liquid tank is located on the same side of the media discharge portion relative to the movable area of the liquid ejection portion. This configuration advantageously makes it easier to supply the liquid to the liquid ejection portion.

(28) According to another aspect of the disclosure, there is provided a printing apparatus comprising a liquid ejection portion configured to be movable; the liquid supply device described in the above (22); and a media discharge portion configured to discharge in the second direction a printing medium printed by ejection of the liquid from the liquid ejection portion. In this printing apparatus, at least part of the liquid tank is arranged on an identical side with the media discharge portion relative to a movable area of the liquid ejection portion moving in the first direction, and at least part of the buffer tank is arranged on an opposite side to the media discharge portion relative to the movable area.

This configuration suppresses size expansion of the printing apparatus in the first direction that is the moving direction of the liquid ejection portion. Vacant spaces are likely to be present in the periphery of the movable area of the liquid ejection portion of the printing apparatus. This configuration enables the liquid tank and the buffer tank to be placed by using such vacant spaces. Additionally, in the printing apparatus of this aspect, at least part of the liquid tank is located on the same side of the media discharge portion relative to the movable area of the liquid ejection portion. This configuration reduces the distance between the liquid tank and the liquid ejection portion and thereby advantageously makes it easier to supply the liquid to the liquid ejection portion.

(29) The printing apparatus of the above aspect may further comprise a scanner unit. At least part of the buffer tank may be placed in a location overlapping with an imaging area of the scanner unit.

In the printing apparatus of this configuration, at least part of the buffer tank is placed in the location overlapping with the imaging area of the scanner unit. This configuration suppresses expansion of the placement area of the printing apparatus.

(30) The printing apparatus of the above aspect may further comprise a waste containing portion configured to store the liquid. The waste containing portion may be placed below at least part of the liquid tank and the buffer tank.

Even in the case of leakage of the liquid from the liquid tank and/or the buffer tank, this configuration makes it likely that the leaked liquid is stored in the waste containing portion and thereby advantageously reduces the possibility that the liquid flows out.

(31) The printing apparatus of the above aspect may further comprise a partition wall configured to partition at least part of the liquid tank and the buffer tank from the waste containing portion in a height direction. The partition wall may include an opening at a position opposed to the waste containing portion.

Even in the case of leakage of the liquid from the liquid tank and/or the buffer tank, this configuration makes it likely that the leaked liquid is stored in the waste containing portion via the opening of the partition wall. The partition wall is placed between the liquid tank and/or the buffer tank and the waste containing portion, except the location corresponding to the opening of the partition wall. This configuration advantageously reduces the possibility that the liquid flows out.

(32) The printing apparatus of the above aspect may further comprise a partition wall configured to partition at least part of the liquid tank and the buffer tank from the waste containing portion in a height direction. The partition wall may include an opening, and the opening and the waste containing portion may be connected with each other by a liquid guide member.

Even in the case of leakage of the liquid from the liquid tank and/or the buffer tank, this configuration makes it likely that the leaked liquid is stored in the waste containing portion via the opening of the partition wall and the liquid guide member. The partition wall is placed to partition the liquid tank and/or the buffer tank from the waste containing portion, except the location corresponding to the opening of the partition wall. This configuration advantageously reduces the possibility that the liquid flows out.

For example, one aspect of the disclosure may be implemented as an apparatus comprising one or more elements out of a plurality of elements, i.e., a liquid containing chamber, an air communication path and a buffer chamber. Accordingly this apparatus may include a liquid containing chamber or may not include the liquid containing chamber. This apparatus may include an air communication path or may not include the air communication path. This apparatus may include a buffer chamber or may not include the buffer chamber. Each of various aspects described above solves at least one of various problems such as downsizing of the apparatus, cost reduction, resource saving, easy manufacture and improvement of usability. Part or all of the technical features in each of the aspects with regard to the liquid supply device described above may be applied to this apparatus.

All the plurality of components included in each of the aspects of the disclosure described above are not essential, but some components among the plurality of components may be appropriately changed, omitted or replaced with other additional components or part of the limitations may be deleted, in order to solve part or all of the problems described above or in order to achieve part or all of the advantageous effects described herein. In order to solve part or all of the problems described above or in order to achieve part or all of the advantageous effects described herein, part or all of the technical features included in one aspect of the disclosure described above may be combined with part or all of the technical features included in another aspect of the disclosure described above to provide one independent aspect of the disclosure.

The disclosure may be implemented by any of various aspects other than the liquid supply device, the printing apparatus, the liquid ejection apparatus connected with the liquid supply device and the liquid ejection system including the liquid supply device and the liquid ejection apparatus of the above aspects, for example, a method of manufacturing any of the device, apparatus and system, an apparatus for manufacturing any of the device, apparatus and system, an object on which a liquid is ejected by any of the device, apparatus and system and a liquid supply system. The liquid supply device may be configured to supply a liquid to a record head via a sub-tank or the like.

DESCRIPTION OF EMBODIMENTS

A. First Embodiment

A-1. Configuration of Liquid Ejection System

Figure 1:
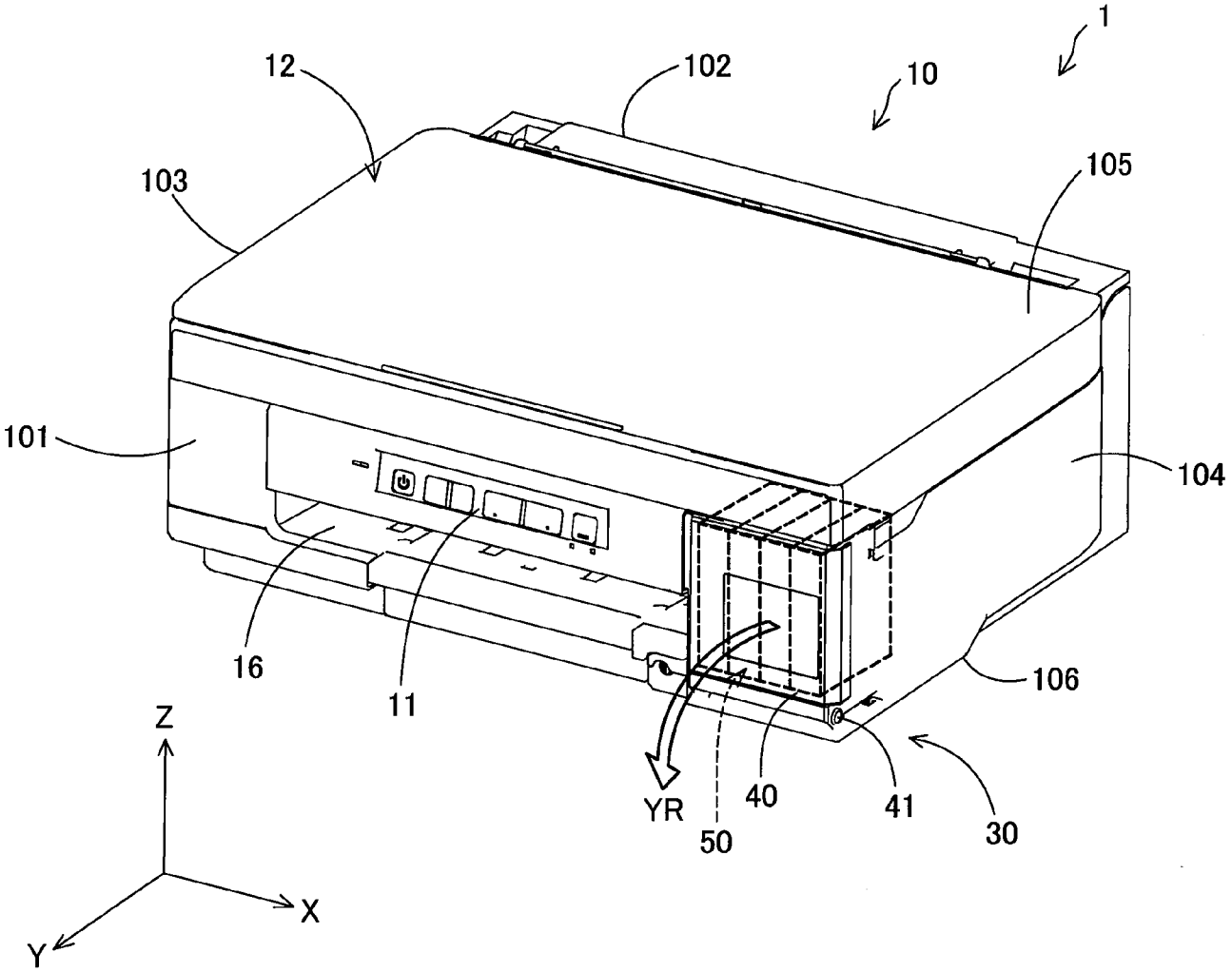
FIG. 1 is a diagram illustrating the appearance of a liquid ejection system in a use state according to a first embodiment.
Figure 2:
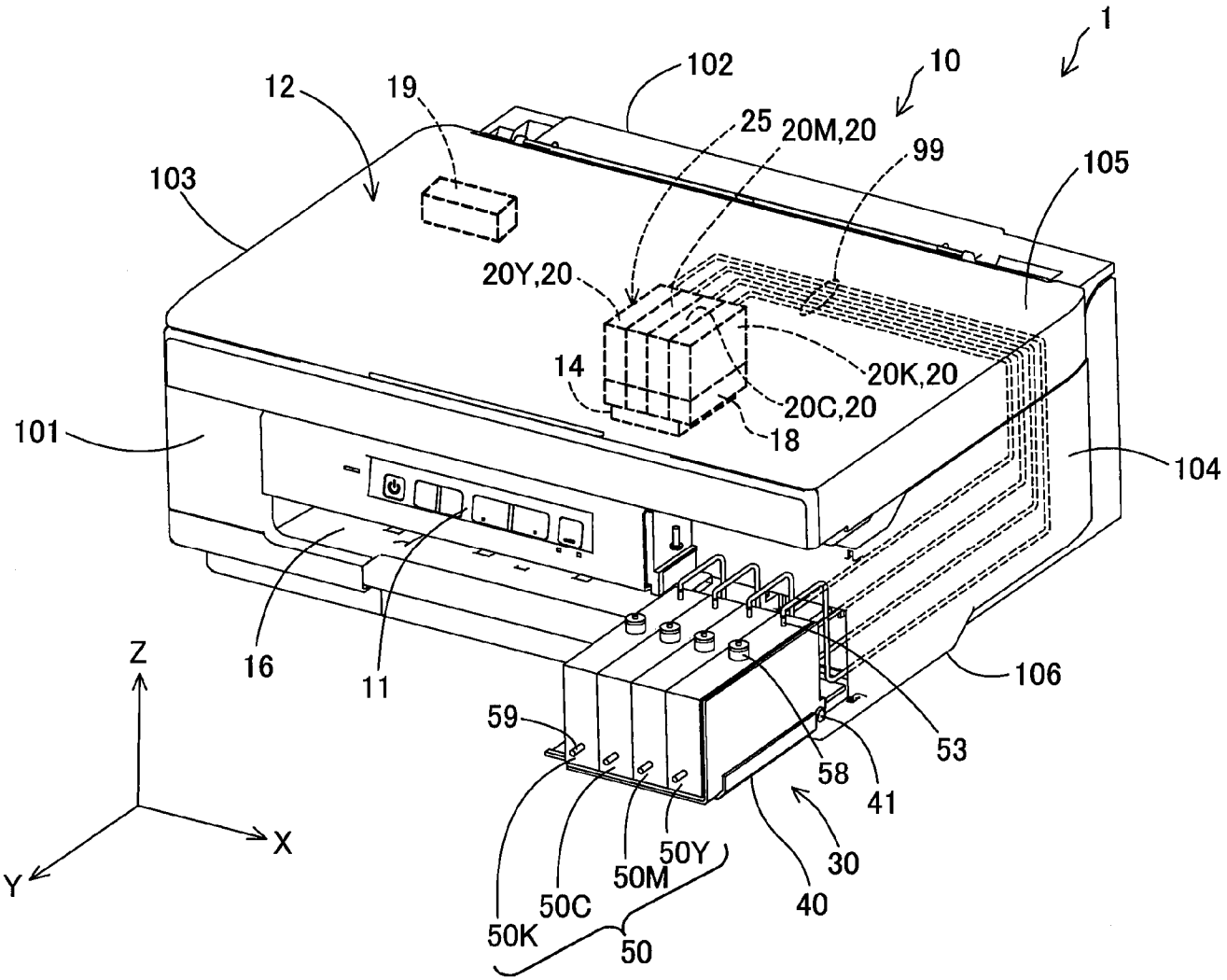
FIG. 2 is a schematic diagram illustrating the liquid ejection system in an injection state.
Figure 3:
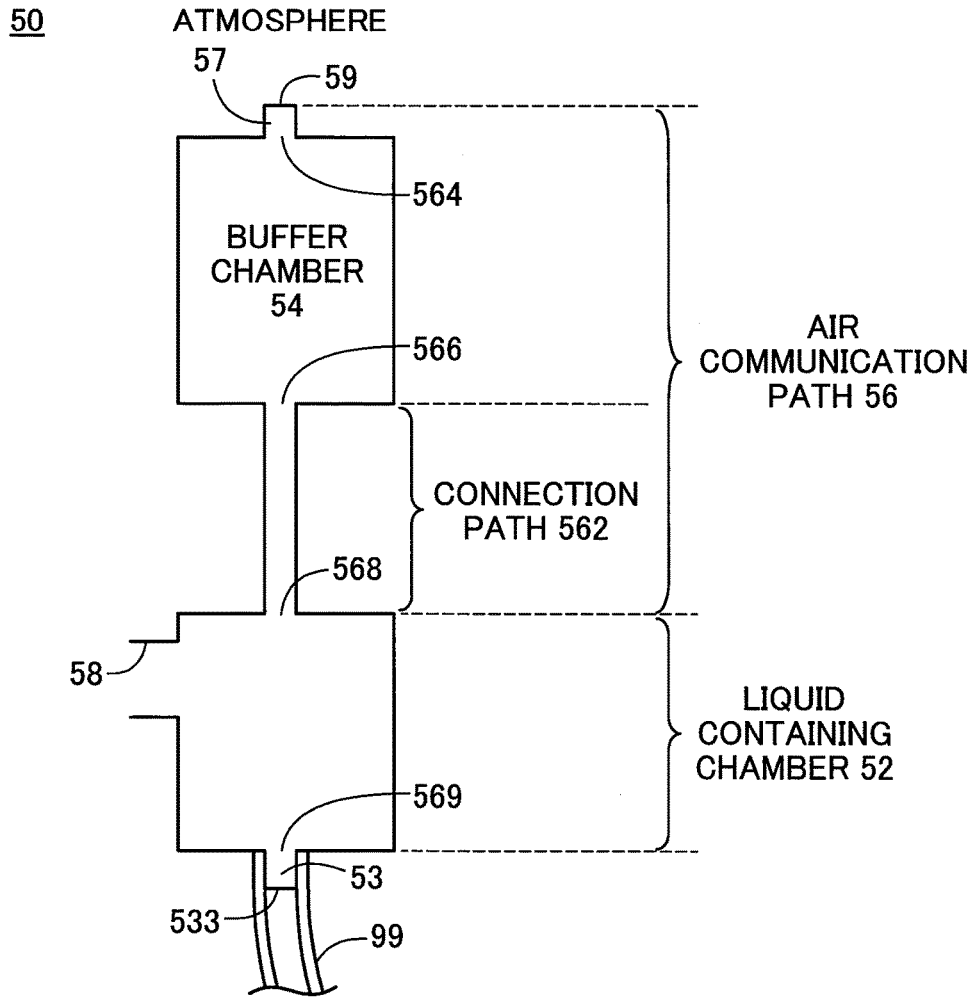
FIG. 3 is a conceptual diagram illustrating a pathway from an air outlet port to a liquid discharge portion.

FIGS. 1 and 2 are schematic diagrams illustrating a liquid ejection system 1 according to a first embodiment of the disclosure. FIG. 1 illustrates the appearance of the liquid ejection system 1 in its use state. FIG. 2 illustrates the appearance of the liquid ejection system 1 in its injection state and part of the internal configuration (shown by the broken line) of the liquid ejection system 1. XYZ axes that are orthogonal to one another are illustrated in FIGS. 1 and 2. The X axis corresponds to the "width direction" of a printer 10. The Y axis corresponds to the "depth direction" of the printer 10. The Z axis corresponds to the "height direction" of the printer 10. The printer 10 is accordingly placed on a horizontal placement surface defined by an X-axis direction and a Y-axis direction. In FIGS. 1 and 2, a +Z-axis direction (i.e., upward on the sheet surface) is also called vertically upward direction, and a −Z-axis direction (i.e., downward on the sheet surface) is also called vertically downward direction. XYZ axes in the directions corresponding to those in FIGS. 1 and 2 are also illustrated in FIG. 3 and subsequent drawings as needed.

The liquid ejection system 1 (shown in FIG. 2) includes the printer 10 serving as a liquid ejection apparatus and four liquid supply devices 50. The printer 10 is an inkjet printer. The printer 10 ejects ink in the liquid form (in the form of droplets) on a recording medium such as paper, so as to perform printing on the recording medium.

In the use state of the liquid ejection system 1, the liquid supply devices 50 are placed inside of the printer 10 as shown in FIG. 1. In the use state of the liquid ejection system 1, the printer 10 is ready for printing operations. In the injection state of the liquid ejection system 1, the liquid supply devices 50 are exposed outside of the printer 10 as shown in FIG. 2 and are ready for injection of ink into the liquid supply devices 50. In the description below, the attitude taken by the liquid supply devices 50 in the use state may be called "use attitude". The attitude taken by the liquid supply devices 50 in the injection state may be called "injection attitude". The direction of a liquid fill port 58 provided in each of the liquid ejection devices 50 differs in the use attitude and in the injection attitude. In the use attitude, the liquid fill port 58 is open to face in a horizontal direction. In the injection attitude, on the other hand, the liquid fill port 58 is open to face in the vertically upward direction. According to another embodiment, in the use attitude, the liquid fill port 58 may be open to face in a direction including a horizontal direction component. In the injection attitude, the liquid fill port 58 may be open to face in a direction including a vertically upward direction component.

The printer 10 (shown in FIG. 2) includes an operation panel 11, a housing 12, a paper discharge portion 16, a controller 19, a carriage unit 25 and a placement mechanism 30. The carriage unit 25 includes a carriage 18 and four sub-tanks 20. The four sub-tanks 20 are provided to contain inks of different colors. More specifically, the four sub-tanks 20 are a sub-tank 20K configured to contain black ink, a sub-tank 20C configured to contain cyan ink, a sub-tank 20M configured to contain magenta ink and a sub-tank 20Y configured to contain yellow ink. The ink herein may be any of various inks, such as a pigment ink or a dye ink. The four sub-tanks 20 are mounted on the carriage 18. According to this embodiment, when there is no need to distinguish the four sub-tanks 20K to 20Y from one another, these sub-tanks are expressed by the common reference sign "20".

The housing 12 is formed in an approximately rectangular parallelepiped shape. The housing 12 includes a front face (first face, first wall) 101, a rear face (second face, second wall) 102, a left side face (first side face, first side wall) 103, a right side face (second side face, second side wall) 104, a top face (third face, third wall) 105 and a bottom face (fourth face, fourth wall) 106. The six faces 101 to 106 constitute the housing 12 as the outer shell of the printer 10. The front face 101 and the rear face 102 are opposed to each other. Similarly the left side face 103 and the right side face 104 are opposed to each other. The front face 101, the rear face 102, the left side face 103 and the right side face 104 are faces arranged approximately perpendicular to the placement surface of the printer 10. The left side face 103 and the right side face 104 are respectively arranged to intersect with both the front face 101 and the rear face 102. The top face 105 and the bottom face 106 are also opposed to each other. The top face 105 and the rear face 106 are faces arranged approximately horizontal to the placement surface of the printer 10. According to this embodiment, the terms "approximately perpendicular" and "approximately horizontal" include the meanings of roughly "perpendicular" and roughly "horizontal", in addition to the meanings of completely "perpendicular" and completely "horizontal". Each of the faces 101 to 106 is thus not limited to a perfectly flat surface but is allowed to have some irregularities and to be roughly "perpendicular" or roughly "horizontal" in appearance.

The X-axis direction described above is the direction in which the left side face 103 and the right side face 104 are opposed to each other. The Y-axis direction is the direction in which the front face 101 and the rear face 102 are opposed to each other. The Z-axis direction is the direction in which the top face 105 and the bottom face 106 are opposed to each other.

The operation panel 11 and the paper discharge portion 16 are provided on the front face 101 of the housing 12. The operation panel 11 includes a plurality of buttons used to operate the respective parts of the printer 10 and a display unit (for example, LEDs) indicating the state of the printer 10. The operation panel 11 may be operated, for example, to power ON and OFF the printer 10. The paper discharge portion 16 is configured to eject the printed recording media.

The carriage 18 is provided inside of the housing 12. The carriage 18 is configured to be movable in a main scanning direction (paper width direction, X-axis direction). The carriage 18 is moved via a timing belt (not shown) by driving a stepping motor (not shown). A liquid ejection head 14 is provided on a lower face of the carriage 18. Printing is performed by ejecting inks from a plurality of nozzles provided in the liquid ejection head 14 onto a recording medium such as paper. Various components of the printer 10, for example, the timing belt and the carriage 18, are placed in the housing 12 to be protected. The liquid ejection head 14 is configured to be moved in the main scanning direction according to this embodiment, but may have another configuration. For example, the liquid ejection head 14 may be a line head that is extended over the main scanning direction (X-axis direction) and is fixed at a position.

The placement mechanism 30 places the liquid supply devices 50 inside of the housing 12 in the use state. The placement mechanism 30 is provided in a right side portion on the front face 101 of the housing 12. As shown in FIG. 2, the placement mechanism 30 includes a plate-like case 40 that forms part of the front face 101. The case 40 is formed in a rectangular shape (as shown in FIG. 1) and includes a hinge 41 provided at a bottom of the case 40 to fix the case 40 to the housing 12 and rotate the case 40 in a direction of arrow YR about the bottom as the supporting point. The liquid supply devices 50 are detachably attached to the case 40. The case 40 is approximately perpendicular to the placement surface in the use state shown in FIG. 1 (in the use attitude) and is approximately parallel to the placement surface in the injection state shown in FIG. 2 (in the injection attitude). When ink is to be injected into the liquid supply device 50, the user rotates an upper portion of the case 40 in the direction of arrow YR shown in FIG. 1 to change the attitude of the liquid supply devices 50 from the use attitude to the injection attitude. In the injection attitude, the user injects ink through the liquid fill port 58 described later into the liquid supply device 50.

The four liquid supply devices 50 (shown in FIG. 2) are provided to contain inks corresponding to the color inks contained in the four sub-tanks 20. More specifically, a liquid supply device 50K is provided to contain black ink. A liquid supply device 50C is provided to contain cyan ink. A liquid supply device 50M is provided to contain magenta ink. A liquid supply device 50Y is provided to contain yellow ink. The ink herein may be any of various inks such as a pigment ink or a dye ink. The liquid supply device 50 is configured to contain a larger amount of ink than the amount of ink contained in the sub-tank. According to this embodiment, when there is no need to distinguish the four liquid supply devices 50K to 50Y, these liquid supply devices are expressed by the common reference sign "50".

The four liquid supply devices 50 (shown in FIG. 2) are arrayed along the X-axis direction. The liquid supply device 50 includes the liquid fill port 58 provided to allow ink to be injected inside (i.e., a liquid containing chamber described later), an air outlet port 59 configured to introduce the air inside accompanied with consumption of ink, and a liquid discharge portion 53 connected with a tube 99 described later to discharge ink toward the carriage unit 25.

The liquid supply devices 50 provided to contain the respective color inks are connected with the sub-tanks 20 configured to contain the corresponding color inks by means of the tubes 99 serving as the liquid supply flow paths. The tubes 99 may be made of a flexible material such as synthetic rubber. When ink contained in the sub-tank 20 is consumed by ejection of ink from the liquid ejection head 14, ink contained in the liquid supply device 50 is supplied to the sub-tank 20 through the tube 99. The sub-tank 20 is configured to communicate with the liquid ejection head 14. This configuration enables the liquid ejection system 1 to continue printing for a long time period without interruption. As described above, the tube 99 is provided to make the liquid ejection head 14 communicate with the liquid supply device 50. According to another configuration without the sub-tanks 20, ink may be directly supplied from the liquid supply device 50 to the liquid ejection head 14 through the tube 99.

A-2. Outline of Liquid Supply Device

For the purpose of better understanding, the mechanism of supplying ink from the liquid supply device 50 to the printer 10 is described, prior to description of the detailed configuration of the liquid supply device 50. FIG. 3 is a conceptual diagram illustrating a pathway from the air outlet port 59 to the liquid discharge portion 53. In the description below, the terms "upstream" and "downstream" are based on the flow direction of a fluid from the air outlet port 59 toward the liquid discharge portion 53.

The pathway (flow path) from the air outlet port 59 to the liquid discharge portion 53 is roughly divided into an air communication path 56, a liquid containing chamber 52 and a buffer chamber 54. The air communication path 56 includes a first connection portion 568 at one end that is connected with the liquid containing chamber 52 and the air outlet port 59 at the other end that is open to the atmosphere. The buffer chamber 54 is provided in the middle of the air communication path 56. The buffer chamber 54 has a larger flow passage area than the air communication path 56. The buffer chamber 54 serves to contain ink flowing from the liquid containing chamber 52 into the air communication path 56 and suppress the ink from flowing to the air outlet port 59-side.

The air communication path 56 includes an air inlet portion 57 and a connection path 562 arranged sequentially from the upstream side. The buffer chamber 54 is placed between the air inlet portion 57 and the connection path 562 in the flow direction of the fluid from the upstream side to the downstream side.

The air inlet portion 57 is configured to introduce the atmosphere (air) into the buffer chamber 54. The air inlet portion 57 includes an air-side connection portion 564 formed at one end and the air outlet port 59 formed at the other end. The air-side connection portion 564 is connected with the buffer chamber 54. The air-side connection portion 564 is provided as an opening that allows the fluid to pass through. In other words, the air-side connection portion 564 is open to the buffer chamber 54.

The connection path 562 is arranged to connect the buffer chamber 54 with the liquid containing chamber 52 and introduce the air from the buffer chamber 54 into the liquid containing chamber 52 with consumption of ink contained in the liquid containing chamber 52. The connection path 562 is part of the air communication path 56 that is located on the downstream side of the buffer chamber 54. The connection path 562 includes the first connection portion 568 at one end (downstream end) that is connected with the liquid containing chamber 52 and a second connection portion 566 at the other end (upstream end) that is connected with the buffer chamber 54. The first connection portion 568 and the second connection portion 566 are provided as openings that allow the fluid to pass through. In other words, the first connection portion 568 is open to the liquid containing chamber 52, and the second connection portion 566 is open to the buffer chamber 54. In the use attitude, a liquid surface that is directly exposed to the atmosphere is formed in the first connection portion 568. The air is introduced into the liquid containing chamber 52 by introducing the air (air bubbles) from the first connection portion 568 into the ink contained in the liquid containing chamber 52. It is preferable that the flow passage areas of the connection path 562 and the first connection portion 568 are small enough to allow for formation of a meniscus (liquid surface bridging).

The liquid containing chamber 52 is configured to contain ink that is to be supplied to the liquid ejection head 14. The liquid containing chamber 52 is connected with the liquid discharge portion 53. The liquid discharge portion 53 is a part to be connected with the tube 99. The liquid discharge portion 53 has one end 533 that is open to the outside and the other end 569 that is open to the liquid containing chamber 52. Ink contained in the liquid containing chamber 52 is supplied to the liquid ejection head 14 through the liquid discharge portion 53 and the tube 99. In the unused state of the liquid supply device 50 prior to connection with the tube 99 (shown in FIG. 2), one end 533 is sealed by a peelable film or the like.

The pathway described above is only illustrative and may be modified and changed in any of various ways. For example, a connection member configured to connect a flow path with another flow path and a gas-permeable liquid-proof member (for example, gas-liquid separation membrane) configured to suppress a liquid from flowing upstream may be provided in the middle of the air communication path 56. Another pathway (not described) may additionally be provided in the pathway from the air outlet port 59 to the liquid discharge portion 53.

Figure 4:
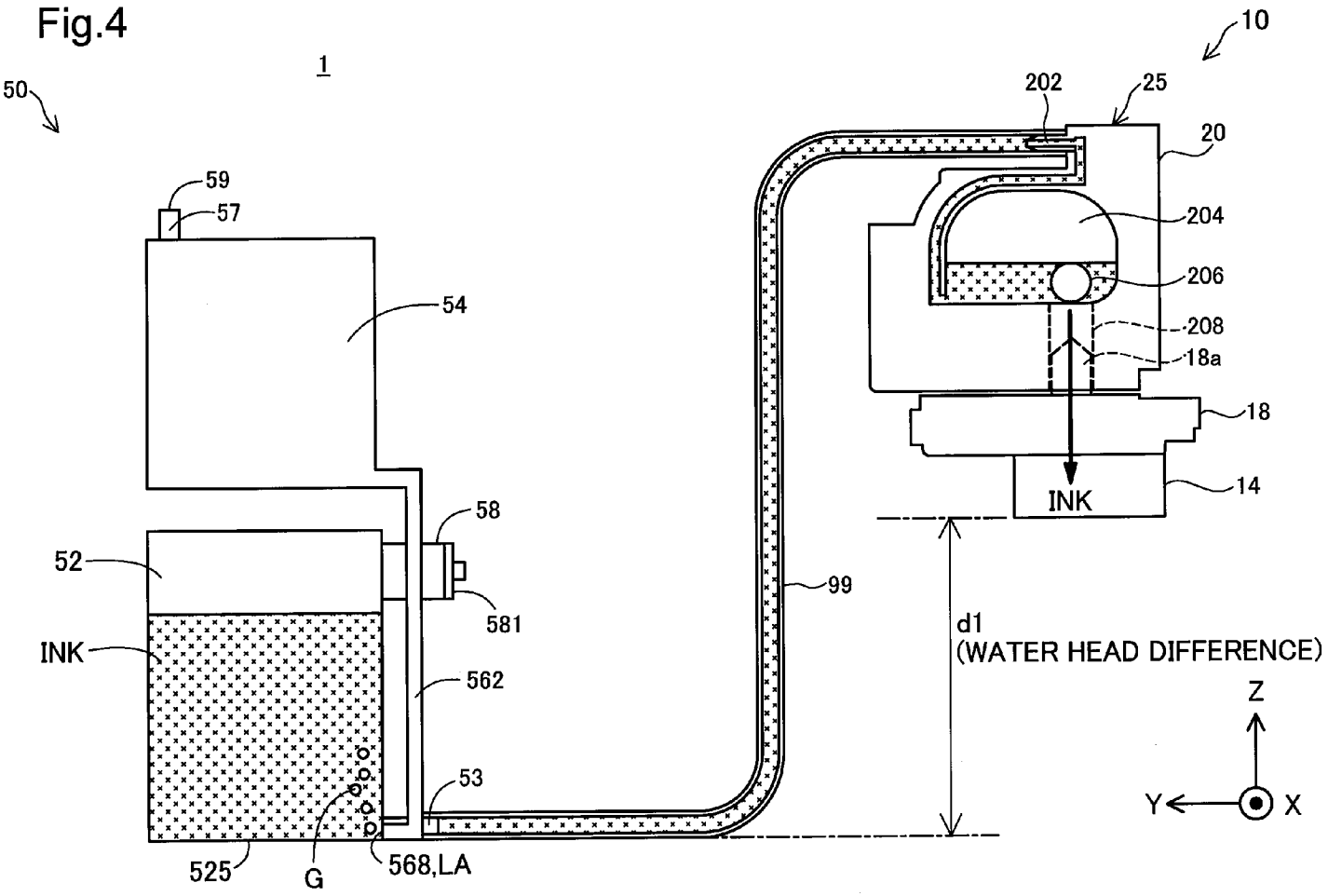
FIG. 4 is a diagram illustrating the principle of ink supply.

For the purpose of better understanding, the principle of supplying ink from the liquid supply device 50 to the sub-tank 20 is described with reference to FIG. 4. FIG. 4 is a diagram illustrating the principle of supplying ink from the liquid supply device 50 to the sub-tank 20. FIG. 4 is a schematic diagram of the liquid supply device 50 when the liquid supply device 50 is viewed from a +X-axis direction side in the use attitude. FIG. 4 also schematically illustrates the inside of the tube 99 and the carriage unit 25.

The liquid supply device 50 of this embodiment uses the Mariotte bottle principle to supply ink to the printer 10.

The liquid discharge portion 53 of the liquid supply device 50 is connected with a liquid receiving portion 202 of the sub-tank 20 via the tube 99. The sub-tank 20 may be molded from a synthetic resin such as polystyrene or polyethylene. The sub-tank 20 includes a liquid reserving chamber 204, a liquid flow path 208 and a filter 206. A liquid supply needle 18*a* of the carriage 18 is inserted into the liquid flow path 208. The filter 206 serves to trap any impurity such as a foreign substance mixed in ink and thereby suppress the impurity from flowing into the liquid ejection head 14. The ink in the liquid reserving chamber 204 is supplied through the liquid flow path 208 and the liquid supply needle 18*a* to the liquid ejection head 14 by suction from the liquid ejection head 14. The ink supplied to the liquid ejection head 14 is ejected toward outside (toward the recording medium) via nozzles.

When the liquid fill port 58 is sealed with a plug member 581 and the attitude of the liquid supply device 50 is changed to the use attitude after injection of ink through the liquid fill port 58 into the liquid containing chamber 52 in the injection attitude, the air included in the liquid containing chamber 52 is increased to provide a negative pressure in the liquid containing chamber 52. Additionally, the negative pressure in the liquid containing chamber 52 is maintained by suction of ink contained in the liquid containing chamber 52 from the liquid ejection head 14.

In the use attitude, the first connection portion 568 is located on the lower side in the vertical direction of the liquid containing chamber 52. More specifically, in the use attitude, the first connection portion 568 is provided at a location lower than half the height of the liquid containing chamber 52 in the Z-axis direction. According to this embodiment, the first connection portion 568 is formed to be adjacent to a wall 525 that forms a bottom face of the liquid containing chamber 52. This configuration causes a liquid surface (air-exposing liquid surface) LA that is directly exposed to the atmosphere to be maintained at a constant height for a long time period even when the ink contained in the liquid containing chamber 52 is consumed to lower the liquid level in the liquid containing chamber 52. The first connection portion 568 is arranged to be located below the liquid ejection head 14 in the use attitude. This causes a water head difference d1.

Suction of ink in the liquid reserving chamber 204 by the liquid ejection head 14 provides a predetermined or greater negative pressure in the liquid reserving chamber 204. Providing the predetermined or greater negative pressure in the liquid reserving chamber 204 causes the ink contained in the liquid containing chamber 52 to be supplied through the tube 99 to the liquid reserving chamber 204. Accordingly an amount of ink equal to the flow-out amount to the liquid ejection head 14 is automatically filled from the liquid containing chamber 52 to the liquid reserving chamber 204. In other words, ink is supplied from the liquid containing chamber 52 to the liquid reserving chamber 204 when the suction force (negative pressure) from the printer 10-side becomes larger by some degree than the water head difference d1 that is caused by the height difference in the vertical direction between the ink surface (air-exposing liquid surface) LA and the liquid ejection head 14.

When the ink contained in the liquid containing chamber 52 is consumed, the air in the buffer chamber 54 is introduced in the form of air bubbles G through the connection path 562 into the liquid containing chamber 52. This lowers the liquid level in the liquid containing chamber 52. The air-exposing liquid surface LA that is directly exposed to the atmosphere is, on the other hand, maintained at a constant height, so that the water head difference d1 is maintained constant. Ink is thus stably supplied from the liquid supply device 50 to the liquid ejection head 14 by a predetermined suction force of the liquid ejection head 14.

A-3. Configuration of Liquid Supply Device

Figure 5:
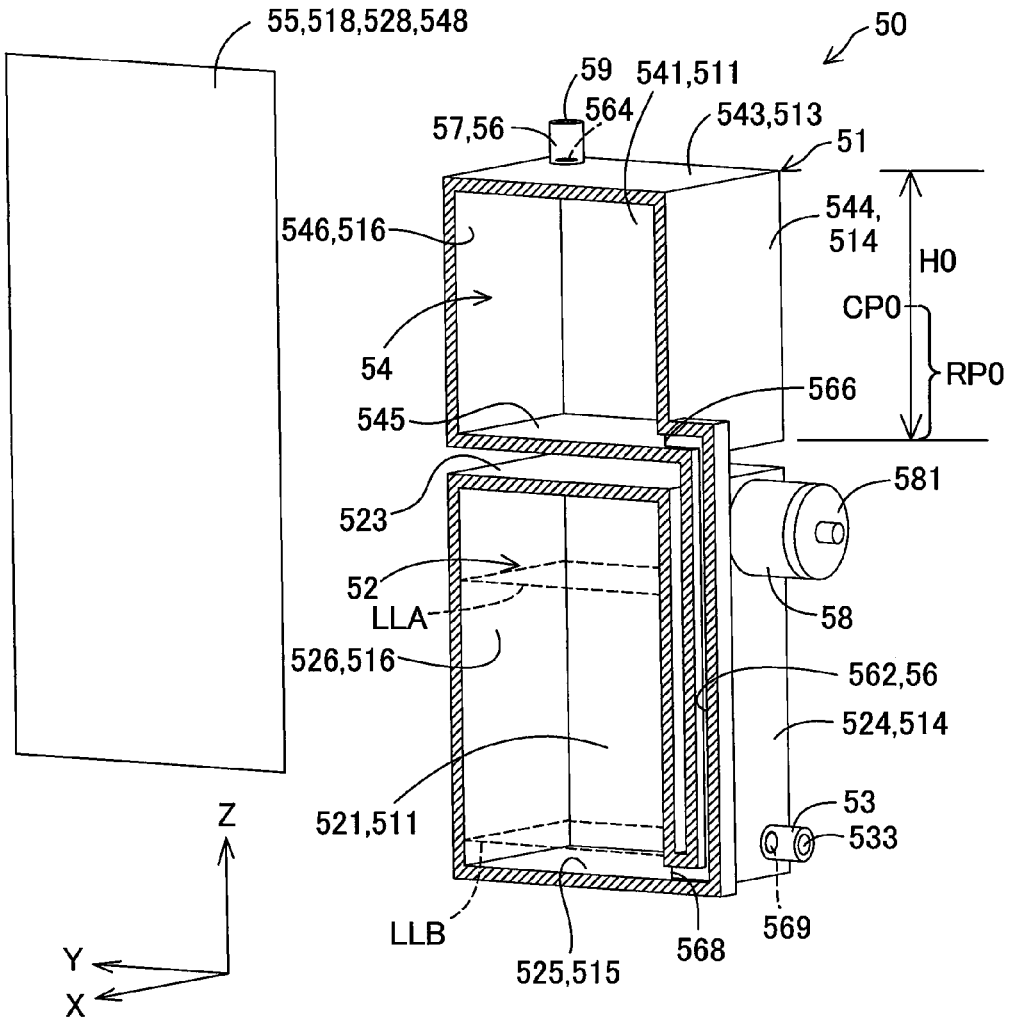
FIG. 5 is an exploded perspective view illustrating a liquid supply device according to the first embodiment.
Figure 6:
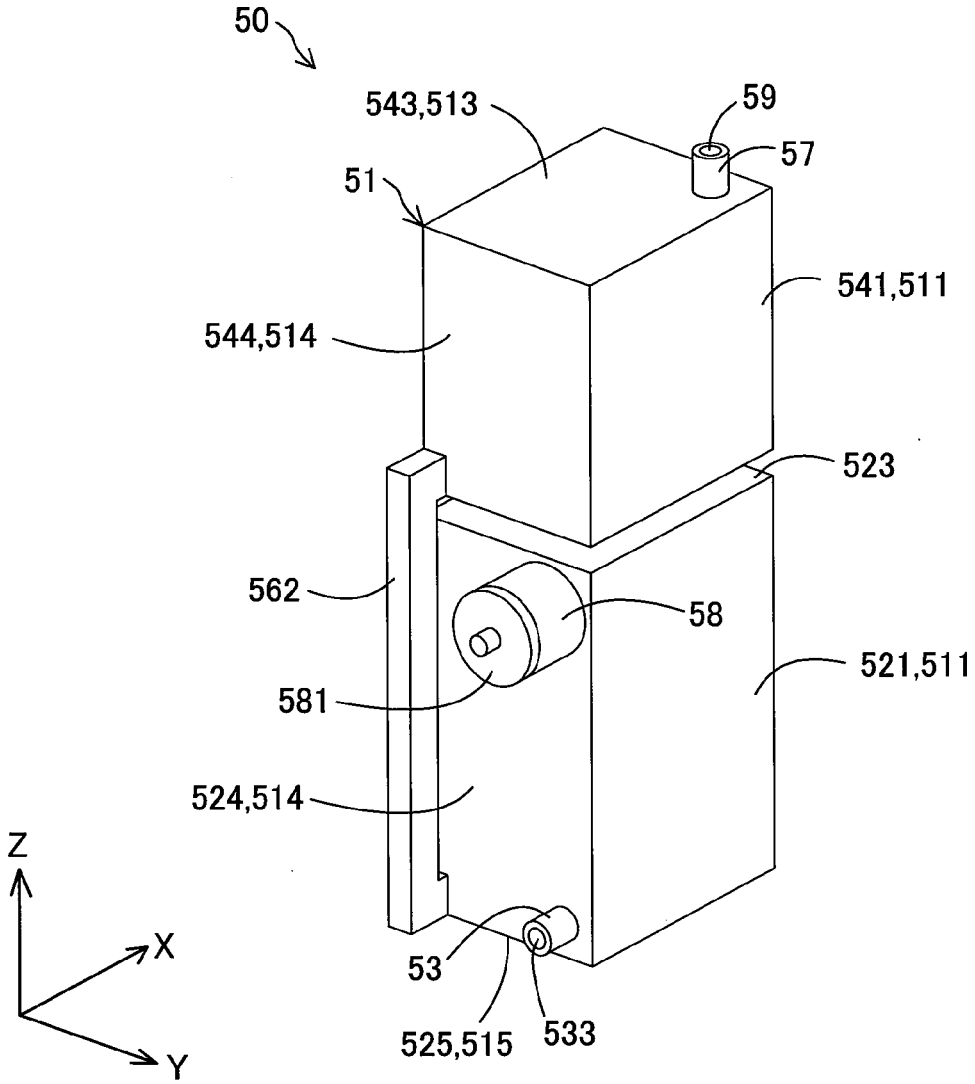
FIG. 6 is a perspective view illustrating the liquid supply device.

FIG. 5 is an exploded perspective view illustrating the liquid supply device 50. FIG. 6 is a perspective view illustrating the liquid supply device 50. XYZ axes in the use state are illustrated in FIGS. 5 and 6. A film 55 shown in FIG. 5 is omitted from the illustration of FIG. 6.

The liquid supply device 50 (shown in FIG. 5) includes a container body 51 and a film 55. The container body 51 is formed in a concave shape having one open side face. Attaching the film 55 to an end face of the concave shape by heat sealing or the like partitions and defines the respective chambers (for example, the liquid containing chamber 52 and the buffer chamber 54). Part of the container body 51 which the film 55 is attached to is shown by single hatching in FIG. 5. According to another embodiment, the liquid supply device 50 may be configured to partition and define the respective chambers by the container body 51 without using a film or may be configured to partition and define the respective chambers by using a container body having openings in two or more directions and two or more films provided to cover the openings.

The container body 51 is integrally molded from a synthetic resin such as polypropylene. The container body 51 is translucent or transparent. This configuration enables the user to check the state of ink (level of ink) inside of the container body 51 (more specifically, in the liquid containing chamber 52) from outside. According to another embodiment, the container body 51 may be configured to include a translucent or transparent part of walls partitioning and defining the liquid containing chamber 52, such as to enable the state of ink in the liquid containing chamber 52 to be checked from outside in the use attitude and in the injection attitude. According to another embodiment, the container body 51 may be not necessarily translucent or transparent. In this latter configuration, it is preferable that the liquid containing chamber 52 is provided with a sensor mechanism to detect the remaining amount of the liquid. The sensor mechanism may be, for example, a mechanism such as a pair of electrodes, a prism or a piezoelectric vibrator that output different signals in the ink soaked state and in the ink non-soaked state.

The liquid supply device 50 is formed in an approximately rectangular parallelepiped outer shape. The outer shell of the liquid supply device 50 is formed by a first container wall (first container face) 511, a second container wall (second container face) 513, a third container wall (third container face) 514, a fourth container wall (fourth container face) 515, a fifth container wall (fifth container face) 516 and a sixth container all (sixth container face) 518. The first container wall 511 to the fifth container wall 516 are formed by the container body 51. The sixth container wall 518 is formed by the film 55. The first container wall 511 forms a bottom face of the container body 51 in the concave shape. The second container wall 513 to the fifth container wall 516 form side faces of the container body 51 rising from the first container wall 511.

The first container wall 511 and the sixth container wall 518 are opposed to each other. The second container wall 513 and the fourth container wall 515 are opposed to each other. The third container wall 514 and the fifth container wall 516 are opposed to each other. In the description hereof, the term "opposed" means the concept including the state that two elements directly face each other without any other member placed therebetween and the state that two elements face each other with another member placed therebetween.

The first container wall 511, the third container wall 514, the fifth container wall 516 and the sixth container wall 518 are arranged to intersect with the second container wall 513 and the fourth container wall 515.

In the description hereof, the term "intersecting" of two elements (for example, walls or faces) means one of the state that two elements actually intersect with each other, the state that an extension of one element intersects with the other element and the state that extensions of the respective elements intersect with each other.

In the use attitude, the fourth container wall 515 forms a bottom face of the liquid supply device 50, and the second container wall 513 forms a top face of the liquid supply device 50. In the use attitude, the first container wall 511, the third container wall 514, the fifth container wall 516 and the sixth container wall 518 form side faces of the liquid supply device 50.

In the injection attitude, the fifth container wall 516 forms a bottom face of the liquid supply device 50, and the third container wall 514 forms a top face of the liquid supply device. In the injection attitude, the first container wall 511, the second container wall 513, the fourth container wall 515 and the sixth container wall 518 form side faces of the liquid supply device 50.

The liquid supply device 50 includes the liquid containing chamber 52, the air communication path 56, the buffer chamber 54, the liquid fill port 58, the plug member 581 and the liquid discharge portion 53.

The liquid containing chamber 52 is formed in an approximately rectangular parallelepiped outer shape. The inner space of the liquid containing chamber 52 is similarly formed in an approximately rectangular parallelepiped shape. The ink level in the liquid containing chamber 52 reaches an upper limit line LLA shown by the dotted line as an upper limit amount of ink immediately after injection of ink in the liquid containing chamber 52. The ink level in the liquid containing chamber 52 reaches a lower limit line LLB shown by the dotted line as a lower limit amount of ink after consumption of ink in the liquid containing chamber 52. The upper limit amount of ink denotes an amount of ink when the user injects ink through the liquid fill port 58 to a predetermined level specified by a mark or the like formed in the liquid containing chamber 52 in the injection attitude. According to this embodiment, the upper limit amount of ink is set such that the ink surface is located slightly below the liquid fill port 58 when the attitude of the liquid supply device 50 is changed from the injection attitude to the use attitude. The lower limit amount of ink denotes an amount of ink that requires injection of ink and is specified by a mark or the like formed in the liquid containing chamber 52 in the use attitude. According to this embodiment, the lower limit amount of ink is set such that the ink surface is located slightly above the liquid discharge portion 53 in the use attitude.

The liquid containing chamber 52 is formed by a first containing chamber wall (first containing chamber face) 521, a second containing chamber wall (second containing chamber face) 523, a third containing chamber wall (third containing chamber face) 524, a fourth containing chamber wall (fourth containing chamber face) 525, a fifth containing chamber wall (fifth containing chamber face) 526 and a sixth containing chamber wall (sixth containing chamber face) 528. The first containing chamber wall 521 is formed by part of the first container wall 511. The second containing chamber wall 523 is formed by the container body 51. The third containing chamber wall 524 is formed by part of the third container wall 514. The fourth containing chamber wall 525 is formed by the fourth container wall 515. The fifth containing chamber wall 526 is formed by part of the fifth container wall 516. The sixth containing chamber wall 528 is formed by part of the sixth container wall 518.

The first containing chamber wall 521 and the sixth containing chamber wall 528 are opposed to each other. The second containing chamber wall 523 and the fourth containing chamber wall 525 are opposed to each other. The third containing chamber wall 524 and the fifth containing chamber wall 526 are opposed to each other. The first containing chamber wall 521, the third containing chamber wall 524, the fifth containing chamber wall 526 and the sixth containing chamber wall 528 are arranged to intersect with the second containing chamber wall 523 and the fourth containing chamber wall 525.

In the use attitude, the fourth containing chamber wall 525 forms a bottom face of the liquid containing chamber 52, and the second containing chamber wall 523 forms a top face of the liquid containing chamber 52. In the use attitude, the first containing chamber wall 521, the third containing chamber wall 524, the fifth containing chamber wall 526 and the sixth containing chamber wall 528 form side faces of the liquid containing chamber 52.

In the injection attitude, the fifth containing chamber wall 526 forms a bottom face of the liquid containing chamber 52, and the third containing chamber wall 524 forms a top face of the liquid containing chamber 52. In the injection attitude, the first containing chamber wall 521, the second containing chamber wall 523, the fourth containing chamber wall 525 and the sixth containing chamber wall 528 form side faces of the liquid containing chamber 52.

The liquid fill port 58 has one end that is connected with the liquid containing chamber 52 and the other end that is open to the outside. In the use attitude, the liquid fill port 58 is open in the horizontal direction. The liquid fill port 58 is a cylindrical member that is protruded from the third containing chamber wall 524. According to this embodiment, the liquid fill port 58 is provided on the third containing chamber wall 524 at a position closer to the second containing chamber wall 523 than the fourth containing chamber wall 525.

The plug member 581 is detachably attached to the liquid fill port 58. The plug member 581 may be made of a synthetic resin such as rubber. The plug member 581 is removed from the liquid fill port 58 when ink is to be injected into the liquid containing chamber 52 in the injection attitude.

The liquid discharge portion 53 is a cylindrical member that is protruded from the third containing chamber wall 524. The liquid discharge portion 53 is provided on the third containing chamber wall 524 at a position closer to the fourth containing chamber wall 525 than the second containing chamber wall 523. According to this embodiment, the liquid discharge portion 53 is provided on the third containing chamber wall 524 at a position closer to the fourth containing chamber wall 525 that forms the bottom face of the liquid containing chamber 52 in the use attitude.

The buffer chamber 54 is formed in an approximately rectangular parallelepiped outer shape. The inner space of the buffer chamber 54 is similarly formed in an approximately rectangular parallelepiped shape. The buffer chamber 54 is provided as a different chamber from the liquid containing chamber 52 and serves to temporarily store the ink flowing from the liquid containing chamber 52 to the air communication path 56-side. The buffer chamber 54 is integrally formed with the liquid containing chamber 52 to be not detachable from the liquid containing chamber 52.

According to another embodiment, the liquid containing chamber 52 and the buffer chamber 54 may be provided as different members that are detachable from each other. In this latter configuration, a flow path member such as a tube that is detachably attached to the liquid containing chamber 52 and to the buffer chamber 54 may be used for the connection path 562.

The buffer chamber 54 is formed by a first buffer chamber wall (first buffer chamber face) 541, a second buffer chamber wall (second buffer chamber face) 543, a third buffer chamber wall (third buffer chamber face) 544, a fourth buffer chamber wall (fourth buffer chamber face) 545, a fifth buffer chamber wall (fifth buffer chamber face) 546 and a sixth buffer chamber wall (sixth buffer chamber face) 548. The first buffer chamber wall 541 is formed by part of the first container wall 511. The second buffer chamber wall 543 is formed by the second container wall 513. The third buffer chamber wall 544 is formed by part of the third container wall 514. The fourth buffer chamber wall 545 is formed by part of the container body 51. The fifth buffer chamber wall 546 is formed by part of the fifth container wall 516. The sixth buffer chamber wall 548 is formed by part of the sixth container wall 518.

The first buffer chamber wall 541 and the sixth buffer chamber wall 548 are opposed to each other. The second buffer chamber wall 543 and the fourth buffer chamber wall 545 are opposed to each other. The third buffer chamber wall 544 and the fifth buffer chamber wall 546 are opposed to each other. The first buffer chamber wall 541, the second buffer chamber wall 543, the fourth buffer chamber wall 545 and the sixth buffer chamber wall 548 are arranged to intersect with the third buffer chamber wall 544 and the fifth buffer chamber wall 546.

In the use attitude, the fourth buffer chamber wall 545 forms a bottom face of the buffer chamber 54, and the second buffer chamber wall 543 forms a top face of the buffer chamber 54. In the use attitude, the first buffer chamber wall 541, the third buffer chamber wall 544, the fifth buffer chamber wall 546 and the sixth buffer chamber wall 548 form side faces of the buffer chamber 54.

In the injection attitude, the fifth buffer chamber wall 546 forms a bottom face of the buffer chamber 54, and the third buffer chamber wall 544 forms a top face of the buffer chamber 54. In the injection attitude, the first buffer chamber wall 541, the second buffer chamber wall 543, the fourth buffer chamber wall 545 and the sixth buffer chamber wall 548 form side faces of the buffer chamber 54.

The buffer chamber 54 has a larger flow passage area than that of the connection path 562. It is preferable that the buffer chamber 54 has a volume that is equal to or greater than an expected volume increase of the gas (air) present in the liquid containing chamber 52, which is calculated based on the volume of ink contained in the liquid containing chamber 52 and at least one of an amount of change of temperature and an amount of change of atmospheric pressure expected in the environment where the liquid supply device 50 is placed. The expected volume increase may be calculated, for example by using one of calculation methods (1) to (4) described below. The calculation methods (1) to (4) may be performed, for example, in the use attitude of the liquid supply device 50.

<Calculation Method (1)>

It is assumed that the volume of ink contained in the liquid containing chamber 52 is 50% of the volume of the liquid containing chamber 52. The use environment of the liquid supply device 50 is changed from an ordinary use environment where the ambient temperature is ordinary temperature (for example, 25° C.) and the atmospheric pressure is normal atmospheric pressure (101.3 kPa) to an amount-increasing use environment where an increase in amount of the air in the liquid containing chamber 52 is expected. For example, in the amount-increasing use environment, the ambient temperature may be 40° C. and the atmospheric pressure may be lower than the normal atmospheric pressure by 20 kPa (may be equal to 81.3 kPa). A change in the ambient temperature results in changing the temperature in the liquid containing chamber 52. A change in the atmospheric pressure results in changing the internal pressure of the liquid containing chamber 52 to maintain equilibrium with the pressure of the buffer chamber 54 that is exposed to the atmosphere. A volume increase of the air in the liquid containing chamber 52 when the use environment is changed from the ordinary use environment to the amount-increasing use environment is calculated as the expected volume increase. The volume of ink flowing from the liquid containing chamber 52 into the air communication path 56 and the buffer chamber 54 (flow-in ink volume) in the case of a change from the ordinary use environment to the amount-increasing use environment may be calculated as the expected volume increase of the air.

In the above calculation method (1), a volume increase of the air when the amount of change of temperature is zero (i.e., when the temperature is constant) and the atmospheric temperature is changed (for example, from the normal atmospheric pressure to a lower value than the normal atmospheric temperature by 20 kPa) may be calculated as the expected volume increase (calculation method (2)). In the above calculation method (1), a volume increase of the air when the amount of change of atmospheric pressure is zero and the ambient temperature is changed (for example, from room temperature to 40° C.) may be calculated as the expected volume increase (calculation method (3)). The greater between the value calculated by the above calculation method (2) and the value calculated by the above calculation method (3) may be specified as the expected volume increase (calculation method (4)).

According to this embodiment, the expected volume increase calculated by the above calculation method (4) is within a range of 25% to 50% of the volume of the liquid containing chamber 52. According to this embodiment, the volume of the buffer chamber 54 is set equal to the expected volume increase.

In the above calculation methods (1) to (4), the ink volume of the liquid containing chamber 52 that is used as the basis for calculation of the expected volume increase (reference ink volume) is, however, not limited to 50% of by volume of the liquid containing chamber 52. For example, the reference ink volume may be set to any value in a range of 25% to 80% of the volume of the liquid containing chamber 52. In the above calculation methods (1) to (4), when the increased volume of the gas is greater than the reference ink volume, the reference ink volume may be set as the expected volume increase. This is because no ink further flows into the buffer chamber 54 after the reference ink volume of ink flows into the buffer chamber 54.

The air-side connection portion 564 at one end of the air inlet portion 57 is connected with the buffer chamber 54, while the air outlet port 59 at the other end of the air inlet portion 57 is open to the outside. The air inlet portion 57 is a cylindrical member protruded from the second buffer chamber wall 543.

The connection path 562 (shown in FIG. 6) that is part of the air communication path 56 is a flow path that is protruded to the outer side of the third container wall 514. The flow passage area of the connection path 562 is smaller than the flow passage areas of the liquid containing chamber 52 and the buffer chamber 54. The depth of the connection path 562 formed by the concave shape of the container body 51 is smaller than the depths of the liquid containing chamber 52 and the buffer chamber 54 formed by the container body 51.

The first connection portion 568 of the connection path 562 (shown in FIG. 5) is formed as an opening in the third containing chamber wall 524 of the liquid containing chamber 52. The first connection portion 568 is provided on the third containing chamber wall 524 at the position closer to the fourth containing chamber wall 525 that forms the bottom face of the liquid containing chamber 52 than the second containing chamber wall 523 that forms the top face of the liquid containing chamber 52. According to this embodiment, the first connection portion 568 is open in the third containing chamber wall 524 to be adjacent to the fourth containing chamber wall 525.

The second connection portion 566 of the connection path 562 is formed as an opening in the third buffer chamber wall 544 of the buffer chamber 54. The second connection portion 566 is provided on the third buffer chamber wall 544 at the position closer to the fourth buffer chamber wall 545 that forms the bottom face of the buffer chamber 54 than the second buffer chamber wall 543 that forms the top face of the buffer chamber 54. The second connection portion 566 is accordingly provided in a lower side portion in the vertical direction in the use attitude. According to this embodiment, the second connection portion 566 is open in the third buffer chamber wall 544 to be adjacent to the fourth buffer chamber wall 545.

A-4. Position of Flow Path

Figure 7:
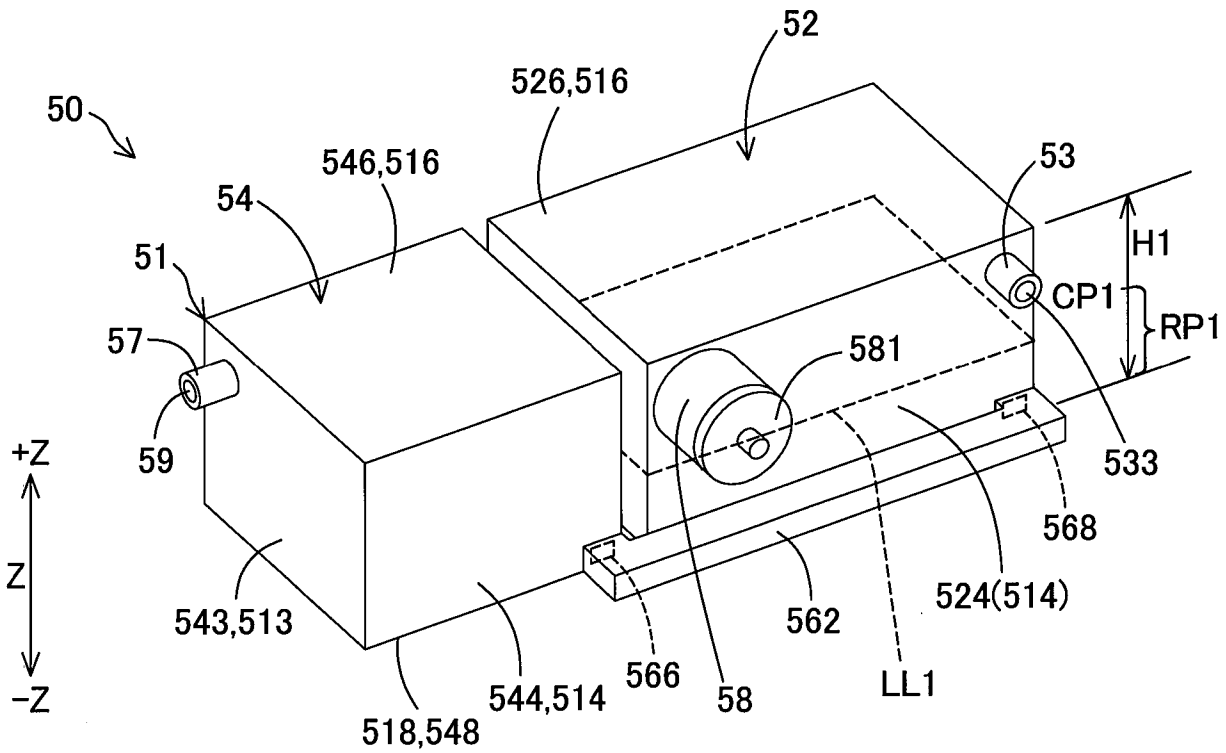
FIG. 7 is a perspective view illustrating the liquid supply device in a first submerged attitude.
Figure 8:
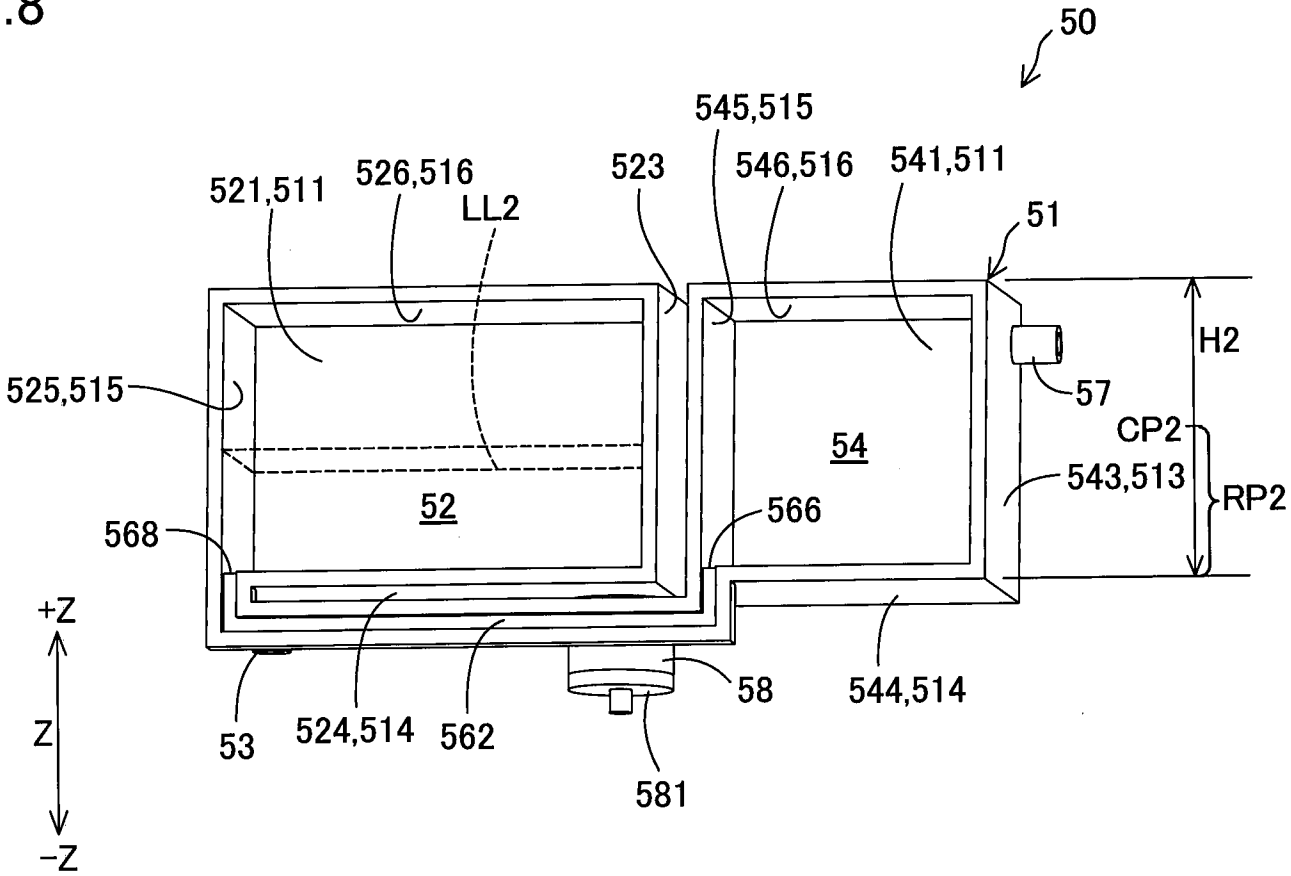
FIG. 8 is a perspective view illustrating the liquid supply device in a second submerged attitude.

The following describes the position of the flow path with reference to FIG. 7 and FIG. 8 in addition to FIG. 5 and FIG. 6. FIG. 7 is a perspective view illustrating the liquid supply device 50 in a first submerged attitude. FIG. 8 is a perspective view illustrating the liquid supply device 50 in a second submerged attitude. The film 55 shown in FIG. 5 is omitted from the illustration of FIGS. 7 and 8.

The first submerged attitude and the second submerged attitude denote attitudes in which the first connection portion 568 is located in the liquid (i.e., below the liquid level in the liquid containing chamber 52) when ink is contained in the liquid containing chamber 52 (for example, when the volume of ink contained in the liquid containing chamber 52 is approximately half the volume of the liquid containing chamber 52). In other words, the first submerged attitude and the second submerged attitude denote attitudes in which the first connection portion 568 is exposed to ink in the liquid containing chamber 52. In the first submerged attitude shown in FIG. 7, the sixth container wall 518 forms a bottom face of the liquid supply device 50. In the first submerged attitude, the liquid level in the liquid containing chamber 52 may be, for example, a liquid level LL1. In the second submerged attitude shown in FIG. 8, the third container wall 514 forms a bottom face of the liquid supply device 50. In the second submerged attitude, the liquid level in the liquid containing chamber 52 may be, for example, a liquid level LL2. In FIGS. 7 and 8, the vertical direction is the Z-axis direction. The +Z-axis direction is vertically upward direction, and the −Z-axis direction is vertically downward direction.

The use attitude shown in FIG. 5, the first submerged attitude shown in FIG. 7 and the second submerged attitude shown in FIG. 8 are attitudes in which the first connection portion 568 is located at the position closer to the bottom face than the top face of the liquid containing chamber 52 (near to the bottom face according to the embodiment) out of the six attitudes in which each one of the walls 511, 513, 514, 515, 516 and 518 of the liquid supply device 50 in the approximately rectangular parallelepiped shape forms a bottom face of the liquid supply device 50.

In the use attitude shown in FIG. 5, the first connection portion 568 is located in the liquid. In other words, in the use attitude shown in FIG. 5, the first connection portion 568 is exposed to ink in the liquid containing chamber 52. It can be said that the first connection portion 568 is exposed to ink in the liquid containing chamber 52 in the state that part of ink contained in the liquid containing chamber 52 flows into the connection path 562-side including the first connection portion 568. In this attitude, the second connection portion 566 configured to connect the buffer chamber 54 with the connection path 562 that is part of the air communication path 56 located on the downstream side of the buffer chamber 54, is located in a vertically lower area RP0 of the buffer chamber 54. The area RP0 denotes an area from a center CP0 of a height H0 of the buffer chamber 54 to the bottom face of the buffer chamber 54 (i.e., the fourth buffer chamber wall 545) in the use attitude.

In the first submerged attitude shown in FIG. 7, the first connection portion 568 is located in the liquid. In other words, in the first submerged attitude shown in FIG. 7, the first connection portion 568 is exposed to ink in the liquid containing chamber 52. In this attitude, the second connection portion 566 is located in a vertically lower area RP1 of the buffer chamber 54. The area RP1 denotes an area from a center CP1 of a height H1 of the buffer chamber 54 to the bottom face of the buffer chamber 54 (i.e., the sixth buffer chamber wall 548) in the first submerged attitude. According to this embodiment, in the first submerged attitude, the second connection portion 566 is adjacent to the bottom face (i.e., the sixth buffer chamber wall 548).

In the second submerged attitude shown in FIG. 8, the first connection portion 568 is located in the liquid. In other words, in the second submerged attitude shown in FIG. 8, the first connection portion 568 is exposed to ink in the liquid containing chamber 52. In this attitude, the second connection portion 566 is located in a vertically lower area RP2 of the buffer chamber 54. The area RP2 denotes an area from a center CP2 of a height 112 of the buffer chamber 54 to the bottom face of the buffer chamber 54 (i.e., the third buffer chamber wall 544) in the second submerged attitude. According to this embodiment, in the second submerged attitude, the second connection portion 566 is adjacent to the bottom face (i.e., the third buffer chamber wall 544).

As described above, in the liquid supply device 50, when the first connection portion 568 is located in the liquid, i.e., when the first connection portion 568 is exposed to ink in the liquid containing chamber 52, the second connection portion 568 is located in one of the vertically lower areas RP0, RP1, and RP2 of the buffer chamber 54.

The air-side connection portion 564 serving as an air-side connection portion configured to connect the air inlet portion 57 as a most upstream-side communication path with the buffer chamber 54 as a most upstream-side buffer chamber is arranged diagonally to the second connection portion 566 serving as a most upstream-side second connection portion in the buffer chamber 54. This configuration provides a long flow path length from the first connection portion 568 to the air outlet port 59 and thereby reduces the possibility that ink in the liquid containing chamber 52 is leaked out through the air outlet port 59.

A-5. Advantageous Effects

The liquid supply device 50 may be placed in various attitudes, for example, during transport. The liquid supply device 50 may be used in various environments having different temperatures and different atmospheric pressures. In the use attitude, the first submerged attitude and the second submerged attitude in which the first connection portion 568 is located in the liquid, the use environment is likely to be changed to increase the volume of the air in the liquid containing chamber 52. In this case, the volume of the air in the liquid containing chamber 52 is increased such that ink contained in the liquid containing chamber 52 is pressed toward the buffer chamber 54 through the connection path 562. Accordingly the internal pressure of the liquid containing chamber 52 is changed to maintain equilibrium with the pressure of the buffer 54 that communicates with the atmosphere. For example, it is assumed that the temperature of the air in the liquid containing chamber 52 increases with an increase of the ambient temperature and thereby increases the internal pressure of the liquid containing chamber 52. In this case, the air is introduced from the buffer chamber 54 through the connection path 562 to the liquid containing chamber 52 to decrease the internal pressure of the liquid containing chamber 52, in order to maintain equilibrium with the internal pressure of the buffer chamber 54 (normal atmospheric pressure) that communicates with the atmosphere. Ink contained in the liquid containing chamber 52 is, on the other hand, flowed into the buffer chamber 54-side by the amount equivalent to the amount of the air introduced into the liquid containing chamber 52. In another example, it is assumed that the atmospheric pressure in which the liquid supply device 50 is placed is changed from the normal atmospheric pressure to a lower value than the normal atmospheric pressure. In this case, the air in the liquid containing chamber 52 is expanded to decrease the internal pressure of the liquid containing chamber 52, in order to maintain equilibrium with the internal pressure of the buffer chamber 54. Expansion of the air in the liquid containing chamber 52 causes ink in the liquid containing chamber 52 to be flowed into the buffer chamber 54-side.

According to the above embodiment, when the first connection portion 568 is exposed to ink in the liquid containing chamber 52, the second connection portion 566 is located in one of the vertically lower areas RP0, RP1 and RP2 of the buffer chamber 54. This configuration enables ink flowing into the buffer chamber 54 to be returned to the liquid containing chamber 52 in response to a decrease in temperature or in response to an increase in atmospheric pressure after ink in the liquid containing chamber 52 is flowed into the buffer chamber 54 in response to an increase in temperature (ambient temperature) or a decrease in atmospheric pressure in the environment where the liquid supply device 50 is placed. Even when ink flows into the buffer chamber 54, this configuration makes it likely that the inflow ink is returned to the liquid containing chamber 52 and thereby reduces the possibility that ink remains in the buffer chamber 54.

Additionally, according to the above embodiment, the buffer chamber 54 is configured to have the volume that is equal to or greater than the expected volume increase, which is calculated based on the volume of ink contained in the liquid containing chamber 52 and at least one of the amount of change of temperature and the amount of change of atmospheric pressure expected in the environment where the liquid supply device 50 is placed. Even when the volume of the air present in the liquid containing chamber 52 is increased to make the ink in the liquid containing chamber 52 flow into the air communication path 56, this configuration enables the inflow ink to be stored in the buffer chamber 54. This accordingly reduces the possibility that ink flows into the upstream side of the buffer chamber 54. Setting the volume of the buffer chamber 54 approximately equivalent to the expected volume increase suppresses unnecessary expansion in size of the buffer chamber 54. This suppresses expansion in size of the liquid supply device 50 and thereby suppresses expansion in whole size of the liquid ejection system 1.

According to the above embodiment, the liquid containing chamber 52 and the buffer chamber 54 are formed integrally with each other. This configuration facilitates manufacture of the liquid supply device 50.

B. Second Embodiment

Figure 9:
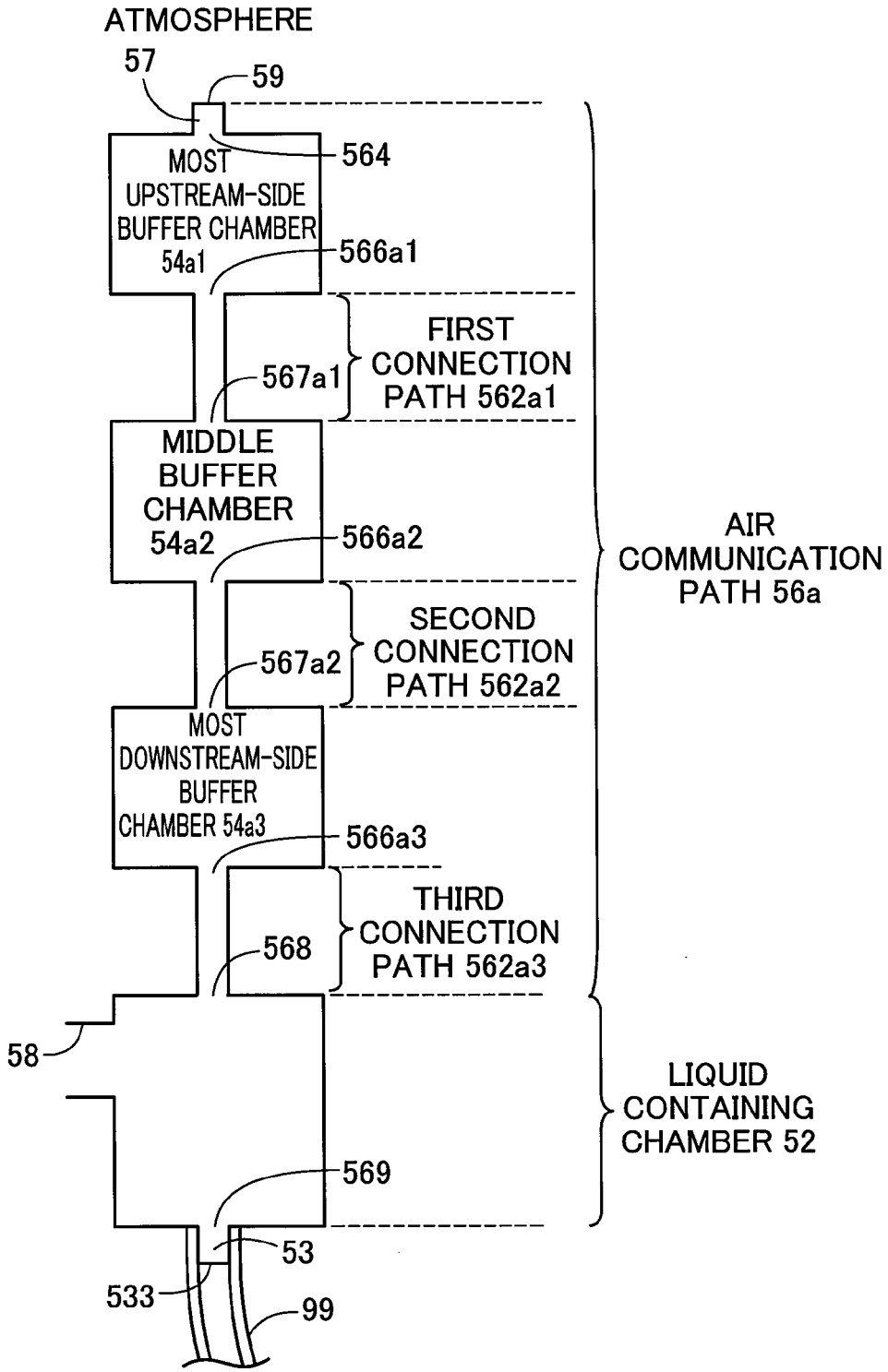
FIG. 9 is a conceptual diagram illustrating a pathway from an air outlet port to a liquid discharge portion according to a second embodiment.

FIG. 9 is a conceptual diagram illustrating a flow path from an air outlet port 59 to a liquid discharge portion 53 of a liquid supply device 50*a* according to a second embodiment of the disclosure. The liquid supply device 50*a* of the second embodiment differs from the liquid supply device 50 of the first embodiment by the number of buffer chambers 54*a*1 to 54*a*3 and the configuration of an air communication path 56*a*. Otherwise the configuration of the liquid supply device 50*a* is similar to the configuration of the liquid supply device 50. Like components are expressed by like reference signs and description of such components is omitted.

The liquid supply device 50*a* includes three buffer chambers 54*a*1, 54*a*2 and 54*a*3 that are provided in series in the middle of the air communication path 56*a*. The buffer chamber 54*a*1, the buffer chamber 54*a*2 and the buffer chamber 54*a*3 are arranged in this sequence from the upstream side to the downstream side. The buffer chamber 54*a*1 is also called "most upstream-side buffer chamber 54*a*1". The buffer chamber 54*a*2 is also called "middle buffer chamber 54*a*2". The buffer chamber 54*a*3 is also called "most downstream-side buffer chamber 54*a*3". The number of the buffer chambers is, however, not necessarily limited to the three buffer chambers 54*a*1, 54*a*2 and 54*a*3 but may be two or may be four or more according to another embodiment.

The air communication path 56*a* includes an air inlet portion 57, a first connection path 562*a*1, a second connection path 562*a*2 and a third connection path 562*a*3 which are sequentially arranged from the upstream side.

The air inlet portion 57 as a most upstream-side communication path is configured to introduce the outside atmosphere into the most upstream-side buffer chamber 54*a*1. The air inlet portion 57 includes an air-side connection portion 564 at a downstream end that is connected with the most upstream-side buffer chamber 54*a*1, and an air outlet port 59 at an upstream end that is open to the outside.

The first connection path 562*a*1 as an intermediate connection path is configured to connect the adjacent most upstream-side buffer chamber 54*a*1 with the adjacent middle buffer chamber 54*a*2 in the flow direction of fluid. The first connection path 562*a*1 serves to introduce the air in the most upstream-side buffer chamber 54*a*1 into the middle buffer chamber 54*a*2 with consumption of ink in the liquid containing chamber 52. The first connection path 562*a*1 is part of the air communication path 56*a* that is located on the downstream side of the most upstream-side buffer chamber 54*a*1. The first connection path 562*a*1 includes a second connection portion 566*a*1 at an upstream end that is connected with the most upstream-side buffer chamber 54*a*1 on the upstream side, and a third connection portion 567*a*1 at a downstream end that is connected with the middle buffer chamber 54*a*2 on the downstream side.

The second connection path 562*a*2 as an intermediate connection path is configured to connect the adjacent middle buffer chamber 54*a*2 with the adjacent most downstream-side buffer chamber 54*a*3 in the flow direction of fluid. The second connection path 562*a*2 serves to introduce the air in the middle buffer chamber 54*a*2 into the most downstream-side buffer chamber 54*a*3 with consumption of ink in the liquid containing chamber 52. The second connection path 562*a*2 is part of the air communication path 56*a* that is located on the downstream side of the middle buffer chamber 54*a*2. The second connection path 562*a*2 includes a second connection portion 566*a*2 at an upstream end that is connected with the middle buffer chamber 54*a*2 on the upstream side, and a third connection portion 567*a*2 at a downstream end that is connected with the most downstream-side buffer chamber 54*a*3 on the downstream side.

The third connection path 562*a*3 is configured to connect the adjacent most downstream-side buffer chamber 54*a*3 with the adjacent liquid containing chamber 52 in the flow direction of fluid. The third connection path 562*a*3 serves to introduce the air in the most downstream-side buffer chamber 54*a*3 to the liquid containing chamber 52 with consumption of ink in the liquid containing chamber 52. The third connection path 562*a*3 includes a second connection portion 566*a*3 at an upstream end that is connected with the most downstream-side buffer chamber 54*a*3, and a first connection portion 568 at a downstream end that is connected with the liquid containing chamber 52.

Figure 10:
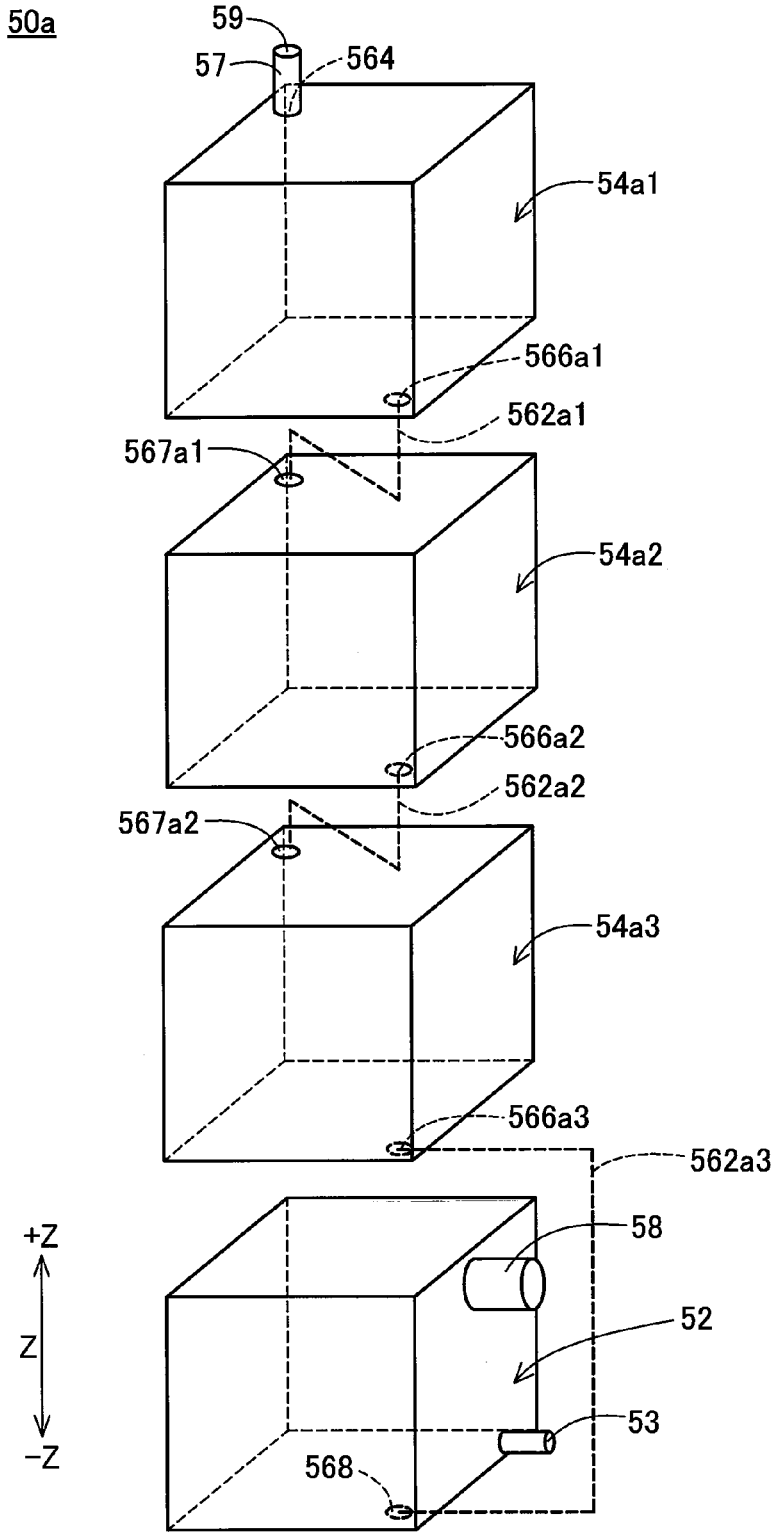
FIG. 10 is a diagram illustrating a liquid supply device according to the second embodiment.

FIG. 10 is a diagram illustrating the liquid supply device 50*a*. The Z axis is shown in FIG. 10. The vertical direction is the Z-axis direction. The +Z-axis direction is vertically upward direction, and the −Z-axis direction is vertically downward direction. FIG. 10 illustrates the liquid supply device 50*a* in the use attitude.

Each of the buffer chambers 54*a*1, 54*a*2 and 54*a*3 and the liquid containing chamber 52 is formed in an approximately rectangular parallelepiped outer shape and has an inner space in an approximately rectangular parallelepiped shape. The buffer chambers 54*a*1, 54*a*2 and 54*a*3 and the liquid containing chamber 52 are provided as different members. The total volume of the buffer chamber may be readily varied by changing the number of the buffer chambers or using different buffer chambers. This accordingly improves the flexibility in design of the liquid supply device 50*a*. Flow path members such as tubes that are detachably attached to the buffer chambers 54*a*1, 54*a*2 and 54*a*3 and the liquid containing chamber 52 may be employed for the first connection path 562*a*1, the second connection path 562*a*2 and the third connection path 562*a*3. According to another embodiment, the buffer chambers 54*a*1, 54*a*2 and 54*a*3 and the liquid containing chamber 52 may be configured to be not detachable from one another but to be integral.

The liquid supply device 50*a* of the second embodiment has three relations 1 to 3 described below.

<Relation 1>

The air-side connection portion 564 and the second connection portion 566*a*1 as a most upstream-side second connection portion are arranged diagonally to each other in the most upstream-side buffer chamber 54*a*1. According to this embodiment, the air-side connection portion 564 is located at one corner (specific corner) out of six corners of the most upstream-side buffer chamber 54*a*1, and the second connection portion 566*a*1 is located at a corner diagonal to the specific corner.

<Relation 2>

The second connection portion 566*a*2 and the third connection portion 567*a*1 are arranged diagonally to each other in the middle buffer chamber 54*a*2 that is a downstream-side buffer chamber located on the downstream side of the most upstream-side buffer chamber 54*a*1. According to this embodiment, the third connection portion 567*a*1 is located at one corner (specific corner) out of six corners of the middle buffer chamber 54*a*2, and the second connection portion 566*a*2 is located at a corner diagonal to the specific corner.

<Relation 3>

The second connection portion 566*a*3 and the third connection portion 567*a*2 are arranged diagonally to each other in the most downstream-side buffer chamber 54*a*3 that is a downstream-side buffer chamber located on the downstream side of the most upstream-side buffer chamber 54*a*1 and the middle buffer chamber 54*a*2. According to this embodiment, the third connection portion 567*a*2 is located at one corner (specific corner) out of six corners of the most downstream-side buffer chamber 54*a*3, and the second connection portion 566*a*3 is located at a corner diagonal to the specific corner.

The above relations 1 to 3 provide a long flow path length from the first connection portion 568 to the air outlet port 59 and thereby reduces the possibility that ink contained in the liquid containing chamber 52 reaches the upstream side of the most upstream-side buffer chamber 54*a*1.

The respective second connection portions 566*a*1, 566*a*2 and 566*a*3 of the respective connection paths 562*a*1, 562*a*2 and 562*a*3 are located on the same sides in the horizontal direction and in the vertical direction in the respective buffer chambers 54*a*1, 54*a*2 and 54*a*3. More specifically, when the second connection portion 566*a*1 is located on the front right side of the sheet surface in the horizontal direction and on the lower side of the sheet surface in the vertical direction in the most upstream-side buffer chamber 54*a*1, the other second connection portions 566*a*2 and 566*a*3 are similarly located on the front side and on the right side of the sheet surface in the horizontal direction and on the lower side of the sheet surface in the vertical direction in the respective buffer chambers 54*a*2 and 54*a*3.

Like the first embodiment, when the first connection portion 568 is located in the liquid, the second connection portions 566*a*1, 566*a*2 and 566*a*3 are located in vertically lower areas of the respective buffer chambers 54*a*1, 54*a*2 and 54*a*3. Like the first embodiment, even when ink flows into the buffer chambers 54*a*1, 54*a*2 and 54*a*3, this configuration makes it likely that the inflow ink is returned to the liquid containing chamber 52.

Like the first embodiment, it is preferable that each of the buffer chambers 54*a*1, 54*a*2 and 54*a*3 has a volume that is equal to or greater than an expected volume increase, which is calculated based on the volume of ink contained in the liquid containing chamber 52 and at least one of an amount of change of temperature and an amount of change of atmospheric pressure expected in the environment where the liquid supply device 50*a* is placed. This reduces the likelihood that ink flows into the upstream side of the respective buffer chambers 54*a*1, 54*a*2 and 54*a*3.

According to the above second embodiment, a plurality of the buffer chambers 54*a*1, 54*a*2 and 54*a*3 are provided, and the respective second connection portions 566*a*1, 566*a*2 and 566*a*3 of the respective connection paths 562*a*1, 562*a*2 and 562*a*3 are located on the same sides in the horizontal direction and in the vertical direction in the respective buffer chambers 54*a*1, 54*a*2 and 54*a*3. Even when ink flows from the liquid containing chamber 52 into the air communication path 56*a*, this configuration enables the inflow ink to be stored in the plurality of buffer chambers 54*a*1, 54*a*2 and 54*a*3 and thereby reduces the possibility that ink flows out through the air communication path 56*a*. The respective second connection portions 566*a*1, 566*a*2 and 566*a*3 are located on the same sides in the respective buffer chambers 54*a*1, 54*a*2 and 54*a*3. Even when ink flows into the buffer chambers 54*a*1, 54*a*2 and 54*a*3, this configuration makes it likely that the inflow ink flows into the downstream side (i.e., to the liquid containing chamber 52-side) of the buffer chambers 54*a*1, 54*a*2 and 54*a*3 via the second connection portions 566*a*1, 566*a*2 and 566*a*3.

C. Modifications of First and Second Embodiments

The disclosure is not limited to any of the embodiments and the examples described above but may be implemented by a diversity of other aspects without departing from the scope of the disclosure. Some of possible modifications are given below.

C-1. First Modification

In the above respective embodiments, the shape of the connection path 562 or the shape of each of the connection paths 562*a*1 to 562*a*3 is not limited to the configuration described above but may be any of various shapes, for example, a linear shape or a serpentine shape including curved parts in the middle of the flow path. When the serpentine shape is employed for the connection path 562 or for each of the connection paths 562*a*1 to 562*a*3, this provides a long flow path length from the first connection portion 568 to the air outlet port 59. Even when ink flows into the air communication path 56 or 56*a* in response to a vibration or a change in attitude of the liquid supply device 50 or 50*a*, this configuration further reduces the possibility that ink is leaked out from the air outlet port 59. Providing the long flow path length from the first connection portion 568 to the air outlet port 59 also reduces the possibility that the water content in the ink is evaporated in the liquid containing chamber 52 and thereby suppresses a concentration variation of ink.

C-2. Second Modification

According to the above embodiments, the buffer chamber 54 or each of the buffer chambers 54*a*1 to 54*a*3 is configured to have the volume that is equal to or greater than the expected volume increase. This configuration is, however, not restrictive. For example, the buffer chamber 54 or each of the buffer chambers 54*a*1 to 54*a*3 may be configured to have a volume that is smaller than the expected volume increase. In the second embodiment, the total volume of the plurality of buffer chambers 54*a*1 to 54*a*3 may be set equal to or greater than the expected volume increase.

D. Third Embodiment

D-1. Configuration of Liquid Ejection System

Figure 11:
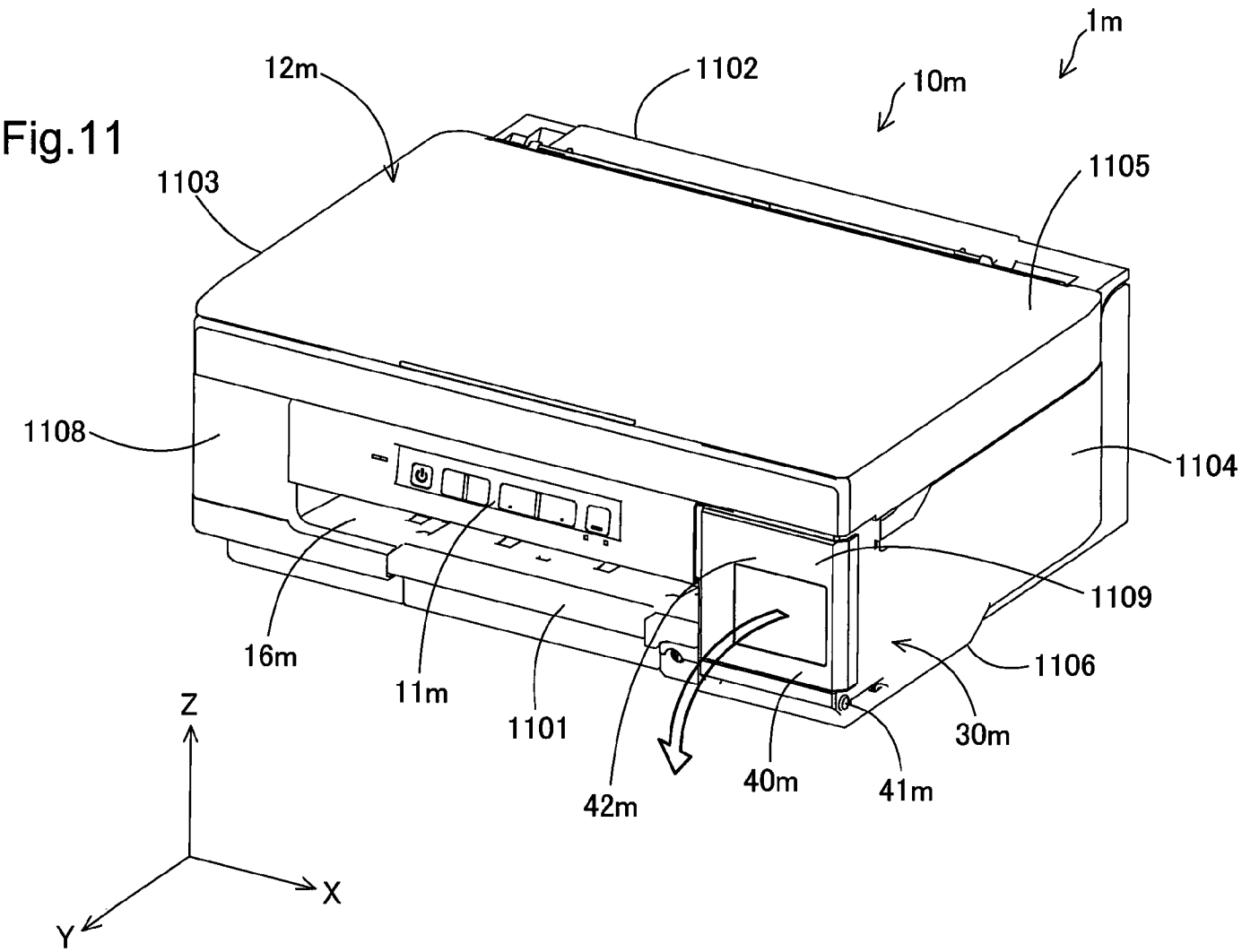
FIG. 11 is a schematic diagram illustrating a liquid ejection system according to a third embodiment.
Figure 12:
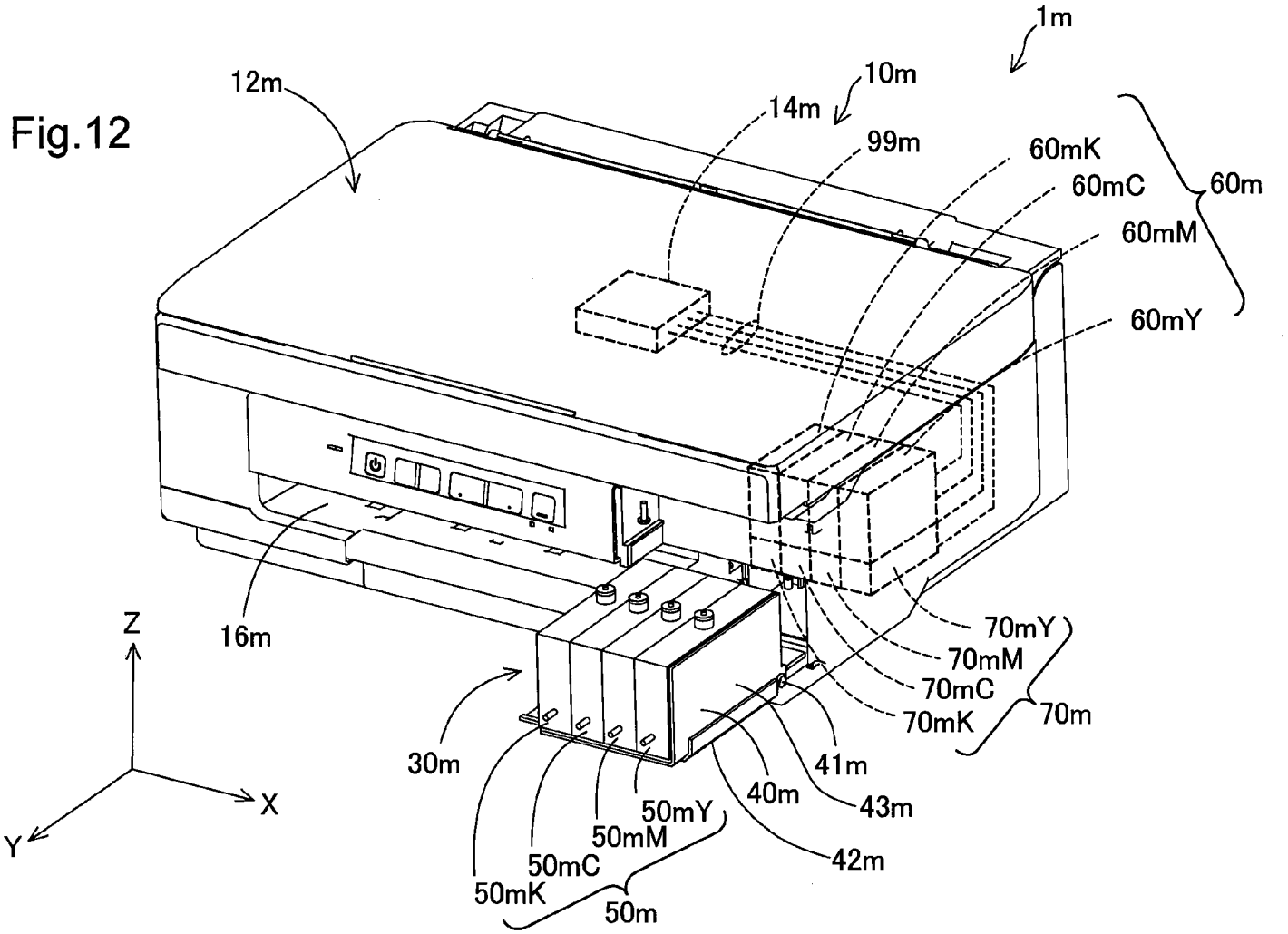
FIG. 12 is a schematic diagram illustrating the liquid ejection system of the third embodiment.

FIG. 11 and FIG. 12 are schematic diagrams illustrating a liquid ejection system 1*m* according to a third embodiment of the disclosure. FIG. 11 illustrates the appearance of the liquid ejection system 1*m*. FIG. 12 illustrates the appearance and part of the inner configuration (shown by the broken lines) of the liquid ejection system 1*m*. The liquid ejection system 1*m* includes a printer 10*m*, a liquid container unit 30*m* including liquid containing chambers 50*m*, and air containing chambers 60*m*. The printer 10*m* serves as a "liquid ejection apparatus". The liquid container unit 30*m* (liquid containing chamber 50*m*) and the air containing chamber 60*m* serve as "liquid supply device".

In the use state of the liquid ejection system 1*m*, the liquid container unit 30*m* (liquid containing chamber 50*m*) is placed inside of the printer 10*m* as shown in FIG. 11. In the liquid refilling state of the liquid ejection system 1*m*, the liquid container unit 30*m* (liquid containing chamber 50*m*) is exposed outside of the printer 10*m* as shown in FIG. 12. As shown in FIG. 12, the air containing chambers 60*m* are, on the other hand, placed inside of the printer 10*m*, irrespective of the state (use state/liquid refilling state) of the liquid ejection system 1*m*. In the description below, the attitude taken by the liquid supply device (more specifically, the liquid containing chamber 50*m*) in the use state is called "first attitude". The attitude taken by the liquid supply device (more specifically, the liquid containing chamber 50*m*) in the liquid refilling state is, on the other hand, called "second attitude".

Figure 13:
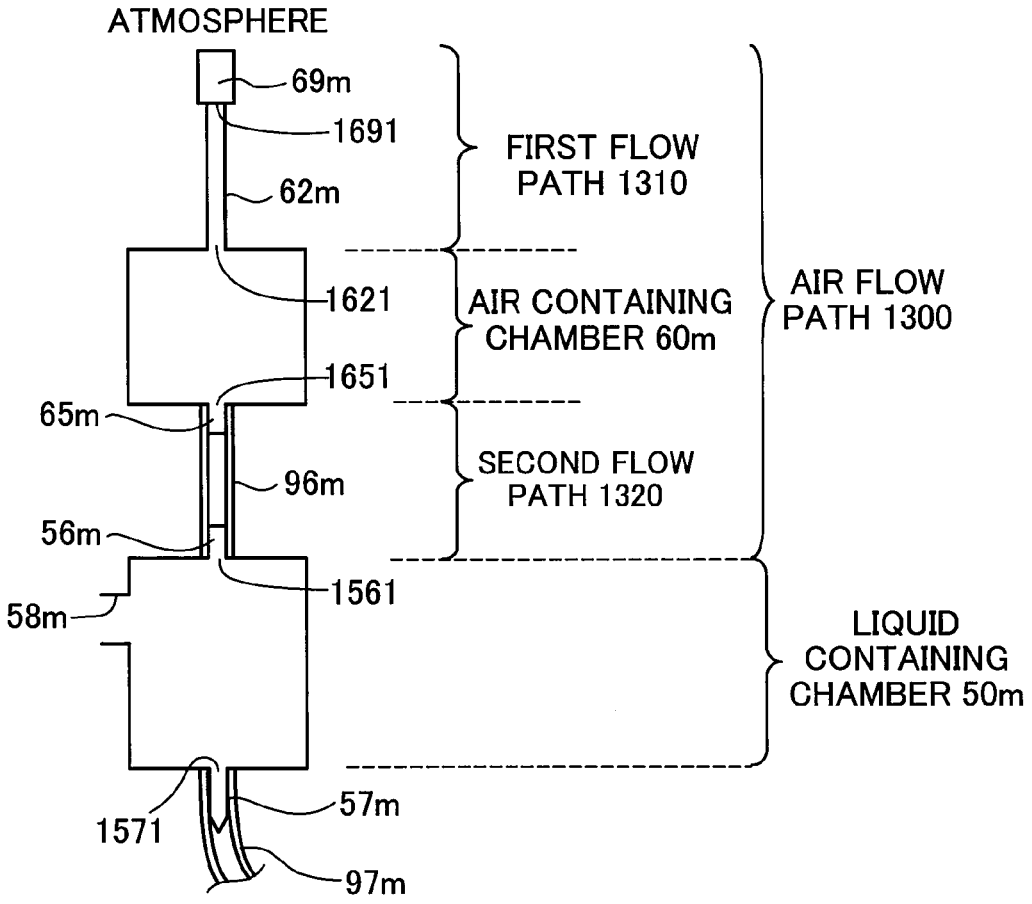
FIG. 13 is a conceptual diagram illustrating a pathway in a liquid supply device according to the third embodiment.

XYZ axes that are orthogonal to one another are illustrated in FIGS. 11 and 12. The X axis corresponds to the "width direction" of the printer 10*m*. The Y axis corresponds to the "depth direction" of the printer 10*m*. The Z axis corresponds to the "height direction" of the printer 10*m*. The printer 10*m* is accordingly placed on a horizontal plane defined by an X-axis direction and a Y-axis direction. In FIGS. 11 and 12, a +Z-axis direction (i.e., upward on the sheet surface) is also called vertically upward direction, and a −Z-axis direction (i.e., downward on the sheet surface) is also called vertically downward direction. XYZ axes in the directions corresponding to those in FIGS. 11 and 12 are also illustrated in FIG. 13 and subsequent drawings as needed.

The printer 10*m* is an inkjet printer. The printer 10*m* ejects ink in the liquid form (in the form of droplets) on a recording medium such as paper, so as to perform printing on the recording medium. The printer 10*m* includes an operation panel 11*m* (shown in FIG. 11), a housing 12*m*, a record head 14*m* (shown in FIG. 12) and a paper discharge portion 16*m*.

The housing 12*m* is formed in an approximately rectangular parallelepiped shape. The housing 12*m* includes a front face (first face, first wall) 1101, a rear face (second face, second wall) 1102, a left side face (first side face, first side wall) 1103, a right side face (second side face, second side wall) 1104, a top face (third face, third wall) 1105 and a bottom face (fourth face, fourth wall) 1106. The six faces 1101 to 1106 constitute the housing 12*m* as the outer shell of the printer 10*m*. The front face 1101 and the rear face 1102 are opposed to each other. Similarly the left side face 1103 and the right side face 1104 are opposed to each other. The front face 1101, the rear face 1102, the left side face 1103 and the right side face 1104 are faces arranged approximately perpendicular to the placement surface of the printer 10*m*. The left side face 1103 and the right side face 1104 are respectively arranged to intersect with both the front face 1101 and the rear face 1102. The top face 1105 and the bottom face 1106 are also opposed to each other. The top face 1105 and the rear face 1106 are approximately horizontal faces. According to this embodiment, the terms "approximately perpendicular" and "approximately horizontal" include the meanings of roughly "perpendicular" and roughly "horizontal", in addition to the meanings of completely "perpendicular" and completely "horizontal". Each of the faces 1101 to 1106 is thus not limited to a perfectly flat surface but is allowed to have some irregularities and to be roughly "perpendicular" or roughly "horizontal" in appearance.

The X-axis direction described above is the direction in which the left side face 1103 and the right side face 1104 are opposed to each other. The Y-axis direction is the direction in which the front face 1101 and the rear face 1102 are opposed to each other. The Z-axis direction is the direction in which the top face 1105 and the bottom face 1106 are opposed to each other.

The operation panel 11*m* and the paper discharge portion 16*m* are provided on the front face 1101 of the housing 12*m*. The operation panel 11*m* includes a plurality of buttons used to operate the respective parts of the printer 10*m* and a display unit (for example, LEDs) indicating the state of the printer 10*m*. The operation panel 11*m* may be operated, for example, to power ON and OFF the printer 10*m*. The paper discharge portion 16*m* is configured to eject the printed recording media.

The record head 14*m* is provided inside of the housing 12*m*. The record head 14*m* serves as a liquid ejection portion to eject ink in the liquid form (in the form of droplets) onto the recording medium. The record head 14*m* is held by a carriage 18*m* (shown in FIG. 14) and is moved in a main scanning direction (X-axis direction) and in a sub-scanning direction (Y-axis direction) inside of the housing 12*m*. The record head 14*m* ejects ink while being moved in the main scanning direction and in the sub-scanning direction. The record head 14*m* is configured to be moved in the main scanning direction and in the sub-scanning direction according to this embodiment but may have another configuration. For example, the record head 14*m* may be a line head that is extended over the main scanning direction (X-axis direction) and is configured to be moved only in the sub-scanning direction (Y-axis direction).

The liquid container unit 30*m* is attached to a right side portion (front right side 1109) of the front face 1101 of the housing 12*m*. As shown in FIG. 12, the liquid container unit 30*m* includes a case 40*m* and a plurality of liquid containing chambers 50*m*K to 50*m*Y placed inside of the case 40*m*. The case 40*m* includes two plate-like members (outer case 42*m* and inner case 43*m*) as shown in FIG. 12. The outer case 42*m* is formed in a rectangular shape (as shown in FIG. 11) and includes a hinge 41*m* provided at a vertically lower end to fix the case 40*m* to the printer 10*m*. The outer case 42*m* is arranged approximately horizontal to the front face 1101 in the use state shown in FIG. 11 (first attitude) and is arranged approximately horizontal to the bottom face 1106 in the liquid refilling state shown in FIG. 12 (second attitude). The inner case 43*m* is formed in the same shape as the shape of side faces of respective liquid containing chambers 50*m*K to 50*m*Y (shown in FIG. 12) and has one side that is joined with the outer case 42*m*.

The respective liquid containing chambers 50*m*K to 50*m*Y are placed vertically above the outer case 42*m* and are arrayed along the X-axis direction in the liquid refilling state shown in FIG. 12 (second attitude). The liquid containing chamber 50*m*K is configured to contain black ink. The liquid containing chamber 50*m*C is configured to contain cyan ink. The liquid containing chamber 50*m*M is configured to contain magenta ink. The liquid containing chamber 50*m*Y is configured to contain yellow ink. The respective liquid containing chambers 50*m*K to 50*m*Y are respectively connected with corresponding air containing chambers 60*m*K to 60*m*Y by means of first hoses 96*m* (not shown in FIGS. 11 and 12) described later.

The respective liquid containing chambers 50*m*K to 50*m*Y are also respectively connected with corresponding first connection bodies 70*m*K to 70*m*Y by means of second hoses 97*m* (not shown in FIGS. 11 and 12) described later. Additionally, the respective first connection bodies 70*m*K to 70*m*Y are respectively connected with the record head 14*m* by means of corresponding flow tubes 99*m*. The respective color inks contained in the respective liquid containing chambers 50*m*K to 50*m*Y are thus supplied through the flow tubes 99*m* to the record head 14*m* by a supply mechanism such as a pump provided in the printer 10*m*. In other words, the liquid containing chambers 50*m*K to 50*m*Y are configured to contain inks that are to be supplied to the record head 14*m* serving as a liquid ejection portion.

In the description below, when there is a need to distinguish the respective liquid containing chambers 50*m*K to 50*m*Y from one another, corresponding alphabetical letters are suffixed such as "liquid containing chamber 50*m*K". When there is no need to distinguish the respective liquid containing chambers 50*m*K to 50*m*Y from one another, on the other hand, the respective liquid containing chambers are simply called "liquid containing chamber 50*m*". Similarly, when there is a need to distinguish the respective air containing chambers 60*m*K to 60*m*Y from one another or to distinguish the respective first connection bodies 70*m*K to 70*m*Y from one another, corresponding alphabetical letters are suffixed. When there is no need to distinguish the respective air containing chambers 60*m*K to 60*m*Y from one another or to distinguish the respective first connection bodies 70*m*K to 70*m*Y from one another, on the other hand, the respective air containing chambers and the respective first connection bodies are simply called "air containing chamber 60*m*" and "first connection body 70*m*". The number of the liquid containing chambers 50*m* is four according to this embodiment but may be not necessarily limited to this embodiment. For example, the number of the liquid containing chambers 50*m* may be any number that is equal to or greater than 1. In this case, the number of the air containing chambers 60*m* and the number of the first connection bodies 70*m* are equal to the number of the liquid containing chambers 50*m*. According to another embodiment, the first connection bodies 70*m* may be omitted. In this case, the respective color inks contained in the respective liquid containing chambers 50*m*K to 50*m*Y may be supplied to the record head 14*m* by means of flow tubes 99*m* that are extended from the respective liquid containing chambers 50*m*.

According to this embodiment, the X-axis direction is also called "width direction" of the liquid container unit 30*m* and the liquid containing chamber 50*m*. Similarly the Y-axis direction is also called "depth direction" of the liquid container unit 30*m* and the liquid containing chamber 50*m*. The Z-axis direction is also called "height direction" of the liquid container unit 30*m* and the liquid containing chamber 50*m*.

D-2. Outline of Liquid Supply Device

For the purpose of better understanding, the mechanism of supplying ink from the liquid supply device to the liquid ejection apparatus (printer 10*m*) is described, prior to description of the detailed configuration of the liquid supply device (the liquid container unit 30*m* and the air containing chamber 60*m*).

FIG. 13 is a conceptual diagram illustrating a pathway in the liquid supply device. More specifically, FIG. 13 conceptually illustrates the pathway from an air outlet port 1691 of the air containing chamber 60*m* to a liquid outlet port 1571 of the liquid container unit 30*m* (liquid containing chamber 50*m*). The pathway (flow path) from the air outlet port 1691 to the liquid outlet port 1571 is roughly divided into an air flow path 1300 and the liquid containing chamber 50*m*.

The air flow path 1300 includes a first flow path 1310, the air containing chamber 60*m* and a second flow path 1320 that are arranged sequentially from the upstream side (air side). One end of the first flow path 1310 forms the air outlet port 1691 of the air containing chamber 60*m*. The air outlet port 1691 is an opening provided in a second opening member 69*m* of the air containing chamber 60*m*. The air outlet port 1691 causes one end of the first flow path 1310 to be open to the outside and communicate with the atmosphere. The first flow path 1310 is formed by partitioning a main body 61*m* of the air containing chamber 60*m* (shown in FIG. 15) by a partition wall 62*m* (shown in FIG. 15). The other end of the first flow path 1310 forms an opening 1621 of the partition wall 62*m*. The first flow path 1310 causes the air containing chamber 60*m* to communicate with the atmosphere and serves to introduce the air into the air containing chamber 60*m*.

In the air containing chamber 60*m*, ink flowing back from the liquid containing chamber 50*m* is stored inside of the main body 61*m* except the part partitioned by the partition wall 62*m*. This configuration suppresses ink from flowing out to the upstream side of the air containing chamber 60*m*. The flow passage area of the air containing chamber 60*m* is larger than the flow passage area of the first flow path 1310. According to this embodiment, the air containing chamber 60*m* is provided as part of the air flow path 1300 as described above.

One end of the second flow path 1320 forms a liquid chamber-side opening 1651 of the air containing chamber 60*m*. The liquid chamber-side opening 1651 is an opening provided in a first opening member 65*m* of the air containing chamber 60*m*. The second flow path 1320 is formed by the first hose 96*m* configured to connect the first opening member 65*m* of the air containing chamber 60*m* with an opening member 56*m* of the liquid containing chamber 50*m*. The other end of the second flow path 1320 forms an air inlet port 1561 of the liquid containing chamber 50*m*. The air inlet port 1561 is an opening provided in the opening member 56*m* of the liquid containing chamber 50*m*. The second flow path 1320 is arranged to connect the liquid containing chamber 50*m* with the air containing chamber 60*m* and enables the air to be introduced into the liquid containing chamber 50*m*. More specifically, in the use state shown in FIG. 11 (first attitude), a liquid surface (meniscus) that directly communicates with the atmosphere is formed near to the air inlet port 1561 of the liquid containing body 50*m*, and the air is introduced in the form of air bubbles from the air inlet port 1561 into the liquid containing chamber 50*m*. It is preferable that the flow passage area of the second flow path 1320 (i.e., the inner diameter of the first hose 96*m*) is small enough to allow for formation of a meniscus (liquid surface bridging) near to the air inlet port 1561.

The pathway described above is only illustrative and may be modified and changed in any of various ways. For example, a connection member configured to connect a flow path with another flow path and a gas-permeable liquid-proof member (for example, gas-liquid separation membrane) configured to suppress a liquid from flowing upstream may be provided in the middle of the air flow path 1300. The flow passage areas of the first flow path 1310 and the second flow path 1320 may be designed appropriately. Another pathway (not described) may additionally be provided in the pathway from the air outlet port 1691 to the liquid outlet port 1571.

Figure 14:
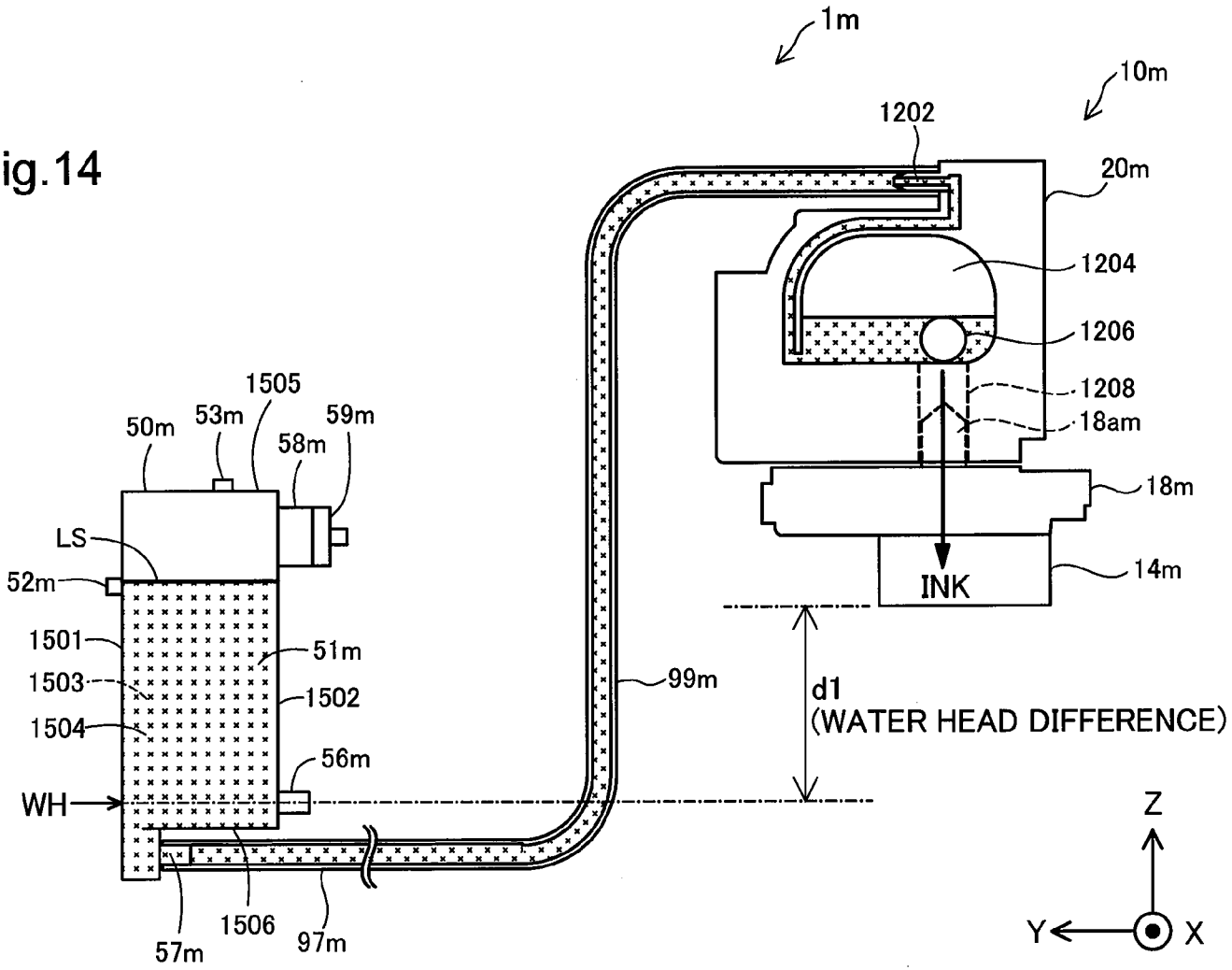
FIG. 14 is a diagram illustrating the principle of supplying ink from the liquid supply device to a sub-tank.
Figure 15:
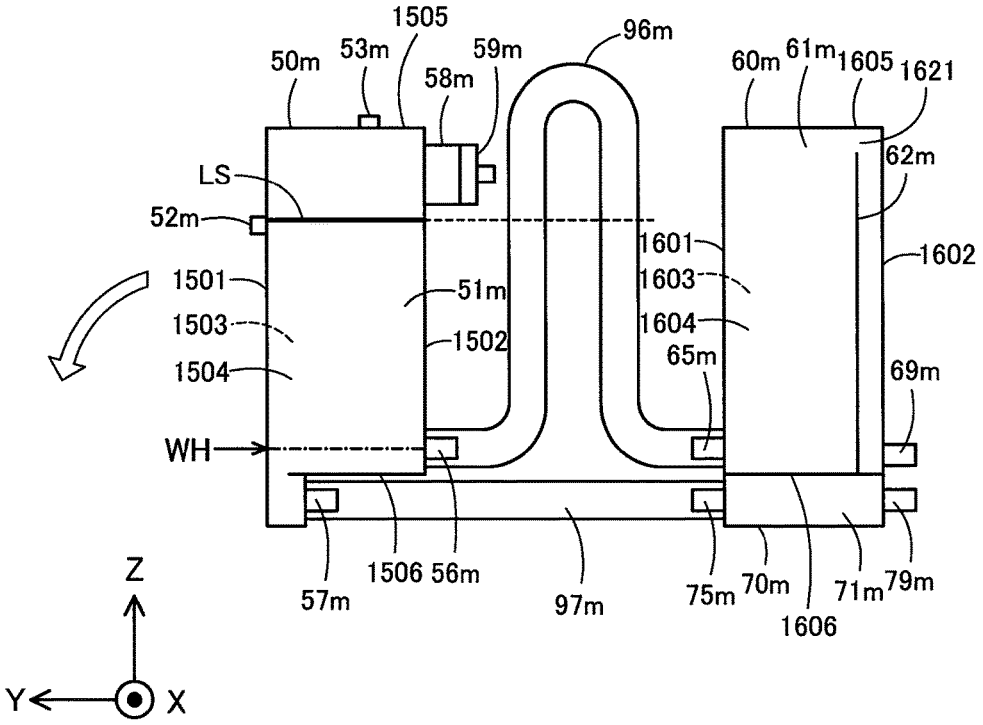
FIG. 15 is a diagram illustrating the liquid supply device in a use state (first attitude)

The liquid containing chamber 50*m* is configured to contain ink inside of a main body 51*m* (shown in FIG. 15). The ink contained in the liquid containing chamber 50*m* is supplied from a liquid outlet provided in a liquid discharge member 57*m* (liquid outlet port 1571) through the second hose 97*m*, the first connection body 70*m* and the flow tube 99*m* to a sub-tank 20*m* (shown in FIG. 14) mounted on the record head 14*m*.

FIG. 14 is a diagram illustrating the principle of supplying ink from the liquid supply device to the sub-tank 20*m*. FIG. 14 schematically illustrates the liquid containing chamber 50*m* viewed from a +X-axis direction side and the sub-tank 20*m* mounted on the record head 14*m*. The liquid supply device of this embodiment uses the Mariotte bottle principle to supply ink to the liquid ejection apparatus (more specifically to the record head 14*m* of the printer 10*m*).

The liquid ejection system 1*m* including the liquid supply device and the liquid ejection apparatus is placed on a horizontal plane. The liquid outlet port 1571 of the liquid containing chamber 50*m* and a liquid receiving portion 1202 of the sub-tank 20*m* are connected with each other by means of the second hose 97*m*, the first connection body 70*m* and the flow tube 99*m*. For convenience of description, the first connection body 70*m* is omitted from the illustration of FIG. 14.

The sub-tank 20*m* may be molded from a synthetic resin such as polystyrene or polyethylene. The sub-tank 20*m* includes an ink reserving chamber 1204, a filter 1206 and an ink flow path 1208. The ink reserving chamber 1204 is configured to store ink supplied from the liquid containing chamber 50*m*. The filter 1206 serves to trap any impurity such as a foreign substance mixed in ink and thereby suppress the impurity from flowing into the record head 14*m*. An ink supply needle 18*am* of the carriage 18*m* is inserted in the ink flow path 1208. The ink in the ink reserving chamber 1204 is supplied through the ink flow path 1208 and the ink supply needle 18*am* to the record head 14*m* by suction from the record head 14*m*. The ink supplied to the record head 14*m* is ejected toward outside (toward the recording medium) via nozzles.

The user fills ink into the liquid containing chamber 50*m* in the liquid refilling state shown in FIG. 12 (second attitude) and subsequently closes the liquid containing chamber 50*m* with a plug member 59*m*. The user then changes the attitude of the liquid container unit 30*m* to the use state shown in FIG. 11 and FIG. 14 (i.e., to the first attitude). The air in the liquid containing chamber 50*m* is expanded with a change of the attitude to provide a negative pressure in the liquid containing chamber 50*m*. Additionally, the negative pressure in the liquid containing chamber 50*m* is maintained by suction of ink contained in the liquid containing chamber 50*m* from the record head 14*m*.

The liquid outlet port 1571 of the liquid containing chamber 50*m* is provided in the liquid discharge member 57*m* that is attached to a vertically downward protruded portion of the main body 51*m* that forms the liquid containing chamber 50*m* in the first attitude (shown in FIG. 14). The air inlet port 1561 of the liquid containing chamber 50*m* is provided in the opening member 56*m* that is attached to a vertically lower end of the main body 51*m* that forms the liquid containing chamber 50*m*. Even when a liquid level LS in the liquid containing chamber 50*m* is lowered with consumption of ink contained in the liquid containing chamber 50*m*, this configuration maintains an ink surface (air exposed surface, meniscus) WH that is directly exposed to the air taken in the liquid containing chamber 50*m* at a constant height for a long time period. In the use state (first attitude), the air inlet port 1561 provided to take the air into the liquid containing chamber 50*m* is located below the record head 14*m* in the vertical direction. A water head difference d1 is accordingly caused by the air exposed surface (meniscus) WH in the liquid containing chamber 50*m* and the nozzles provided in a vertically lower face of the record head 14*m*.

A change in pressure accompanied with consumption of ink by the record head 14*m* (more specifically, ejection of ink from the nozzles) provides a predetermined or greater negative pressure in the liquid containing chamber 50*m*. Providing the predetermined or greater negative pressure causes ink contained in the liquid containing chamber 50*m* to be supplied through the second hose 97*m*, the first connection body 70*m* and the flow tube 99*m* to the ink reserving chamber 1204 (on the record head 14*m*-side). Accordingly an amount of ink equal to the consumed amount by the record head 14*m* is automatically filled from the liquid containing chamber 50*m* to the ink reserving chamber 1204. In other words, this automatic ink refilling is achieved when the pressure change (negative pressure) accompanied with consumption of ink by the record head 14*m* becomes larger than the height difference in the vertical direction (water head difference d1) between the air exposed face (meniscus) WH and the nozzles of the record head 14*m*.

When ink in the liquid containing chamber 50*m* is consumed, the air in the air containing chamber 60*m* is introduced in the form of air bubbles from the air inlet port 1561 into the liquid containing chamber 50*m*. This lowers the liquid level LS in the liquid containing chamber 50*m*. The air exposed surface (meniscus) WH in the liquid containing chamber 50*m* is, on the other hand, maintained at a constant height as described above, so that the water head difference d1 is maintained constant. Ink is thus stably supplied from the liquid containing chamber 50*m* to the record head 14*m*.

D-3. Configuration of Liquid Supply Device

The following describes the configuration and the positional relationship of the liquid supply device (the liquid container unit 30*m* and the air containing chamber 60*m*).

FIG. 15 is a diagram illustrating the liquid supply device in the use state (first attitude). As described above, the liquid supply device of this embodiment includes the liquid containing chamber 50*m*, the air containing chamber 60*m*, the first connection body 70*m*, the first hose 96*m* and the second hose 97*m*. FIG. 15 schematically illustrate the respective components viewed from the +X-axis direction side.

The liquid containing chamber 50*m* includes the main body 51*m*, a first state indication element 52*m*, a second state indication element 53*m*, the opening member 56*m*, the liquid discharge member 57*m*, a liquid injection portion 58*m* and the plug member 59*m*.

The main body 51*m* is a hollow approximately columnar member. The main body 51*m* includes a front face (first face, first wall) 1501, a rear face (second face, second wall) 1502, a left side face (first side face, first side wall) 1503, a right side face (second side face, second side wall) 1504, a top face (third face, third wall) 1505 and a bottom face (fourth face, fourth wall) 1506. The front face 1501 and the rear face 1502 are opposed to each other. Similarly the left side face 1503 and the right side face 1504 are opposed to each other. The front face 1501, the rear face 1502, the left side face 1503 and the right side face 1504 are faces arranged approximately perpendicular to the placement surface of the printer 10*m*. The left side face 1503 and the right side face 1504 are respectively arranged to intersect with both the front face 1501 and the rear face 1502. The top face 1505 and the bottom face 1506 are also opposed to each other. The top face 1505 and the rear face 1506 are approximately horizontal faces. Accordingly the respective faces 1501 to 1506 of the main body 51*m* correspond to the respective faces 1101 to 1106 of the housing 12*m* of the printer 10*m* described above with reference to FIG. 11.

The main body 51*m* has a protruded portion formed by protruding part of the bottom face 1506. The main body 51*m* also includes openings formed at positions respectively corresponding to the position where the opening member 56*m* is placed, the position where the liquid discharge member 57*m* is placed and the position where the liquid injection portion 58*m* is placed to have sizes corresponding to openings of the respective members and portion 56*m*, 57*m* and 58*m*. The main body 51*m* may be molded, for example, from a synthetic resin such as polypropylene. The main body 51*m* is translucent. As described above, the inner space of the main body 51*m* serves as the liquid containing chamber to contain ink therein. This configuration enables the user to check the ink level in the liquid containing chamber 50*m* (more specifically, the main body 51*m*) from outside in the process of filling the liquid into the liquid containing chamber 50*m*.

The first state indication element 52*m* denotes an indication indicating a full level position (upper limit position) of ink in the use state of the liquid ejection system 1*m* (first attitude). The first state indication element 52*m* is provided at a predetermined position on the front face 1501 of the main body 51*m* or in other words, at a predetermined position on an opposite face of the main body 51*m* that is opposite to the face where the opening member 56*m* is placed. The predetermined position may be determined appropriately according to the amount of ink containable in the liquid containing chamber 50*m*. The first state indication element 52*m* may be, for example, a linear indication extended in the X-axis direction or may be an indication using a figure such as an arrow or a symbol. The first state indication element 52*m* may be a concave or a convex integrally molded with the main body 51*m* or may be printed on the main body 51*m*.

The second state indication element 53*m* denotes an indication indicating a full level position (upper limit position) of ink in the liquid refilling state of the liquid ejection system 1*m* (second attitude). The second state indication element 53*m* is provided at a predetermined position on the top face 1505 of the main body 51*m* or in other words, at a predetermined position on a perpendicular face of the main body 51*m* that is perpendicular to the face where the first state indication element 52*m* is placed. The predetermined position may be determined appropriately according to the amount of ink containable in the liquid containing chamber 50*m*. Like the first state indication element 52*m*, the second state indication element 53*m* may also be, for example, a linear indication extended in the X-axis direction or may be an indication using a figure such as an arrow or a symbol. The second state indication element 53*m* may be a concave or a convex integrally molded with the main body 51*m* or may be printed on the main body 51*m*.

The main body 51*m* may additionally include indications indicating lower limit positions of ink in the use state/in the liquid refilling state of the liquid ejection system 1*m*, with a view to encouraging the user to fill the liquid.

The opening member 56*m* is a cylindrical member having openings at both ends. The opening member 56*m* is arranged at a predetermined position on the rear face 1502 of the main body 51*m* to be extended outward from the main body 51*m*. The predetermined position may be in a lower part in the vertical direction (Z-axis direction) of the main body 51*m* in the use state (first attitude). The "lower part in the vertical direction" herein may be lower than the center position in the vertical direction of the main body 51*m*. The predetermined position is preferably below the lower limit position of ink in the use state. According to this embodiment, the opening member 56*m* is arranged at a vertically lower end on the rear face 1502 of the main body 51*m*. Like the main body 51*m*, the opening member 56*m* is molded from a synthetic resin. The opening member 56*m* may be integrally molded with the main body 51*m*. The opening at one end of the opening member 56*m* is arranged to communicate with the opening of the main body 51*m*. The opening at the other end of the opening member 56*m* is arranged to communicate with the air containing chamber 60*m* via the first hose 96*m*. According to this embodiment, the opening at one end of the opening member 56*m* forms the air inlet port 1561.

Like the opening member 56*m*, the liquid discharge member 57*m* is a cylindrical member having openings at both ends. The liquid discharge member 57*m* is arranged on the protruded portion of the main body 51*m* to be extended outward from the main body 51*m*. Accordingly the liquid discharge member 57*m* is arranged below the opening member 56*m* in the vertical direction (Z-axis direction). Like the main body 51*m*, the liquid discharge member 57*m* is molded from a synthetic resin. The liquid discharge member 57*m* may be integrally molded with the main body 51*m*. The opening at one end of the liquid discharge member 57*m* is arranged to communicate with the opening of the main body 51*m*. The opening at the other end of the liquid discharge member 57*m* is arranged to communicate with the first connection body 70*m* (and further with the record head 14*m*) via the second hose 97*m*.

The liquid injection portion 58*m* is a cylindrical member having openings at both ends. The sectional area of the opening of the liquid injection portion 58*m* is greater than the sectional areas of the openings of the opening member 56*m* and the liquid discharge member 57*m*. The liquid injection portion 58*m* is arranged at a predetermined position on the rear face 1502 of the main body 51*m* or in other words, at a predetermined position on the face of the main body 51*m* where the opening member 56*m* is placed, to be extended outward from the main body 51*m*. The predetermined position may be above the center in the vertical direction (Z-axis direction) of the main body 51*m*. Furthermore the predetermined position is preferably above the upper limit position of ink in the use state (first attitude). According to this embodiment, the liquid injection portion 58*m* is arranged at a vertically upper end on the rear face 1502 of the main body 51*m*. Like the main body 51*m*, the liquid injection portion 58*m* is molded from a synthetic resin. The liquid injection portion 58*m* may be integrally molded with the main body 51*m*. The opening at one end of the liquid injection portion 58*m* is arranged to communicate with the opening of the main body 51*m*. The opening at the other end of the liquid injection portion 58*m* is arranged to communicate with the atmosphere.

The plug member 59*m* is a member including a solid cylindrical main body having a sectional area that is equal to or larger than the sectional area of the opening of the liquid injection portion 58*m*, and a grip portion that is protruded from the approximate center of the main body. The plug member 59*m* is molded from a resin material having flexibility (for example, rubber). The plug member 59*m* is placed to close the liquid injection portion 58*m* of the main body 51*m*, so as to suppress ink from flowing out from the liquid containing chamber 50*m*.

The air containing chamber 60*m* includes the main body 61*m*, the partition wall 62*m*, the first opening member 65*m* and the second opening member 69*m*.

The main body 61*m* is a hollow approximately columnar member. The main body 61*m* includes a front face (first face, first wall) 1601, a rear face (second face, second wall) 1602, a left side face (first side face, first side wall) 1603, a right side face (second side face, second side wall) 1604, a top face (third face, third wall) 1605 and a bottom face (fourth face, fourth wall) 1606. The front face 1601 and the rear face 1602 are opposed to each other. Similarly the left side face 1603 and the right side face 1604 are opposed to each other. The front face 1601, the rear face 1602, the left side face 1603 and the right side face 1604 are faces arranged approximately perpendicular to the placement surface of the printer 10*m*. The left side face 1603 and the right side face 1604 are respectively arranged to intersect with both the front face 1601 and the rear face 1602. The top face 1605 and the bottom face 1606 are also opposed to each other. The top face 1605 and the rear face 1606 are approximately horizontal faces. Accordingly the respective faces 1601 to 1606 of the main body 61*m* correspond to the respective faces 1101 to 1106 of the housing 12*m* of the printer 10*m* described above with reference to FIG. 11 and also correspond to the respective faces 1501 to 1506 of the main body 51*m* of the liquid containing chamber 50*m* described above.

The main body 61*m* also includes openings formed at positions respectively corresponding to the position where the first opening member 65*m* is placed and the position where the second opening member 69*m* is placed to have sizes corresponding to openings of the respective members 65*m* and 69*m*. The main body 61*m* may be molded, for example, from a synthetic resin such as polypropylene.

The partition wall 62*m* is a plate-like member configured to partition inside of the main body 61*m*. The partition wall 62*m* is arranged in the inner space of the main body 61*m* to be extended from the bottom face 1606 parallel to the rear face 1602. The partition wall 62*m* is open at a vertically upper end (opening 1621). This opening 1621 causes the inner space of the main body 61*m* to communicate with the space partitioned by the partition wall 62*m*. Like the main body 61*m*, the partition wall 62*m* is molded from a synthetic resin. The partition wall 62*m* may be integrally molded with the main boy 61*m*. The partition wall 62*m* may have any suitable configuration as long as the partition wall 62*m* is arranged to partition inside of the main body 61*m*. For example, the partition wall 62*m* may be formed in an approximately L shape to include a face extended parallel to the rear face 1602 and a face extended parallel to the right side face 1604 (or the left side face 1603).

The first opening member 65*m* is a cylindrical member having openings at both ends. The first opening member 65*m* is arranged at a predetermined position on the front face 1601 of the main body 61*m* to be extended outward from the main body 61*m*. The predetermined position may be determined arbitrarily. According to this embodiment, the first opening member 65*m* is arranged at a vertically lower end on the front face 1601 of the main body 61*m*. Like the main body 61*m*, the first opening member 65*m* is molded from a synthetic resin. The first opening member 65*m* may be integrally molded with the main body 61*m*. The opening at one end of the first opening member 65*m* is arranged to communicate with the opening of the main body 61*m*. The opening at the other end of the first opening member 65*m* is arranged to communicate with the liquid containing chamber 50*m* via the first hose 96*m*.

The second opening member 69*m* is a cylindrical member having openings at both ends. The second opening member 69*m* is arranged at a predetermined position on the rear face 1602 of the main body 61*m* to be extended outward from the main body 61*m*. The predetermined position may be determined arbitrarily as long as the position is within the space partitioned by the partition wall 62*m*. According to this embodiment, the second opening member 69*m* is arranged at a vertically lower end on the rear face 1602 of the main body

61*m*. Like the main body 61*m*, the second opening member 69*m* is molded from a synthetic resin. The second opening member 69*m* may be integrally molded with the main body 61*m*. The opening at one end of the second opening member 69*m* is arranged to communicate with the opening of the main body 61*m*. The opening at the other end of the second opening member 69*m* is arranged to communicate with the atmosphere. According to this embodiment, the opening at the other end of the second opening member 69*m* of the air containing chamber 60*m* forms the air outlet port 1691.

The first connection body 70*m* includes a main body 71*m*, a first opening member 75*m* and a second opening member 79*m*.

The main body 71*m* is a hollow approximately columnar member. The main body 71*m* includes openings formed at positions respectively corresponding to the position where the first opening member 75*m* is placed and the position where the second opening member 79*m* is placed to have sizes corresponding to openings of the respective members 75*m* and 79*m*. The main body 71*m* may be molded, for example, from a synthetic resin such as polypropylene.

The first opening member 75*m* is a cylindrical member having openings at both ends. The first opening member 75*m* is arranged on one face of the main body 71*m* to be extended outward from the main body 71*m*. The position where the first opening member 75*m* is placed may be determined arbitrarily. Like the main body 71*m*, the first opening member 75*m* is molded from a synthetic resin. The first opening member 75*m* may be integrally molded with the main body 71*m*. The opening at one end of the first opening member 75*m* is arranged to communicate with the opening of the main body 71*m*. The opening at the other end of the first opening member 75*m* is arranged to communicate with the liquid containing chamber 50*m* via the second hose 97*m*.

The second opening member 79*m* is a cylindrical member having openings at both ends. The second opening member 79*m* is arranged on the other face of the main body 71*m* (i.e., on an opposite face opposite to one face) to be extended outward from the main body 71*m*. The position where the second opening member 79*m* is placed may be determined arbitrarily. Like the main body 71*m*, the second opening member 79*m* is molded from a synthetic resin. The second opening member 79*m* may be integrally molded with the main body 71*m*. The opening at one end of the second opening member 79*m* is arranged to communicate with the opening of the main body 71*m*. The opening at the other end of the second opening member 79*m* is arranged to communicate with the record head 14*m* via the flow tube 99*m* (as shown in FIGS. 12 and 14).

The first hose 96*m* is provided to connect the liquid containing chamber 50*m* with the air containing chamber 60*m* and form an air flow path inside thereof. The first hose 96*m* is a hose in a cylindrical shape having openings at both ends. The first hose 96*m* is molded from a resin material having flexibility (for example, rubber). According to this embodiment, the length of the first hose 96*m* is longer than the sum of the height (i.e., the length in the Z-axis direction) of the main body 51*m* of the liquid containing chamber 50*m*, the height of the main body 61*m* of the air containing chamber 60*m* and the length between the position where the liquid containing chamber 50*m* is placed and the position where the air containing chamber 60*m* is placed inside of the printer 10*m*. According to this embodiment, in the use state (first attitude), the first hose 96*m* is accordingly curved in the vertical direction (Z-axis direction) between the liquid containing chamber 50*m* and the air containing chamber 60*m*, such that part of the curve is located vertically above the first state indication element 52*m* indicating the full level position of ink. According to this embodiment, a portion of the first hose 96*m* that is located vertically above the first state indication element 52*m* of the liquid containing chamber 50*m* corresponds to the "upper portion".

The second hose 97*m* is provided to connect the liquid containing chamber 50*m* with the first connection body 70*m* and form a liquid supply flow path inside thereof. The second hose 97*m* is a hose in a cylindrical shape having openings at both ends. The second hose 97*m* is molded from a resin material having flexibility (for example, rubber). According to this embodiment, the length of the second hose 97*m* is longer than the sum of the depth (i.e., the length in the Y-axis direction) of the main body 51*m* of the liquid containing chamber 50*m*, the depth of the main body 61*m* of the air containing chamber 60*m* and the length between the position where the liquid containing chamber 50*m* is placed and the position where the air containing chamber 60*m* is placed inside of the printer 10*m*. According to this embodiment, in the use state (first attitude), the second hose 97*m* is curved in the width direction (X-axis direction) between the liquid containing chamber 50*m* and the air containing chamber 60*m*.

D-4. Operations of Liquid Supply Device

As described above, in the use state of the liquid ejection system 1*m* (first attitude), the liquid container unit 30*m* is placed in the printer 10*m*. In this state, the respective liquid containing chambers 50*m* of the liquid container unit 30*m* are arranged in the attitude illustrated in FIG. 15.

Figure 16:
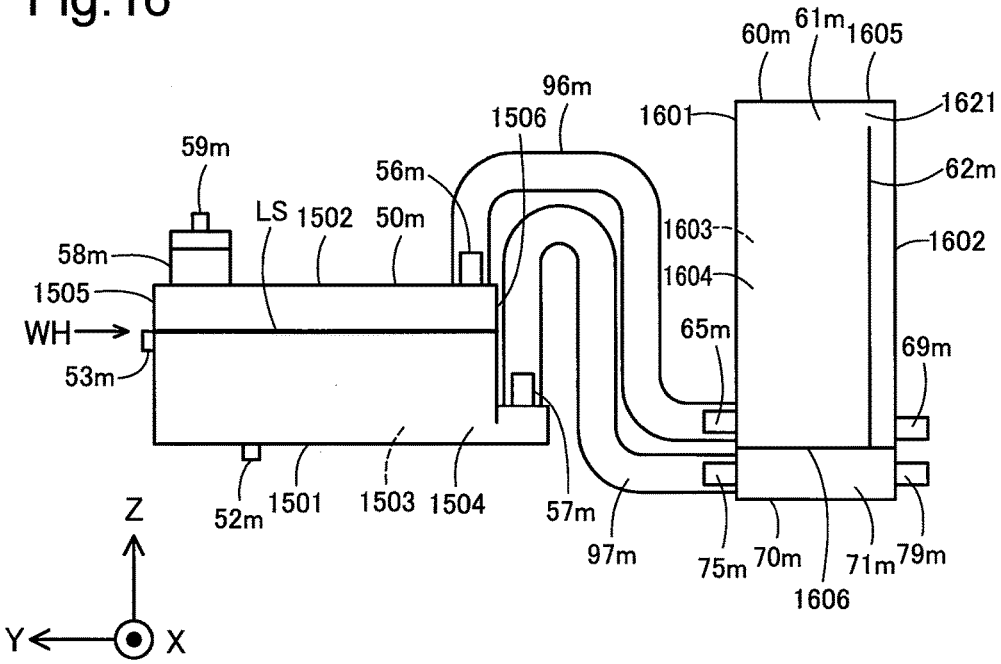
FIG. 16 is a diagram illustrating the liquid supply device in a liquid refilling state (second attitude)

FIG. 16 is a diagram illustrating the liquid supply device in the liquid refilling state (second attitude). FIG. 16 schematically illustrates the respective components viewed from the +X-axis direction side, like FIG. 15. The following describes an operation of filling ink in the liquid ejection system 1*m*. For the purpose of ink refilling, the user presses down a vertically upper end of the case 40*m* of the liquid container unit 30*m* (i.e., an opposite end that is opposite to the end where the hinge 41*m* is provided). A holding mechanism (not shown) of the case 40*m* is then released, so that the case 40*m* is turned about the hinge 41*m* as the rotating axis to be open in a direction shown by an open arrow in FIG. 11 (as shown in FIG. 12). In the liquid container unit 30*m* in the state that the case 40*m* is open (i.e., in the second attitude in the liquid refilling state), the respective liquid containing chamber 50*m* are arranged in the attitude illustrated in FIG. 16. As illustrated, in response to a change in attitude from the first attitude in the use state (shown in FIG. 15) to the second attitude in the liquid refilling state (shown in FIG. 16) and a change in attitude from the second attitude in the liquid refilling state (shown in FIG. 16) to the first attitude in the use state (shown in FIG. 15), the attitude of only the liquid containing chamber 50*m* is changed, while the attitude of the air containing chamber 60*m* is kept unchanged.

As described above, in the liquid supply device of the above embodiment (i.e., the air containing chamber 60*m* and the liquid container unit 30*m* including the liquid containing chamber 50*m*), the liquid containing chamber 50*m* is provided as a different body from the air containing chamber 60*m* (i.e., independently of the air containing chamber 60*m*). In the liquid supply device configured to change the attitude of the liquid containing chamber 50*m* in the process of filling the liquid into the liquid containing chamber 50*m*, this configuration reduces the space required for a change in attitude (i.e., a change from the first attitude to the second attitude and a change from the second attitude to the first attitude), compared with a configuration that the liquid containing chamber 50*m* is integrated with the air containing chamber 60*m*.

In the liquid supply device of the above embodiment, the liquid containing chamber 50*m* and the air containing chamber 60*m* are provided as different bodies. This configuration improves the flexibility in design (for example, capacities, locations and numbers) of the respective chambers (the liquid containing chamber 50*m* and the air containing chamber 60*m*). Additionally, in the first attitude taken in the use state, the air inlet port 1561 is located in the lower part in the vertical direction of the liquid containing chamber 50*m*. In the use state, this configuration suppresses the liquid from flowing out (flowing back) from the air inlet port 1561 to the outside of the liquid containing chamber 50*m*.

In the liquid supply device of the above embodiment, the upper portion of the air flow path 1300 (part of the first hose 96*m*) is arranged to pass through vertically above the first state indication element 52*m* indicating the upper limit position of the liquid in the liquid containing chamber 50*m* in the use state shown in FIG. 15 (first attitude). The upper portion of the air flow path 1300 (part of the first hose 96*m*) is also arranged to pass through vertically above the second state indication element 53*m* indicating the upper limit position of the liquid in the liquid containing chamber 50*m* in the liquid refilling state shown in FIG. 16 (second attitude). The upper portion of the air flow path 1300 (part of the first hose 96*m*) is accordingly arranged to pass through vertically above the upper limit position of the liquid in the liquid containing chamber 50*m* in the pathway from the liquid containing chamber 50*m* to the air containing chamber 60*m*, irrespective of the use state or the liquid refilling state. The configuration of the liquid supply device of this embodiment accordingly suppresses the liquid flowing out (flowing back) to the outside of the liquid containing chamber 50*m* from entering the air containing chamber 60*m*.

In the liquid supply device of the above embodiment, the air flow path 1300 from the liquid containing chamber 50*m* to the air containing chamber 60*m* (i.e., the second flow path 1320 shown in FIG. 13) is formed from a material having flexibility (first hose 96*m*). In the liquid supply device configured to change the attitude of the liquid containing chamber 50*m* in the process of filling the liquid in the liquid containing chamber 50*m*, the configuration of the liquid supply device of this embodiment enables the attitude of only the liquid containing chamber 50*m* to be readily changed as shown in FIGS. 15 and 16.

D-5. Other Configurations

The configuration of the liquid supply device described in the above embodiment is only illustrative, and the liquid supply device may have any of other various configurations. For example, other configurations described below may be employed for the liquid supply device. Any of the other configurations described below may be employed in place of the above configuration of the liquid supply device or may be employed at least partly in combination with the above configuration of the liquid supply device. The components having the like configurations and the like operations to those of the components described in the above embodiment are expressed by the like reference signs to those used in the above embodiment, and their detailed description is omitted. In other words, the configurations and the operations other than those described below are similar to those described in the above embodiment.

(1) Another Configuration 1

Figure 17:
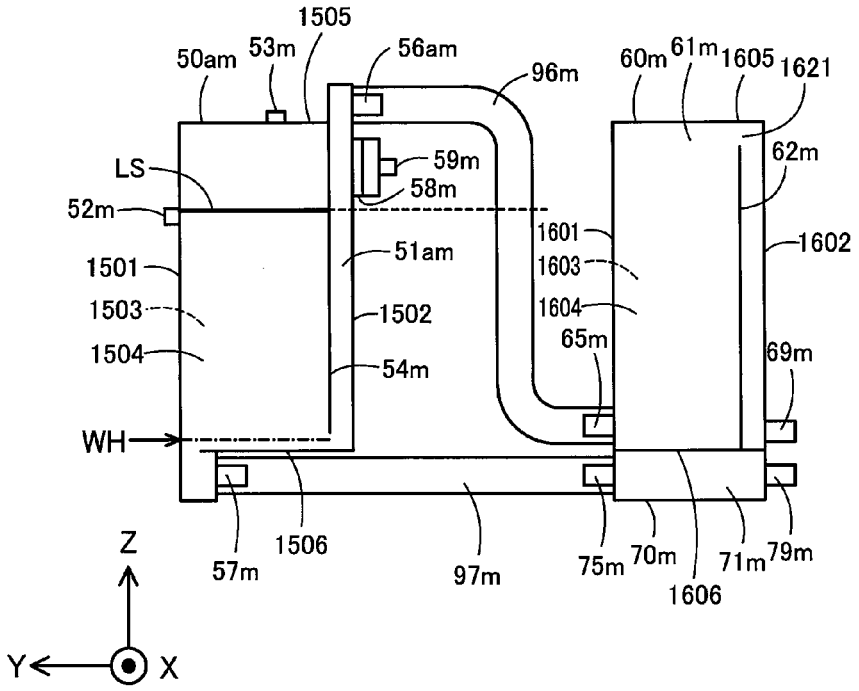
FIG. 17 is a diagram illustrating a liquid supply device according to another configuration 1.

FIG. 17 is a diagram illustrating a liquid supply device according to another configuration 1. FIG. 17 illustrates the liquid supply device in the use state (first attitude). The configuration of FIG. 17 differs from the configuration of the embodiment shown in FIG. 15 by only a liquid containing chamber 50*am* provided in place of the liquid containing chamber 50*m*. The liquid containing chamber 50*am* includes a main body 51*am* in place of the main body and an opening member 56*am* in place of the opening member 56*m* and additionally includes a partition wall 54*m*.

The main body 51*am* includes a second protruded portion formed by protruding a corner of the top face 1505, in addition to a protruded portion formed by protruding part of the bottom face 1506. The second protruded portion of the main body 51*am* has an opening that is formed at a position corresponding to the position where the opening member 56*am* is placed to have a size corresponding to an opening of the opening member 56*am*. The opening member 56*am* is arranged in the second protruded portion of the main body 51*am*. The configurations, the materials, the functions and the like of the respective components of the main body 51*am* and the opening member 56*am* other than those described above are similar to those described in the above embodiment.

The partition wall 54*m* is arranged in the inner space of the main body 51*am* to be extended from the second protruded portion parallel to the rear face 1502 and parallel to the right side face 1504. The partition wall 54*m* has an opening at a vertically lower end. This opening causes the inner space of the main body 51*am* to communicate with the space (flow path) partitioned by the partition wall 54*m*. Like the main body 51*am*, the partition wall 54*m* is molded from a synthetic resin. The partition wall 54*m* may be integrally molded with the main body 51*am*.

According to this configuration, the opening of the partition wall 54*m* of the liquid containing chamber 50*am* serves as an air inlet port. According to this configuration, a liquid surface (meniscus) that directly communicates with the atmosphere is formed near to the opening of the partition wall 54*m*. The space (flow path) partitioned by the partition wall 54*m* in the main body 51*am* of the liquid containing chamber 50*am* serves as part of the air flow path 1300 (more specifically, the second flow path 1320) described above with reference to FIG. 13. Additionally, a portion of the space (flow path) partitioned by the partition wall 54*m* in the main body 51*am* of the liquid containing chamber 50*am* that is located vertically above the first state indication element 52*m* corresponds to the "upper portion".

This another configuration 1 described above provides similar advantageous effects to those of the above embodiment. Additionally, in this another configuration 1, the upper portion is provided in the flow path formed in the liquid containing chamber 50*am* (i.e., the space partitioned by the partition wall 54*m* in the main body 51*am*). This configuration enables the upper portion to be readily provided.

(2) Another Configuration 2

Figure 18:
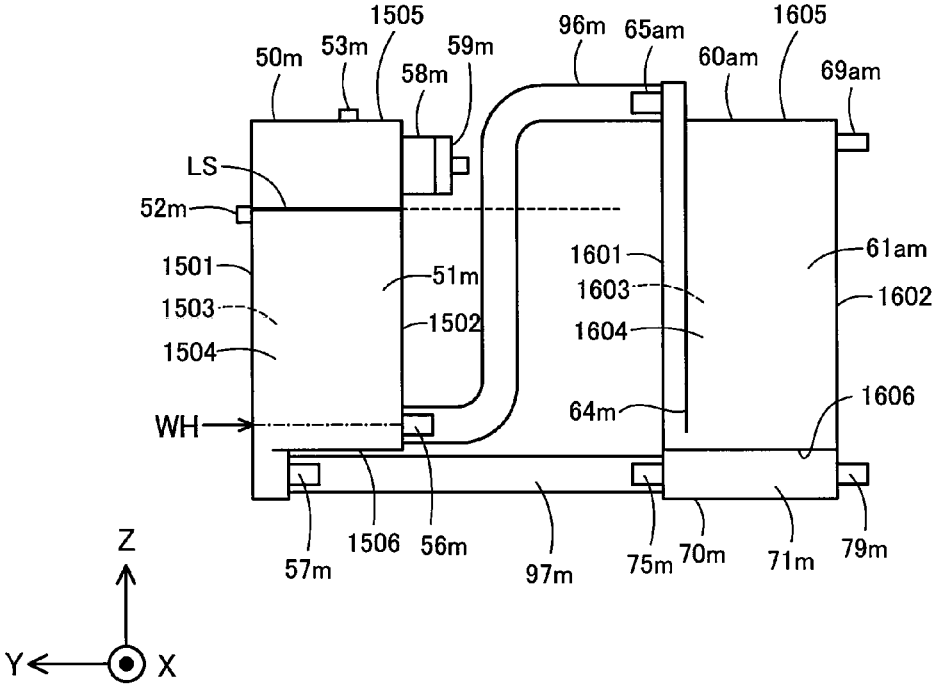
FIG. 18 is a diagram illustrating a liquid supply device according to another configuration 2.

FIG. 18 is a diagram illustrating a liquid supply device according to another configuration 2. FIG. 18 illustrates the liquid supply device in the use state (first attitude). The configuration of FIG. 18 differs from the configuration of the embodiment shown in FIG. 15 by only an air containing chamber 60*am* provided in place of the air containing chamber 60*m*. The air containing chamber 60*am* includes a main body 61*am* in place of the main body 61*m*, a partition wall 64*m* in place of the partition wall 62*m*, a first opening member 65*am* in place of the first opening member 65*m* and a second opening member 69*am* in place of the second opening member 69*m*.

The main body 61*am* includes a protruded portion formed by protruding a corner of the top face 1605. The protruded portion of the main body 61*am* has an opening that is formed at a position corresponding to the position where the first opening member 65*am* is placed to have a size corresponding to an opening of the first opening member 65*am*. The first opening member 65*am* is arranged in the protruded portion of the main body 61*am*. The second opening member 69*am* is arranged at a predetermined position on the rear face 1602 of the main body 61*am*. This predetermined position is preferably in an upper part in the vertical direction of the main body 61*am* (above the center position) and is more preferably in an upper end part, in terms of suppressing ink from flowing out from the air containing chamber 60*am*. The configurations, the materials, the functions and the like of the respective components of the main body 61*am*, the first opening member 65*am* and the second opening member 69*am* other than those described above are similar to those described in the above embodiment.

The partition wall 64*m* is arranged in the inner space of the main body 61*am* to be extended from the protruded portion of the main body 61*am* parallel to the front face 1601 and parallel to the right side face 1604. The partition wall 64*m* has an opening at a vertically lower end. This opening causes the inner space of the main body 61*am* to communicate with the space (flow path) partitioned by the partition wall 64*m*. Like the main body 61*am*, the partition wall 64*m* is molded from a synthetic resin. The partition wall 64*m* may be integrally molded with the main body 61*am*.

According to this configuration, an opening at the other end of the second opening member 69*am* of the air containing chamber 60*am* forms the air outlet port 1691. The space (flow path) partitioned by the partition wall 64*m* in the main body 61*am* of the air containing chamber 60*am* serves as part of the air flow path 1300 (more specifically, the second flow path 1320) described above with reference to FIG. 13. Additionally, a portion of the space (flow path) partitioned by the partition wall 64*m* in the main body 61*am* of the air containing chamber 60*am* that is located vertically above the first state indication element 52*m* of the liquid containing chamber 50*m* corresponds to the "upper portion".

This another configuration 2 described above provides similar advantageous effects to those of the above embodiment. Additionally, in this another configuration 2, the upper portion is provided in the air containing chamber 60*am* (i.e., the space partitioned by the partition wall 64*m* in the main body 61*am*). This configuration enables the upper portion to be readily provided.

(3) Another Configuration 3

Figure 19:
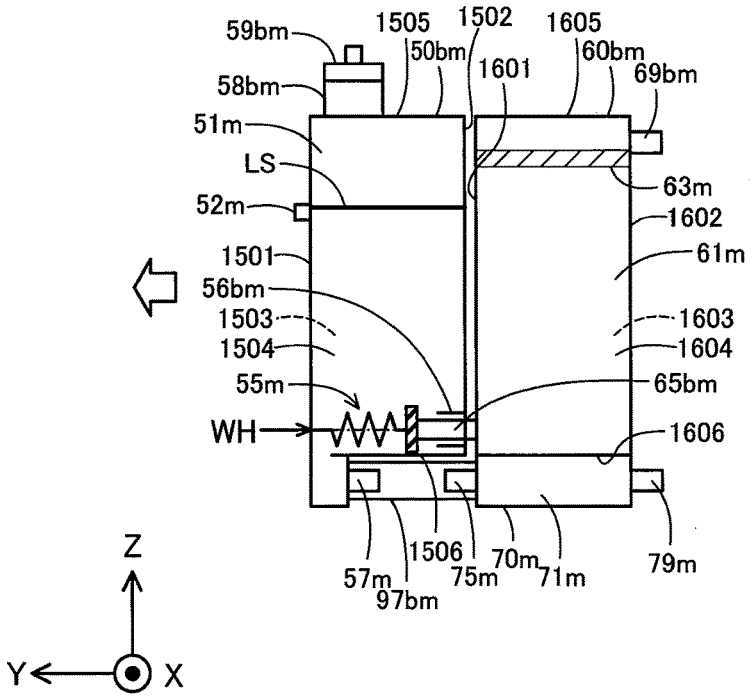
FIG. 19 is a diagram illustrating a liquid supply device according to another configuration 3.
Figure 20:
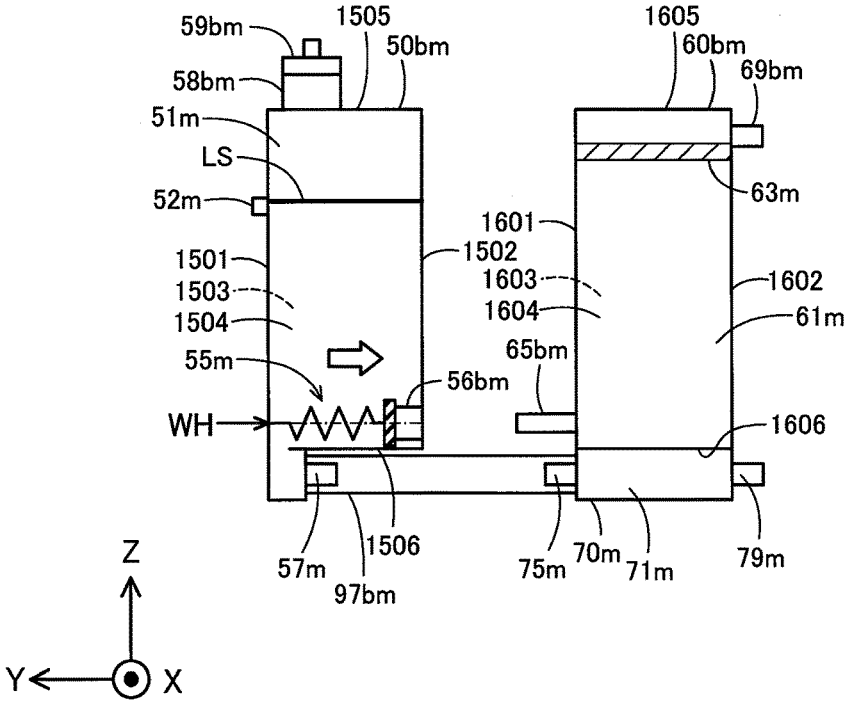
FIG. 20 is a diagram illustrating the liquid supply device according to the another configuration 3.

FIGS. 19 and 20 are diagrams illustrating a liquid supply device according to another configuration 3. FIG. 19 illustrates the liquid supply device in the use state (first attitude). FIG. 20 illustrates the liquid supply device in the liquid refilling state (second attitude). The configuration of FIGS. 19 and 20 differs from the configuration of the embodiment shown in FIG. 15 by a liquid containing chamber 50*bm* provided in place of the liquid containing chamber 50*m* and an air containing chamber 60*bm* provided in place of the air containing chamber 60*m*.

The liquid containing chamber 50*bm* includes an opening member 56*bm* in place of the opening member 56*m*, a liquid injection portion 58*bm* in place of the liquid injection portion 58*m* and a plug member 59*bm* in place of the plug member 59*m*, excludes the second state indication element 53*m* and additionally includes a valve mechanism 55*m*.

Like the opening member 56*m*, the opening member 56*bm* is a cylindrical member having openings at both ends. The opening member 56*bm* is arranged at a predetermined position on the rear face 1502 of the main body 51*m* to be extended inward from the main body 51*m*. As in the case of the opening member 56*m*, this predetermined position may be in a lower part in the vertical direction (Z-axis direction) of the main body 51*m* and is preferably below the lower limit position of ink. According to this configuration, the opening member 56*bm* is arranged at a vertically lower end on the rear face 1502 of the main body 51*m*. Like the main body 51*m*, the opening member 56*bm* is molded from a synthetic resin. The opening member 56*bm* may be integrally molded with the main body 51*m*. The opening at one end of the opening member 56*bm* is arranged to communicate with the opening of the main body 51*m*. The opening at the other end of the opening member 56*bm* is open in the main body 51*m*.

The liquid injection portion 58*bm* and the plug member 59*bm* are provided on the top face 1505 instead of the rear face 1502 but are otherwise similar to the liquid injection portion 58*m* and the plug member 59*m*.

The valve mechanism 55*m* includes an elastic element such as spring and a sealing member. The sealing member is formed from a material having elasticity to have such a size that covers over the opening of the opening member 56*bm*. The sealing member is pressed by the elastic element in a direction from the front face 1501 toward the rear face 1502 (i.e. in a direction of closing the opening member 56*bm*). The valve mechanism 55*m* is thus configured to close the opening of the opening member 56*bm* without application of an external force.

The air containing chamber 60*bm* includes a first opening member 65*bm* in place of the first opening member 65*m* and a second opening member 69*bm* in place of the second opening member 69*m*, excludes the partition wall 62*m*, and additionally includes a gas-permeable liquid-proof member 63*m*.

The first opening member 65*bm* is a cylindrical member having an opening at one end. A cut is formed in the cylinder at the other end (non-open end) of the first opening member 65*bm*. The first opening member 65*bm* is arranged at a predetermined position on the front face 1601 of the main body 61*m* to be extended outward from the main body 61*m*. As in the case of the first opening member 65*m*, this predetermined position may be determined arbitrarily. According to this configuration, the first opening member 65*bm* is arranged at a vertically lower end on the front face 1601 of the main body 61*m*. Like the main body 61*m*, the first opening member 65*bm* is molded from a synthetic resin. The first opening member 65*bm* may be integrally molded with the main body 61*m*. The opening at one end of the first opening member 65*bm* is arranged to communicate with the opening of the main body 61*m*. The other end (non-open end) of the first opening member 65*bm* is inserted through the opening of the opening member 56*bm* into the liquid containing chamber 50*bm* to press the sealing member of the valve mechanism 55*m* in the use state shown in FIG. 19 (first attitude).

The second opening member 69*bm* is arranged at a predetermined position on the rear face 1602 of the main body 61*m*. This predetermined position is preferably in an upper part in the vertical direction of the main body 61*m* (above the center position) and is more preferably in an upper end part, in terms of suppressing ink from flowing out from the air containing chamber 60*bm*. The configurations, the materials, the functions and the like of the respective components of the second opening member 69*bm* other than those described above are similar to those described in the above embodiment.

The gas-permeable liquid-proof member 63*m* may be a gas-liquid separation membrane made of, for example, Gore-Tex (registered trademark). The gas-permeable liquid-proof member 63*m* is arranged at a predetermined position in the main body 61*m* to block the inner space of the main body 61*m* in the Z-axis direction. This predetermined position is preferably vertically above the first state indication element 52*m* indicating the full level position (upper limit position) of ink in the liquid containing chamber 50*bm* and vertically below the position where the second opening member 69*bm* is placed.

According to this configuration, the opening at the other end of the second opening member 69*bm* of the air containing chamber 60*bm* forms the air outlet port 1691. The cut (opening) at the other end of the first opening member 65*bm* of the air containing chamber 60*bm* serves as an air inlet port. According to this configuration, a liquid surface (meniscus) that directly communicates with the atmosphere is accordingly formed near to the cut at the other end of the first opening member 65*bm*. Additionally, a portion of the main body 61*m* of the air containing chamber 60*bm* that is located vertically above the first state indication element 52*m* indicating the full level position (upper limit position) of ink in the liquid containing chamber 50*bm* corresponds to the "upper portion". The pathway from the opening (air outlet port 1691) at the other end of the second opening member 69*bm* of the air containing chamber 60*bm* through inside of the second opening member 69*bm*, inside of the main body 61*m* and inside the first opening member 65*bm* to the cut of the first opening member 65*bm* forms the air flow path 1300.

The following describes an operation of filling ink in the liquid ejection system 1*m* according to this configuration. The user pulls out the liquid container unit 30*m* (including the liquid containing chambers 50*m*) with the case 40*m* in the Y-axis direction (shown by an open arrow in FIG. 19). This pulls out the first opening member 65*bm* that is placed in the liquid containing chamber 50*m* and releases the pressing force applied to the valve mechanism 55*m* to close the valve mechanism 55*m*. More specifically, the sealing member of the valve mechanism 55*m* is pressed by the elastic element to close the opening of the opening member 56*bm* (as shown by an open arrow in FIG. 20). In the liquid container unit 30*m* in the pulled out state (i.e., in the second attitude in the liquid refilling state), the respective liquid containing chambers 50*bm* are arranged in the attitude shown in FIG. 20. As described above, in response to a change in attitude from the first attitude in the use state (shown in FIG. 19) to the second attitude in the liquid refilling state (shown in FIG. 20) and a change in attitude from the second attitude in the liquid refilling state (shown in FIG. 20) to the first attitude in the use state (shown in FIG. 19), the attitude of only the liquid containing chamber 50*bm* is changed, while the attitude of the air containing chamber 60*bm* is kept unchanged. In the description of this configuration, the term "change in attitude" includes the "change of position".

This another configuration 3 described above provides similar advantageous effects to those of the above embodiment. According to this another configuration 3, the upper portion is provided in the air containing chamber 60*bm*. This configuration thus enables the upper portion to be readily provided. Additionally, the gas-permeable liquid-proof member 63*m* is placed in the upper portion in the air containing chamber 60*bm*. This reduces the possibility that the gas permeation ability of the gas-permeable liquid-proof member 63*m* is damaged by wetting the gas-permeable liquid-poof member 63*m* with the liquid.

In this another configuration 3, the air flow path 1300 may be opened and closed by the valve mechanism 55*m*. This results in improving the flexibility in design of the respective components (for example, the liquid containing chamber 50*bm* and the air containing chamber 60*bm*) of the liquid supply device. For example, according to this another configuration 3, the valve mechanism 55*m* is provided in the air flow path 1300 from the liquid containing chamber 50*bm* to the air containing chamber 60*bm*. Closing the valve mechanism 55*m* suppresses the liquid from flowing from the liquid containing chamber 50*bm* into the air containing chamber 60*bm*. This enables the attitude of only the liquid containing chamber 50*bm* to be readily changed as shown in FIG. 20. Additionally, as shown in FIG. 20, the valve mechanism 55*m* is configured to be detachable in the valve-closed state. Employing this valve mechanism 55*m* enables only the liquid containing chamber 50*bm* in the valve-closed state to be detached from the liquid supply device. This facilitates the operation of filling the liquid in the liquid containing chamber 50*bm*.

(4) Another Configuration 4

Figure 21:
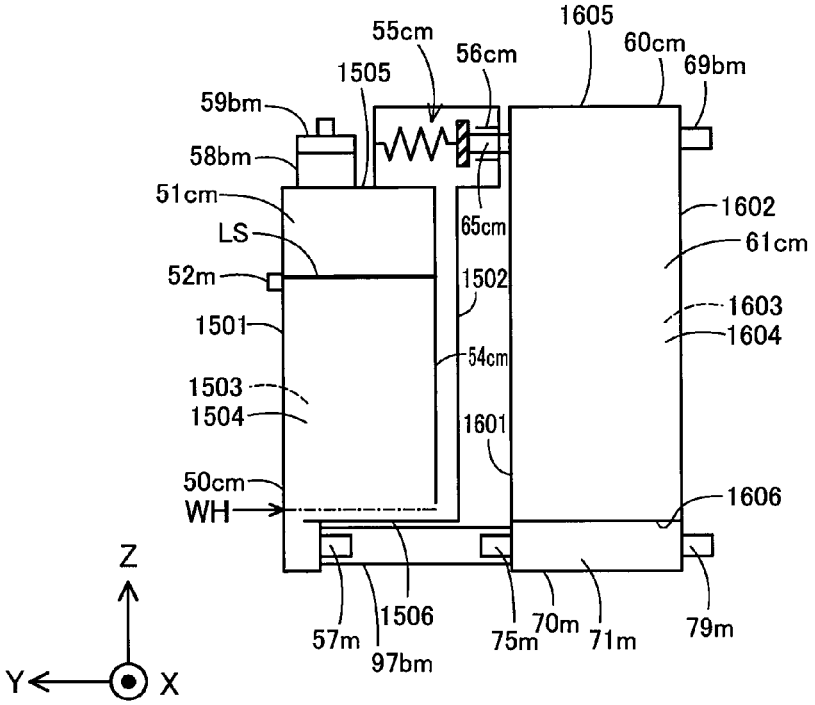
FIG. 21 is a diagram illustrating a liquid supply device according to another configuration 4.

FIG. 21 is a diagram illustrating a liquid supply device according to another configuration 4. FIG. 21 illustrates the liquid supply device in the use state (first attitude). The configuration of FIG. 21 differs from the above another configuration 3 shown in FIG. 19 by a liquid containing chamber 50*cm* provided in place of the liquid containing chamber 50*bm* and an air containing chamber 60*cm* provided in place of the air containing chamber 60*bm*.

The liquid containing chamber 50*cm* includes a main body 51*cm* in place of the main body 51*m*, a valve mechanism 55*cm* in place of the valve mechanism 55*m* and an opening member 56*cm* in place of the opening member 56*bm* and additionally includes a partition wall 54*cm*.

The main body 51*cm* includes a second protruded portion formed by protruding a corner of the top face 1505, in addition to a protruded portion formed by protruding part of the bottom face 1506. The second protruded portion of the main body 51*cm* has an opening that is formed at a position corresponding to the position where the opening member 56*cm* is placed to have a size corresponding to an opening of the opening member 56*cm*. Both the opening member 56*cm* and the valve mechanism 55*cm* are placed in the second protruded portion of the main body 51*cm*. The configurations, the materials, the functions and the like of the respective components of the main body 51*cm*, the valve mechanism 55*cm* and the opening member 56*cm* other than those described above are similar to those described in the above another configuration 3.

The partition wall 54*cm* is arranged in the inner space of the main body 51*cm* to be extended from the second protruded portion parallel to the rear face 1502 and parallel to the right side face 1504. The partition wall 54*cm* has an opening at a vertically lower end. This opening causes the inner space of the main body 51*cm* to communicate with the space (flow path) partitioned by the partition wall 54*cm*. Like the main body 51*cm*, the partition wall 54*cm* is molded from a synthetic resin. The partition wall 54*cm* may be integrally molded with the main body 51*cm*.

The air containing chamber 60*cm* includes a main body 61*cm* in place of the main body 61*m* and a first opening member 65*cm* in place of the first opening member 65*bm* and excludes the gas-permeable liquid-proof member 63*m*.

The main body 61*cm* is longer in the vertical direction than the main body 51*cm*. The first opening member 65*cm* is arranged at a predetermined position on the front face 1601 of the main body 61*cm* to be extended outward from the main body 61*cm*. This predetermined position is a position opposed to the opening member 56*cm* of the liquid containing chamber 50*cm* in assembly of the liquid supply device as shown in FIG. 21. The configurations, the materials, the functions and the like of the respective components of the main body 61*cm* and the first opening member 65*cm* other than those described above are similar to those described in the above another configuration 3.

According to this configuration, the opening of the partition wall 54*cm* of the liquid containing chamber 50*cm* serves as an air inlet port. According to this configuration, a liquid surface (meniscus) that directly communicates with the atmosphere is formed near to the opening of the partition wall 54*cm*. A portion of the main body 51*cm* of the liquid containing chamber 50*cm* that is located vertically above the first state indication element 52*m* indicating the full level position (upper limit position) of ink and a portion of the main body 61*cm* of the air containing chamber 60*cm* that is located vertically above the first state indication element 52*m* indicating the full level position (upper limit position) of ink respectively correspond to the "upper portion". Additionally, the pathway from the opening (air outlet port 1691) at the other end of the second opening member 69*bm* of the air containing chamber 60*cm* through inside of the second opening member 69*bm*, inside of the main body 61*cm*, inside the first opening member 65*cm* and the space in the main body 51*cm* of the liquid containing chamber 50*cm* partitioned by the partition wall 54*cm* to the opening of the partition wall 54*cm* forms the air flow path 1300.

This another configuration 4 described above provides similar advantageous effects to those of the above embodiment. According to this another configuration 4, the upper portion is provided in both the flow path formed in the liquid containing chamber 50*cm* (i.e., the space in the main body 51*cm* partitioned by the partition wall 54*cm*) and in the air containing chamber 60*cm*. This configuration thus enables the upper portion to be readily provided. According to this configuration, both the upper portion and the valve mechanism 55*cm* are provided in the liquid containing chamber 50*cm*.

In this another configuration 4, the air flow path 1300 may be opened and closed by the valve mechanism 55*cm* provided in the middle of the air flow path 1300. This results in improving the flexibility in design of the respective components (for example, the liquid containing chamber 50*cm* and the air containing chamber 60*cm*) of the liquid supply device. For example, the valve mechanism 55*cm* may be provided in the air flow path 1300 from the liquid containing chamber 50*cm* to the air containing chamber 60*cm*, as shown in FIG. 21. Closing the valve mechanism 55*cm* suppresses the liquid from flowing from the liquid containing chamber 50*cm* into the air containing chamber 60*cm*. This enables the attitude of only the liquid containing chamber 50*cm* to be readily changed.

(5) Another Configuration 5

Figure 22:
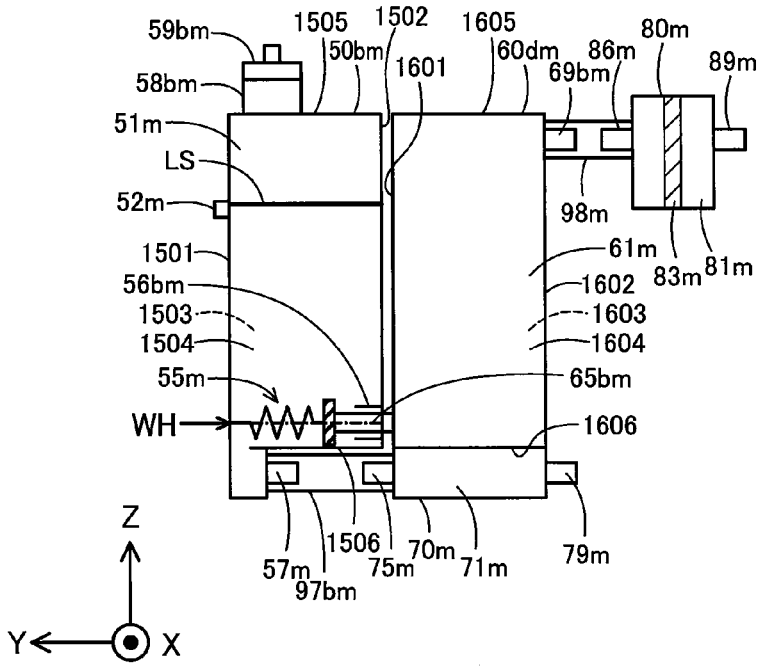
FIG. 22 is a diagram illustrating a liquid supply device according to another configuration 5.

FIG. 22 is a diagram illustrating a liquid supply device according to another configuration 5. FIG. 22 illustrates the liquid supply device in the use state (first attitude). The configuration of FIG. 22 differs from the above another configuration 3 shown in FIG. 19 by an air containing chamber 60*dm* provided in place of the air containing chamber 60*bm*.

The air containing chamber 60*dm* differs from the air containing chamber 60*bm* of another configuration 3 shown in FIG. 19 by exclusion of the gas-permeable liquid-proof member 63*m* and inclusion of a second connection body 80*m* and a third hose 98*m*. The second connection body 80*m* corresponds to the "liquid-proof chamber".

The second connection body 80*m* includes a main body 81*m*, a gas-permeable liquid-proof member 83*m*, a first opening member 86*m* and a second opening member 89*m*.

The main body 81*m* is a hollow approximately columnar member. The main body 81*m* includes openings formed at positions respectively corresponding to the position where the first opening member 86*m* is placed and the position where the second opening member 89*m* is placed to have sizes corresponding to openings of the respective members 86*m* and 89*m*. The main body 81*m* may be molded, for example, from a synthetic resin such as polypropylene.

The gas-permeable liquid-proof member 83*m* may be a gas-liquid separation membrane made of, for example, Gore-Tex (registered trademark). The gas-permeable liquid-proof member 83*m* is arranged at a predetermined position (for example, in an approximate center area in the Y-axis direction) in the main body 81*m* to block the inner space of the main body 81*m* in the Y-axis direction.

The first opening member 86*m* is a cylindrical member having openings at both ends. The first opening member 86*m* is arranged on one face of the main body 81*m* to be extended outward from the main body 81*m*. The position where the first opening member 86*m* is placed may be determined arbitrarily. Like the main body 81*m*, the first opening member 86*m* is molded from a synthetic resin. The first opening member 86*m* may be integrally molded with the main body 81*m*. The opening at one end of the first opening member 86*m* is arranged to communicate with the opening of the main body 81*m*. The opening at the other end of the first opening member 86*m* is arranged to communicate with the air containing chamber 60*dm* via the third hose 98*m*.

The second opening member 89*m* is a cylindrical member having openings at both ends. The second opening member 89*m* is arranged on the other face of the main body 81*m* (i.e., on an opposite face opposite to one face) to be extended outward from the main body 81*m*. The position where the second opening member 89*m* is placed may be determined arbitrarily. Like the main body 81*m*, the second opening member 89*m* is molded from a synthetic resin. The second opening member 89*m* may be integrally molded with the main body 81*m*. The opening at one end of the second opening member 89*m* is arranged to communicate with the opening of the main body 81*m*. The opening at the other end of the second opening member 89*m* is arranged to communicate with the atmosphere.

The third hose 98*m* is a hose in a cylindrical shape having openings at both ends. The third hose 98*m* is molded from a resin material having flexibility (for example, rubber). The third hose may not necessarily have flexibility.

According to this configuration, the opening at the other end of the second opening member 89*m* of the second connection body 80*m* forms an air outlet port. Like the above another configuration 3, the cut (opening) at the other end of the first opening member 65*bm* of the air containing chamber 60*dm* serves as an air inlet port. Additionally, a portion of the main body 61*m* of the air containing chamber 60*dm* that is located vertically above the first state indication element 52*m* indicating the full level position (upper limit position) of ink and a portion of the main body 81*m* of the second connection body 80*m* that is located vertically above the first state indication element 52*m* indicating the full level position (upper limit position) of ink respectively correspond to the "upper portion". The pathway from the opening (air outlet port) at the other end of the second opening member 89*m* of the second connection body 80*m* through inside of the second opening member 89*m*, inside of the main body 81*m*, inside of the third hose 89*m* and inside of the main body 61*m* and inside of the first opening member 65*bm* to the cut of the first opening member 65*bm* forms the air flow path 1300.

This another configuration 5 described above provides similar advantageous effects to those of the above embodiment. According to this another configuration 5, the upper portion is provided in both the second connection body 80*m* and in the air containing chamber 60*dm*. This configuration thus enables the upper portion to be readily provided.

Additionally, according to this another configuration 5, in the liquid supply device, the liquid-proof chamber (second connection body 80*m*) that is replaceable independently of the air containing chamber 60*dm* is included in the upper portion in the air containing chamber 60*dm*. The gas-permeable liquid-proof member 83*m* is placed in this liquid-proof chamber. In the case where the gas-permeable liquid-proof member 83 is wet, this configuration enables only the liquid-proof chamber to be readily replaced and reduces the cost required for replacement.

E. Modifications of Third Embodiment

The disclosure is not limited to any of the embodiment and the configurations described above but may be implemented by a diversity of other aspects without departing from the scope of the disclosure. Some of possible modifications are given below.

* Modification 1

The configurations of the liquid supply device are described in the above embodiment. The configuration of the liquid supply device may be, however, determined arbitrarily without departing from the scope of the disclosure. For example, various components may be added, omitted or changed.

For example, the first hose arranged to connect the liquid containing chamber with the air containing chamber may not necessarily include the upper portion that is vertically above the first state indication element. In another example, the first hose arranged to connect the liquid containing chamber with the air containing chamber and the second hose arranged to connect the air containing chamber with the first connection body may not be necessarily be made of the material having flexibility. For example, at least one of these hoses may be made of a material having elasticity or may be made of a synthetic resin that is similar to the synthetic resin employed for the main body of the chamber or the connection body.

Figure 23:
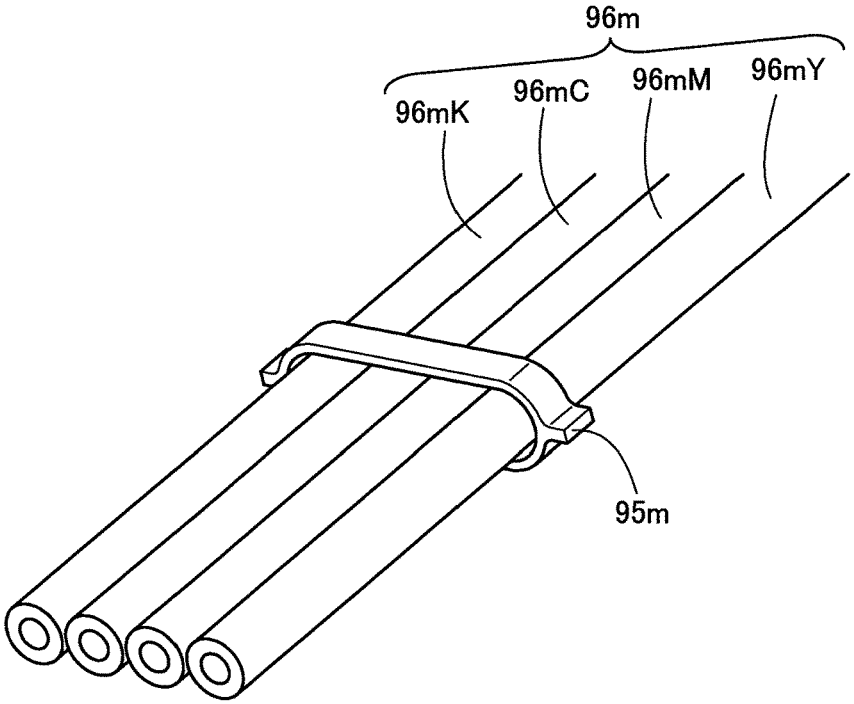
FIG. 23 is a diagram illustrating a linkage member.

FIG. 23 is a diagram illustrating a linkage member. For example, in the above embodiment, a plurality of first hoses 96*m*C to 96*m*Y provided to connect the respective liquid containing chambers 50*m*C to 50*m*Y with the corresponding air containing chambers 60*m*C to 60*m*Y may be linked by means of a linkage member. In the illustrated example of FIG. 23, a clamp-type linkage member 95*m* is used to link the respective first hoses 96*m*C to 96*m*Y. Any of various members, for example, a clamping band, a hook and loop fastener or a tape may be employed for the linkage member. Using such a linkage member enhances the rigidity of the respective first hoses 96*m*C to 96*m*Y in the linkage direction and thereby suppresses deformation of the respective first hoses 96*m*C to 96*m*Y. This results in suppressing blockage of the flow paths between the respective liquid containing chambers 50*m*C to 50*m*Y and the corresponding air containing chambers 60*m*C to 60*m*Y and reduces the possibility of failed liquid supply caused by blockage of the flow path. The similar advantageous effect is achieved by integrally molding the plurality of first hoses 96*m*C to 96*m*Y, instead of using the linkage member. Similarly a plurality of second hoses 97*m* provided to connect the respective liquid containing chambers 50*m* with the corresponding first connection bodies 70*m* and a plurality of third hoses 98*m* provided to connect the respective air containing chambers 60*m* with the corresponding second connection bodies 80*m* may be linked by means of a linkage member or may be integrally molded.

For example, the first connection body may be omitted. In this case, the liquid containing chamber may be directly connected with the record head by means of the second hose. The second connection body may also be omitted. In another example, multiple sets of the first connection bodies or multiple sets of the second connection bodies may be provided. For example, a connection body having a similar configuration to that of the first connection body may be provided in the middle between the liquid containing chamber and the air containing chamber (more specifically, in the approximate center of the second hose shown in FIG. 15).

For example, the configuration of the valve mechanism (including the sealing member and the elastic element) is only illustrative and another configuration may be employed for the valve mechanism. In a concrete example, a solenoid or hydraulic pressure may be used in place of the elastic element to press the sealing member. The material and the shape of the sealing member may also be changed arbitrarily.

* Modification 2

The configuration of the liquid ejection system is described in the above embodiment. The configuration of the liquid ejection system may be, however, determined arbitrarily without departing from the scope of the disclosure. For example, various components may be added, omitted or changed.

For example, the second attitude in the liquid refilling state may be different from the second attitude described in the above embodiment. For example, rails (not shown) may be provided inside of a printer. A liquid container unit (including liquid containing chambers) with a case may be moved in the X-axis direction, such that the respective liquid containing chambers are exposed outside of the housing of the printer for liquid filling. In this configuration, it is preferable that a liquid injection portion is provided on a top face of the liquid containing chamber.

F. Fourth Embodiment (Configuration that the Direction of Array of Liquid Tanks is Parallel to the Direction of Array of Buffer Tanks)

Figure 24:
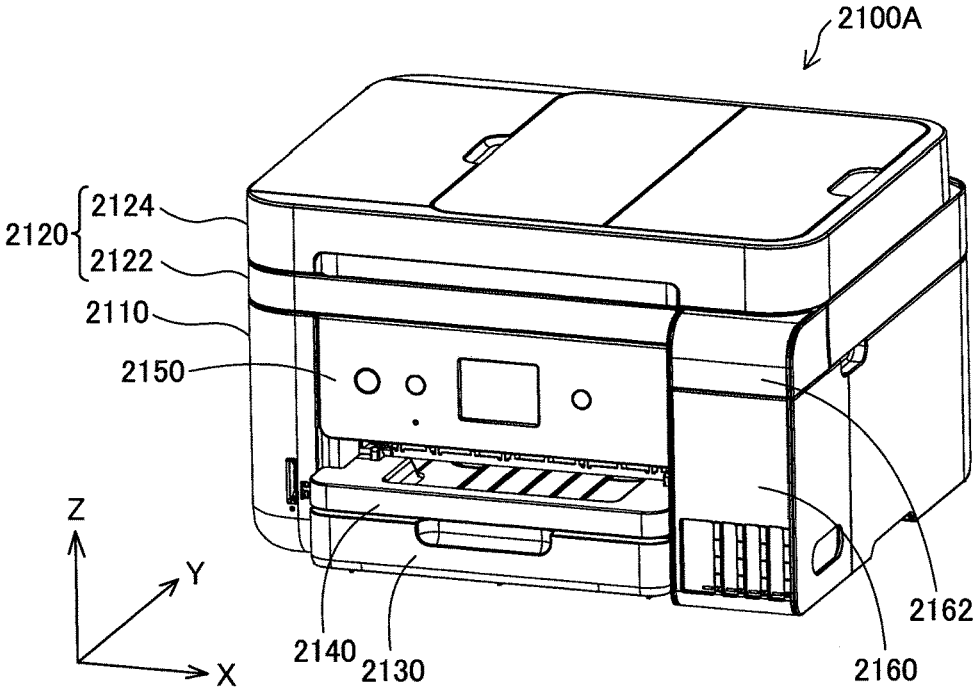
FIG. 24 is a perspective view illustrating a printer according to a fourth embodiment.

FIG. 24 is a perspective view illustrating a printer 2100A as a liquid ejection apparatus according to a fourth embodiment. This printer 2100A is a printing apparatus configured to perform printing by ejecting ink as a liquid onto a printing medium. In the description of this embodiment, "liquid" means ink.

XYZ axes orthogonal to one another are illustrated in FIG. 24 and subsequent drawings. The X axis corresponds to the width direction of the printer 2100A, the Y axis corresponds to the depth direction of the printer 2100A and the Z axis corresponds to the height direction of the printer 2100A. The printer 2100 is placed on a horizontal placement surface defined by the X direction and the Y direction. In the description below, +X direction is also called "rightward direction" and −X direction is also called "leftward direction"; +Y direction is also called "rearward direction" and −Y direction is also called "forward direction"; and ±Z directions are also called "vertical direction".

The printer 2100 includes a printer main body 2110 and a scanner unit 2120 provided on the printer main body 2110 to be openable and closable. The scanner unit 2120 includes a scanner base 2122 including a glass plate (not shown) and a scanner cover 2124. A scanning optical system of the scanner unit 2120 is provided inside of the printer main body 2110. A media storage portion 2130, a media discharge portion 2140 and an operation panel 2150 are provided on a front face of the printer main body 2110 to be arranged sequentially from the bottom. The media storage portion 2130 is configured to store printing media and supplies each of the printing media to a media conveyance mechanism (not shown). The media discharge portion 2140 is configured to discharge in the −Y direction each of the printing media printed by ejection of the liquid by a liquid ejection portion (described later). A liquid container unit 2160 is provided at a right end (+X direction end) on the front face of the printer 2110. The liquid container unit 2160 has a cover 2162 that is provided in an upper part thereof to be openable and closable.

Figure 25:
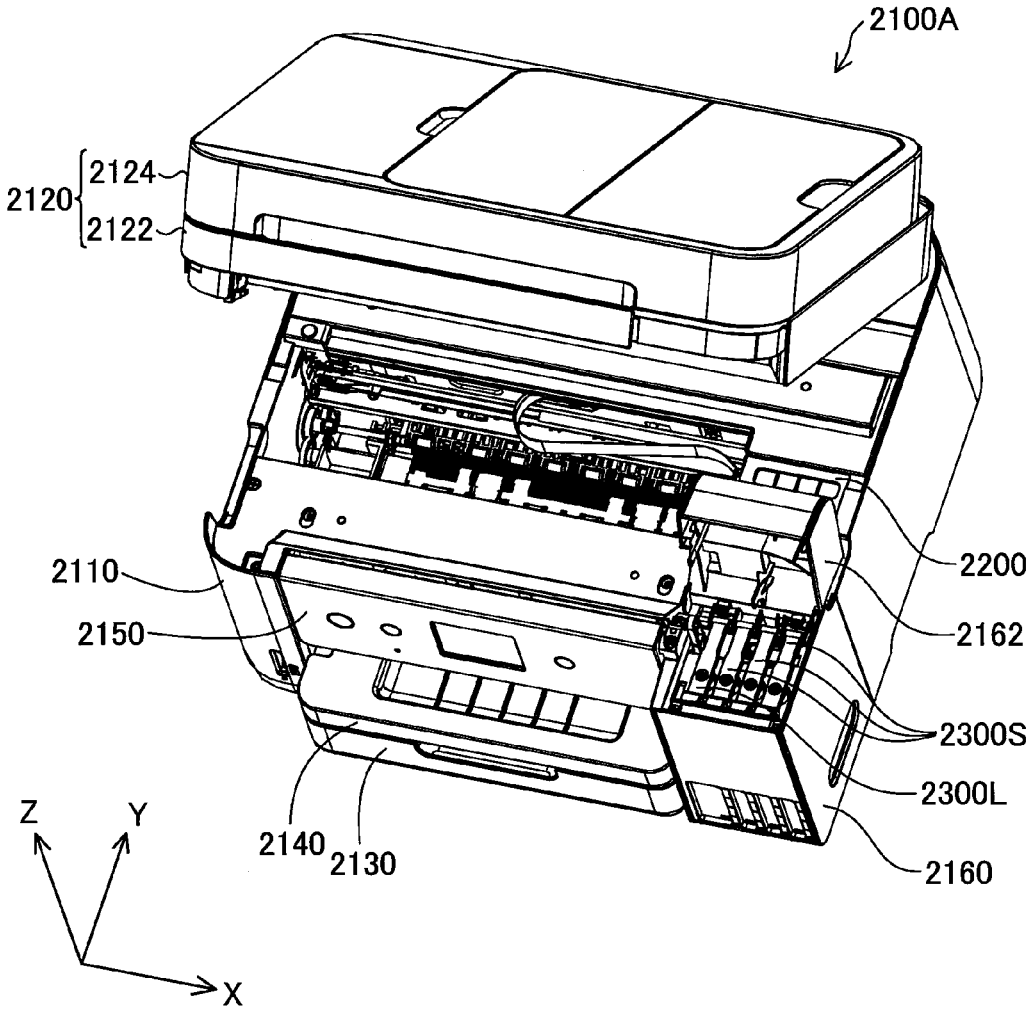
FIG. 25 is a perspective view illustrating the printer of the fourth embodiment.

FIG. 25 is a perspective view illustrating the printer 2100A in the state that the scanner unit 2120 and the cover 2162 of the liquid container unit 2160 are opened. A plurality of liquid tanks 2300S and 2300L are placed in the liquid container unit 2160. A carriage 2200 equipped with a liquid ejection portion (print head) is also provided in the printer main body 2110. This printer 2100A is an "off-carriage type" printer in which the liquid tanks 2300S and 2300L are not mounted on the carriage 2200 but are placed at a fixed position.

Each of the liquid tanks 2300S and 2300L is configured to contain ink as the liquid. The liquid tank 2300L is a tank of larger capacity than the capacities of the other liquid tanks 2300S. For example, the liquid tank 2300L is provided to contain black ink that is generally consumed more than other inks, and the other liquid tanks 2300S are provided to contain other inks (for example, color inks such as magenta ink, cyan ink and yellow ink). The number and the type of inks may be set arbitrarily. In the description below, when there is no need to distinguish the two different types of liquid tanks 2300S and 2300L from each other, these liquid tanks are collectively called "liquid tank 2300". Each of the liquid tanks 2300 includes a liquid containing chamber (described later) configured to contain the liquid. Any material such as a resin or a flexible film may be employed as the material of the liquid tank 2300.

Figure 26:
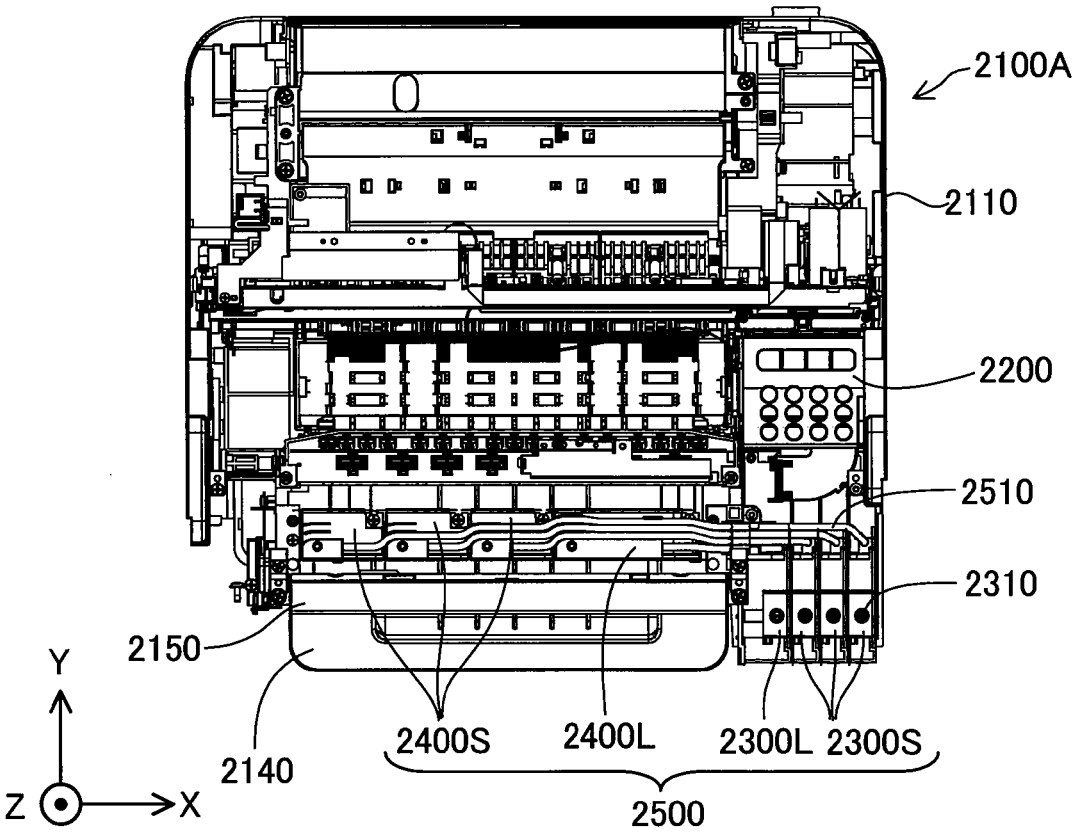
FIG. 26 is a plan view illustrating the internal configuration of the printer of the fourth embodiment.

FIG. 26 is a plan view illustrating the internal configuration of the printer 2100A. Part of components, for example, the scanner unit 2120 are omitted from the illustration. A liquid injection portion 2310 is provided on a top face of each liquid tank 2300 to inject the liquid into the liquid tank 2300. When the volume of the liquid is decreased in the liquid tank 2300 by consumption of the liquid, the user may fill the liquid through the liquid injection portion 2310 into the liquid tank 2300 using a liquid bottle for liquid refilling.

A plurality of buffer tanks 2400S and 2400L are provided behind (on the +Y direction of) the operation panel 2150. These buffer tanks 2400S and 2400L are individually connected with the corresponding liquid tanks 2300S and 2300L by means of a connection flow path member 2510. The plurality of liquid tanks 2300S and 2300L, the plurality of buffer tanks 2400S and 2400L and the connection flow path member 2510 constitute a liquid supply device 2500 configured to supply the liquid to the liquid ejection portion (print head) of the printer 2100A.

The buffer tank 2400L is a tank of larger capacity than the capacities of the other buffer tanks 2400S and is connected with the larger-capacity liquid tank 2300L. The smaller-capacity buffer tanks 2400S are connected with the smaller-capacity liquid tanks 2300S. In the description below, when there is no need to distinguish the two different types of buffer tanks 2400S and 2400L from each other, these buffer tanks are collectively called "buffer tank 2400". Each of the buffer tanks 2400 includes a buffer chamber (described later) configured to store the liquid flowing out from the liquid tank 2300. The buffer chamber of the buffer tank 2400 serves to suppress the liquid contained in the liquid tank 2300 from leaking out in response to a change in environment (for example, a change in atmospheric pressure, temperature or attitude). As described later, the buffer tank 2400 has an air outlet port that communicates with the atmosphere. Any material such as a resin or a flexible film may be employed as the material of the buffer tank 2400.

According to the fourth embodiment, the plurality of liquid tanks 2300 are arrayed in the X direction (first direction). The plurality of buffer tanks 2400 are also arrayed in the X direction (first direction). This arrangement suppresses the size of the liquid supply device 2500 from being excessively expanded in a direction (especially in the Y direction) intersecting with the X direction (first direction).

According to this embodiment, the plurality of liquid tanks 2300 are provided as different bodies. According to another embodiment, only one housing may be provided, and a plurality of liquid containing chambers configured to contain different liquids may be provided in the housing. In this case, one housing and a plurality of liquid containing chambers constitute one "liquid tank". In the description below, the term "liquid tank provided with a plurality of liquid containing chambers" means both a plurality of liquid tanks provided as different bodies like this embodiment and one liquid tank including one housing and a plurality of liquid containing chambers. Similarly the term "buffer tank provided with a plurality of buffer chambers" means both a plurality of buffer tanks provided as different bodies like this embodiment and one buffer tank including one housing and a plurality of buffer chambers.

The connection flow path member 2510 may be a flow path member having any of various configurations, for example, a tube, a multiple-tube including a plurality of tubes arrayed and joined together or a flow path configured by sealing a groove formed in a base member with a film. Any of various materials such as a resin or a metal may be used as the material of the connection flow path member 2510.

According to this embodiment, the buffer tanks 2400 are connected with the liquid tanks 2300. This configuration advantageously reduces the possibility of leakage of the liquid to the outside. Additionally, the liquid tank 2300 and the buffer tank 2400 are provided as different bodies. This configuration advantageously enables each of the volume of the liquid containing chamber 2360 and the volume of the buffer chamber 2430 to be readily increased and decreased.

Figure 27:
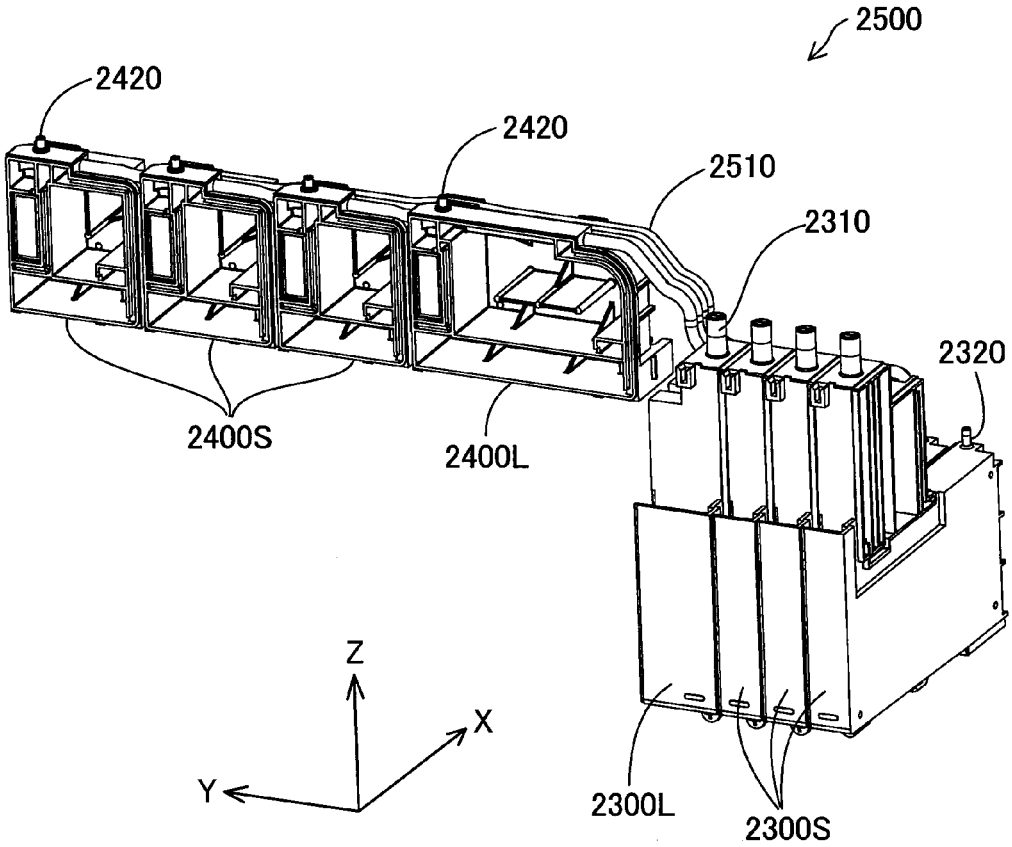
FIG. 27 is a perspective view illustrating a liquid supply device according to the fourth embodiment.
Figure 28:
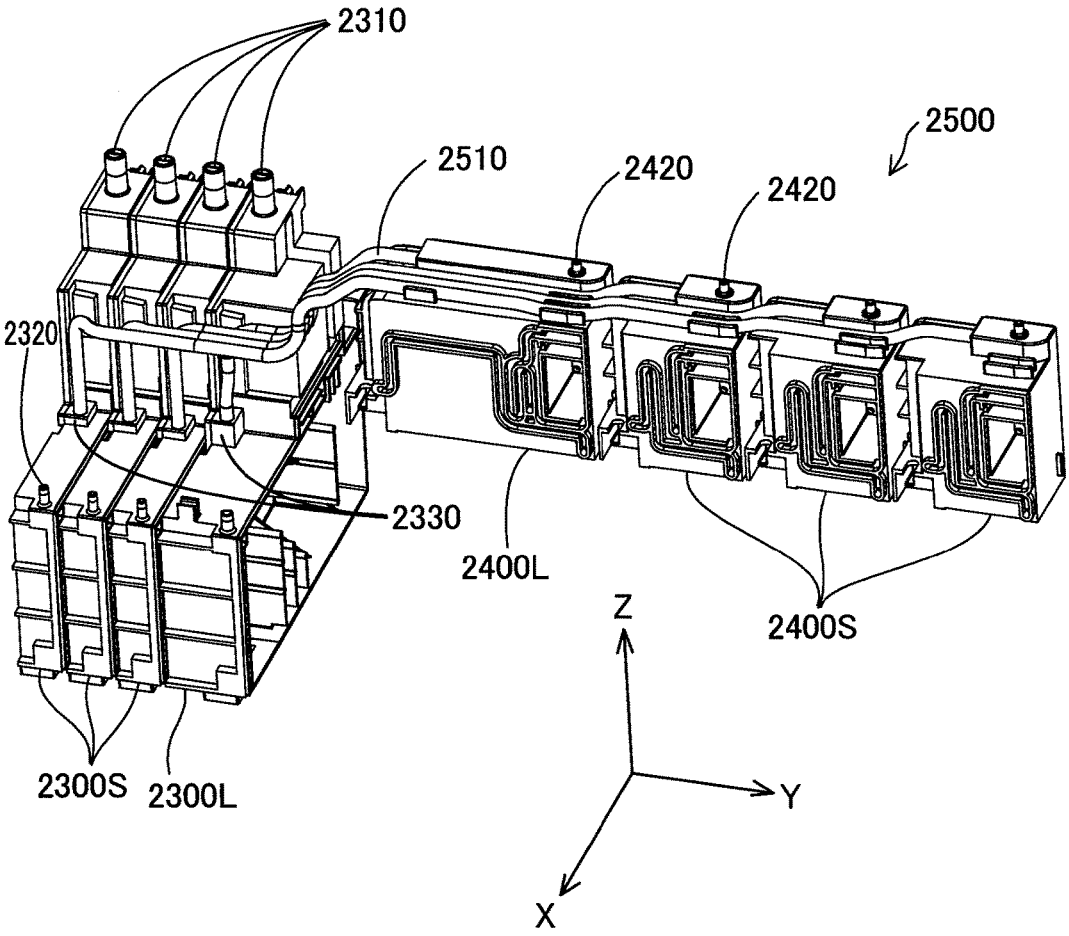
FIG. 28 is a perspective view illustrating the liquid supply device of the fourth embodiment.

FIGS. 27 and 28 are perspective views illustrating the liquid supply device 2500 including the liquid tanks 2300, the buffer tanks 2400 and the connection flow path member 2510. Each of the liquid tanks 2300 includes a connection port 2320 provided for connection with the liquid ejection portion on the carriage 2200 and a connection port 2330 provided for connection with the buffer tank 2400. The connection flow path member 2510 is connected with the connection ports 2330. Each of the buffer tanks 2400 includes an air outlet port 2420 provided on a top face thereof. The buffer tank 2400 communicates with the atmosphere via this air outlet port 2420.

Figure 29:
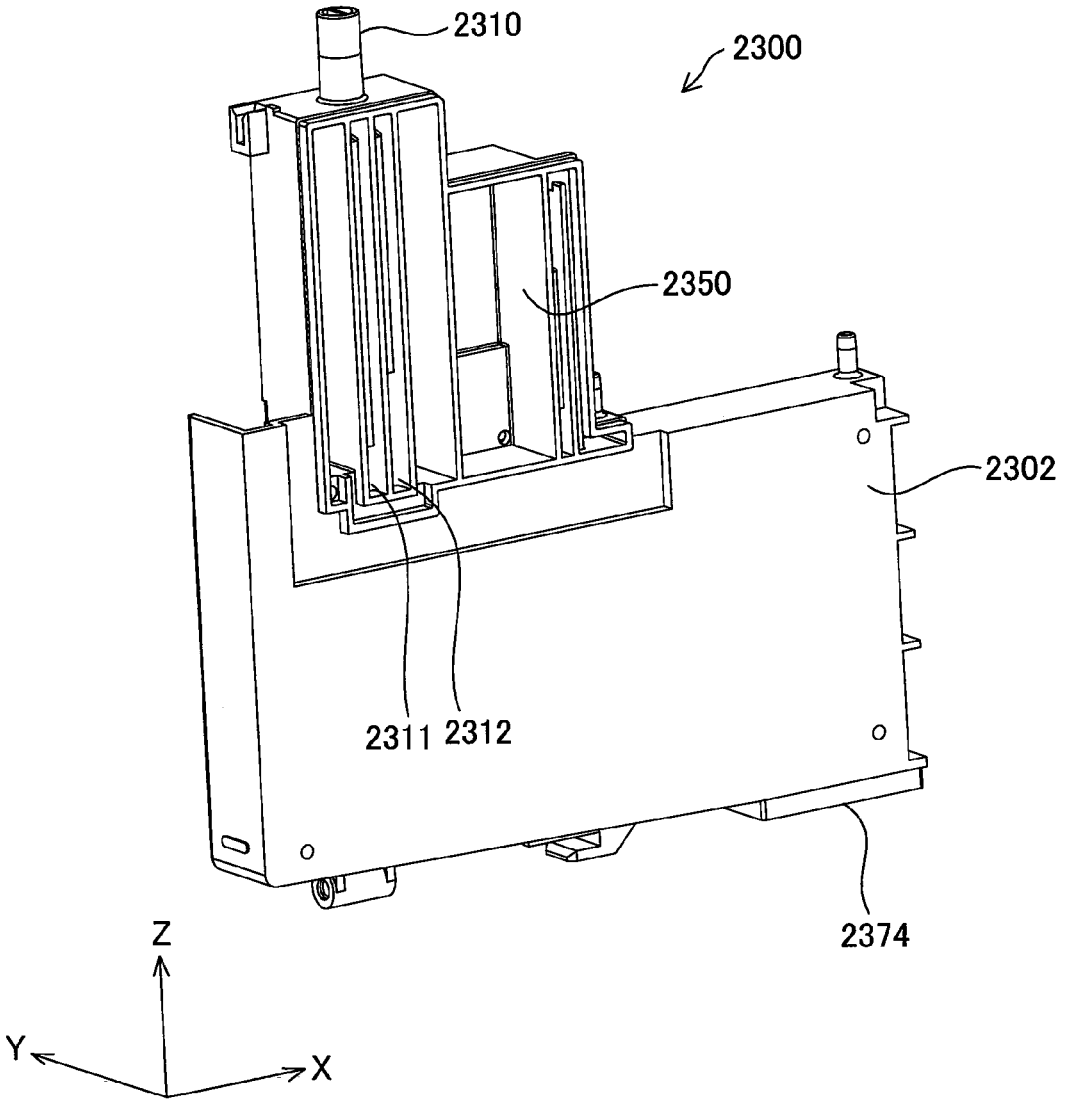
FIG. 29 is a perspective view illustrating the detailed configuration of a liquid tank.
Figure 30:
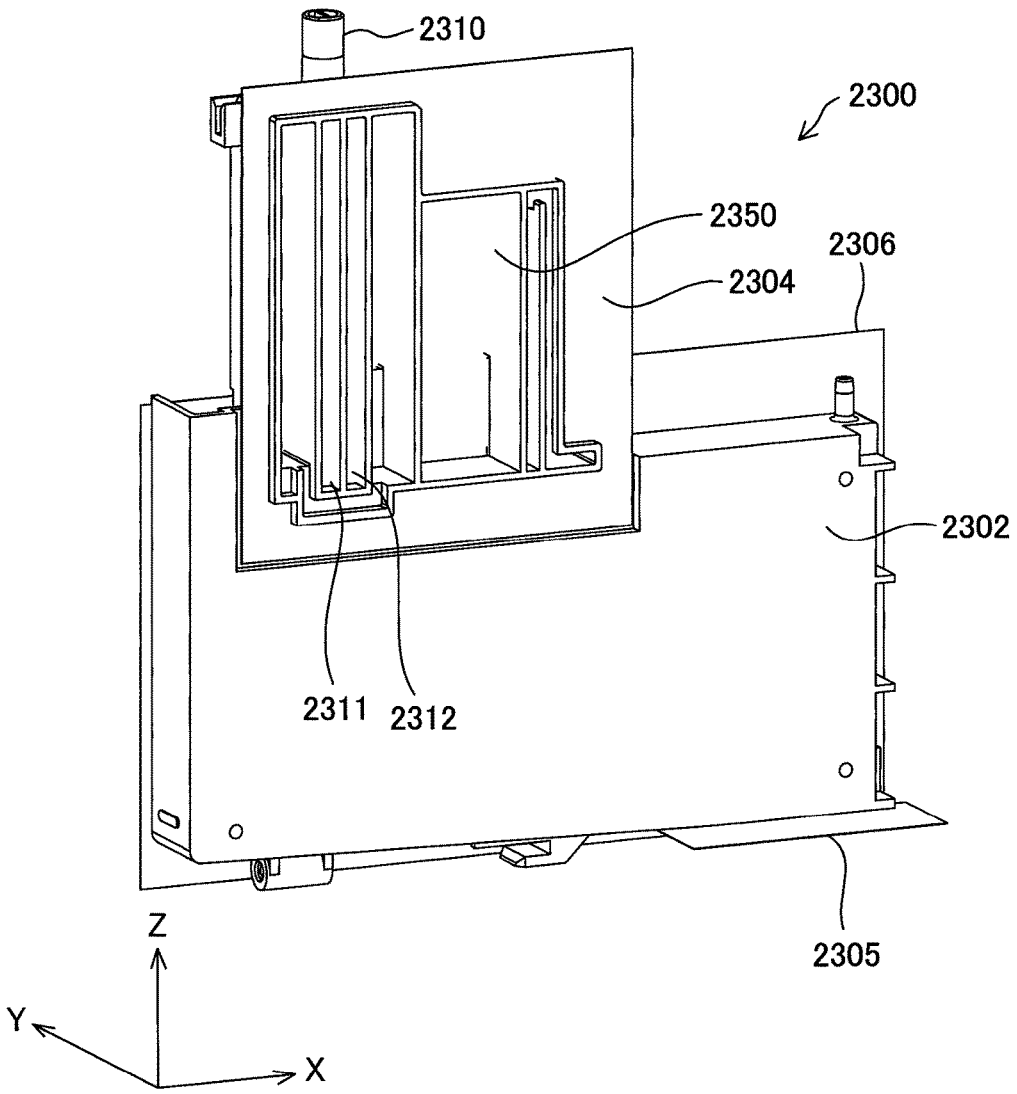
FIG. 30 is a perspective view illustrating the detailed configuration of the liquid tank.
Figure 31:
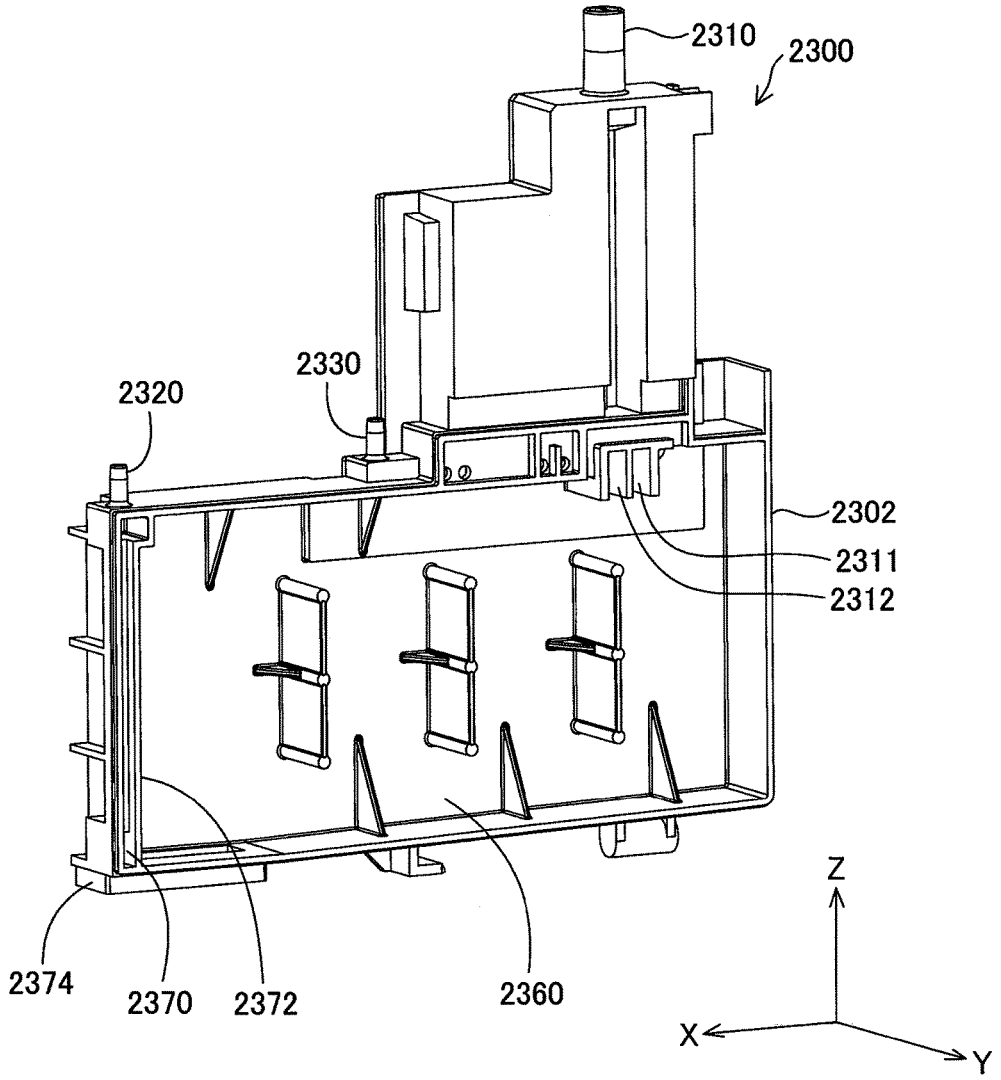
FIG. 31 is a perspective view illustrating the detailed configuration of the liquid tank.
Figure 32:
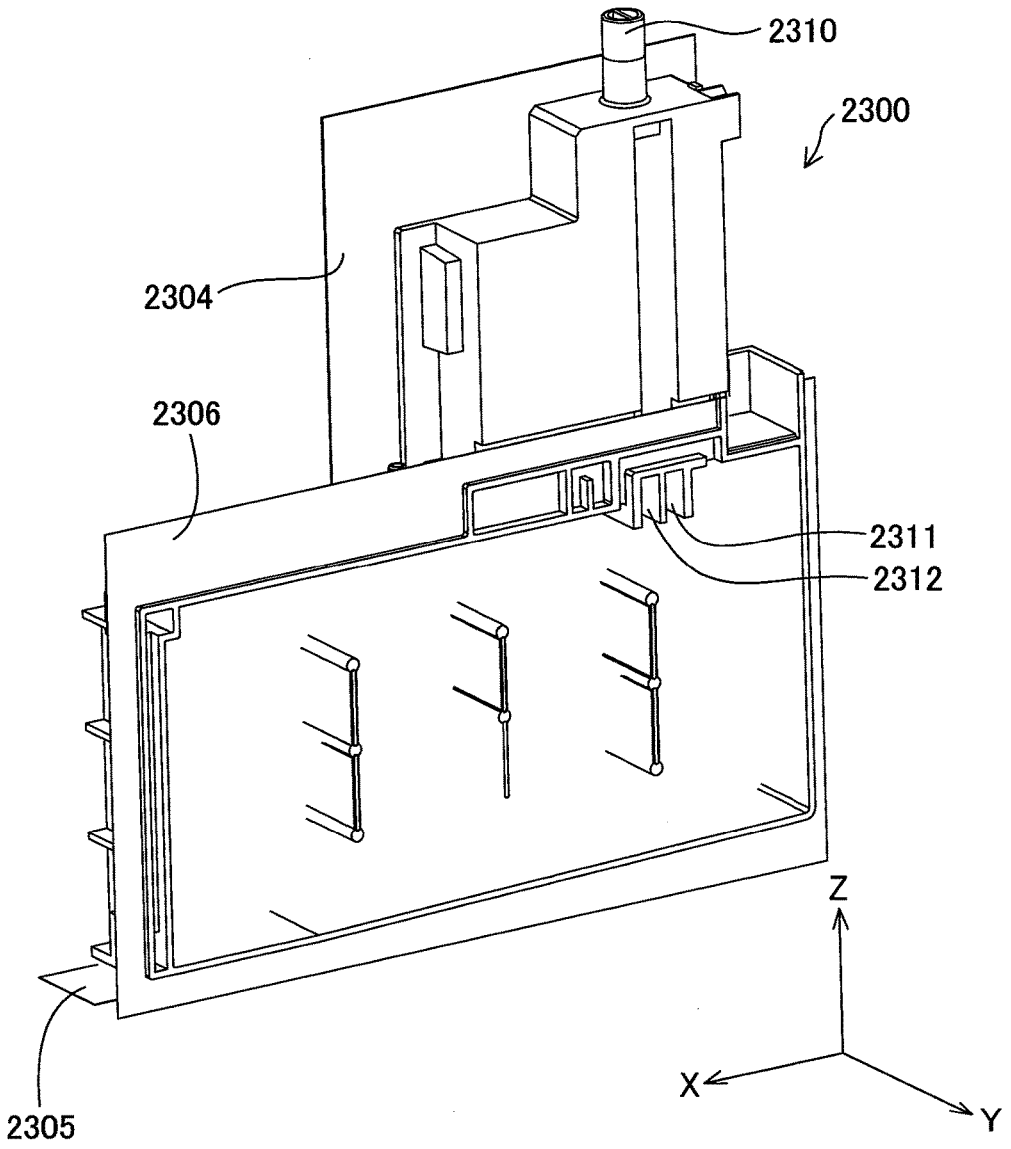
FIG. 32 is a perspective view illustrating the detailed configuration of the liquid tank.

FIGS. 29 to 32 are perspective views illustrating the detailed configuration of the liquid tank 2300. FIGS. 29 and 30 illustrate a first side face of a main body 2302 of the liquid tank 2300. FIG. 29 illustrates the state that liquid-impermeable films 2304 to 2306 are detached from the main body 2302. FIG. 30 illustrates the state that the films 2304 to 2306 are attached to the main body 2302. FIGS. 31 and 32 illustrate a second side face of the main body 2302 of the liquid tank 2300. FIG. 31 illustrates the state that the films 2304 to 2306 are detached from the main body 2302. FIG. 32 illustrate the state that the films 2304 to 2306 are attached to the main body 2302. In this embodiment, the films 2304 to 2306 are transparent.

Two liquid introduction paths 2311 and 2312 are formed inside of the liquid injection portion 2310 to be parted from each other. Lower ends of the liquid introduction paths 2311 and 2312 (i.e., a lower end of the liquid injection portion 2310) are open to a liquid containing chamber 2360 provided in a lower part of the liquid tank 2300 (shown in FIG. 31). When the liquid is to be filled in the liquid containing chamber 2360, a connection port of a liquid bottle for refilling is connected to an opening of the liquid injection portion 2310 and the liquid is injected from the liquid bottle. In this process, one of the two liquid introduction paths 231 and 2312 serves as an air discharge path from the liquid tank 2300 to the liquid bottle, while the other serves as a liquid injection path. As a result, the liquid is filled into the liquid containing chamber 2360 by gas-liquid exchange. When the liquid level in the liquid containing chamber 2360 rises to the lower end of the liquid injection portion 2310, this does not allow for any further gas-liquid exchange and thereby completes refilling. Accordingly the maximum liquid level in the liquid containing chamber 2360 is equal to the height at the lower end of the liquid injection portion 2310. While liquid refilling is not performed, the upper opening of the liquid injection portion 2310 is sealed with a cap.

An upper air chamber 2350 is provided beside the liquid injection portion 2310. This upper air chamber 2350 is configured to communicate with an upper part of the liquid containing chamber 2360. In the state of FIG. 29, the liquid introduction paths 2311 and 2312 of the liquid injection portion 2310 and the upper air chamber 2350 are open to the outside. In the state of FIG. 30, these openings are sealed by the film 2304. Similarly, in the state of FIG. 31, the liquid containing chamber 2360 is open to the outside. In the state of FIG. 32, the opening is sealed by the film 2306.

The connection port 2330 is provided in the upper wall of the liquid containing chamber 2360 to be connected with the buffer tank 2400. The connection port 2320 is provided at one end on the upper wall of the main body 2302 to be connected with the liquid ejection portion mounted on the carriage 2200. A liquid supply path 2370 is formed below this connection port 2320 to be partitioned from the liquid containing chamber 2360 by a partition wall 2372. This liquid supply path 2370 is configured to communicate with the liquid containing chamber 2360 via a communication path 2374 that is provided below the bottom wall of the main body 2302 to be open. In the state of FIGS. 30 and 32, the lower opening of the communication path 2374 is sealed with the film 2305.

Figure 33:
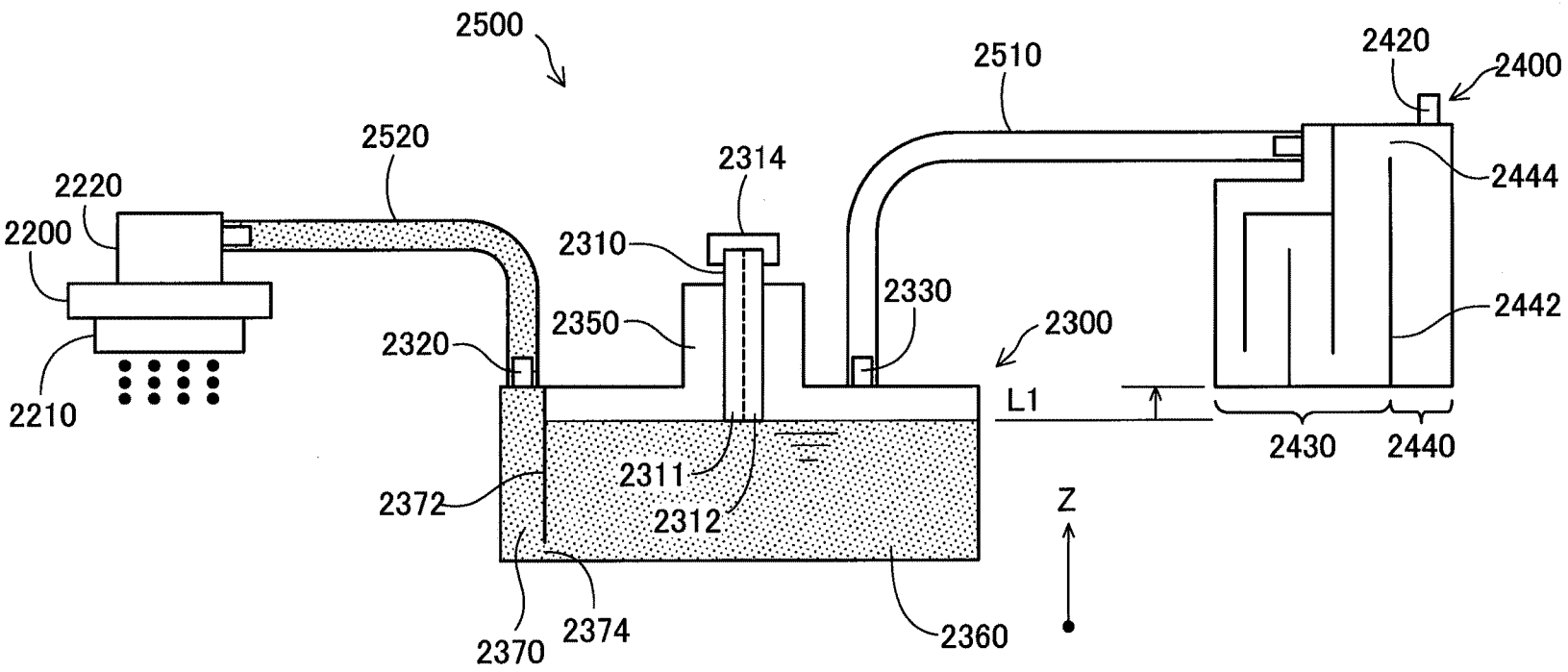
FIG. 33 is a diagram illustrating connection of the liquid supply device with a carriage.

FIG. 33 is a diagram illustrating connection of the liquid supply device 2500 with the carriage 2200. FIG. 33 illustrates only the Z direction (vertical direction) by an arrow with omission of the X direction and the Y direction. The configurations of the liquid tank 2300 and the buffer tank 2400 are simplified in the illustration.

The carriage 2200 is provided with a liquid ejection portion 2210 and a sub-tank 2220. The sub-tank 2220 is connected with the liquid tank 2300 via a connection flow path member 2520. The sub-tank 2220 is also connected with the liquid ejection portion 2210 via a flow path (not shown). The liquid ejection portion 2210 is provided as a print head to be movable with the carriage 2200. The liquid ejection portion 2210 is configured to perform printing by ejecting the liquid toward a printing medium while the carriage 2200 is moving. A fixed amount of the liquid supplied from the liquid tank 2300 is stored in the sub-tank 2220 and is supplied from the sub-tank 2220 to the liquid ejection portion 2210. The sub-tank 2220 may be omitted as appropriate.

A maximum liquid level L1 (also called "first liquid level L1") is set in the liquid containing chamber 2360 of the liquid tank 2300. As described above, this maximum liquid level L1 denotes the liquid level that does not allow for any further gas-liquid exchange during liquid refilling and is equal to the height at the lower end of the liquid injection portion 2310. The space above the maximum liquid level L1 serves as the upper air chamber 2350. According to another embodiment, the internal configuration of the liquid tank 2300 may be changed, and the maximum liquid level L1 may be set by another method different from the method of the above embodiment. For example, the liquid tank 2300 may be formed from a transparent or translucent member to make the liquid level visible from outside, and the maximum liquid level L1 may be indicated on an outer face or on an inner face of the liquid tank 2300. In any case, the maximum liquid level L1 serves as the guide indicating the upper limit of the liquid capacity of the liquid tank 2300. The opening of the liquid injection portion 2310 is closed by a cap 2314.

The connection portion 2330 configured to connect the liquid tank 2300 with the buffer tank 2400 is provided above the maximum liquid level L1 (i.e., in the wall of the upper air chamber 2350). This configuration advantageously makes it less likely that the liquid in the liquid containing chamber 2360 flows out to the buffer tank 2400.

The buffer tanks 2400 are connected with the liquid tanks 2300 via the connection flow path member 2510. A buffer chamber 2430 and an air chamber 2440 are provided inside of the buffer tank 2400. The air chamber 2440 is provided with an air outlet port 2420. The air outlet port 2420 is preferably provided in an upper wall of the air chamber 2440. The buffer chamber 2430 is configured to store the liquid that flows out from the liquid tank 2300 and flows through the connection flow path member 2510 into the buffer tank 2400. The buffer chamber 2430 includes a part of labyrinth structure and is partitioned from the air chamber 2440 by a partition wall 2442. An opening 2444 is provided above the partition wall 2442. The buffer chamber 2430 communicates with the air chamber 2440 via this opening 2444. This configuration suppresses the liquid from flowing out to the air chamber 2440 unless the liquid is filled up to the upper part of the buffer chamber 2430 and thereby advantageously makes it less likely that the liquid flows out from the air outlet port 2420. As the liquid in the liquid tank 2300 is consumed in the ordinary state, the air is filled into the liquid tank 2300 from the buffer tank 2400. In other words, the buffer tank 2400 serves as part of the air communication path that causes the air containing chamber 2360 to communicate with the atmosphere.

The volume of the buffer chamber 2430 is determined by taking into account the amount of the liquid that may be flowed out from the liquid containing chamber 2360 in response to a change in environment (for example, a change in atmospheric pressure, temperature or attitude). For example, the volume of the buffer chamber 2430 may be set in a range of 25% to 80% of the volume of the liquid containing chamber 2360.

The buffer tank 2400 is configured such that the bottom face of the buffer chamber 2430 is located at a position higher than the maximum liquid level L1 in the liquid tank 2300. This configuration advantageously makes it less likely that the liquid flows out from the liquid containing chamber 2360 to the buffer chamber 2430. This configuration also makes it likely that the liquid flowing out from the liquid containing chamber 2360 to the buffer chamber 2430 is returned to the liquid containing chamber 2360 and thereby reduces the amount of the unused liquid.

According to this embodiment, the connection flow path member 2510 configured to connect the liquid tanks 2300 with the buffer tanks 2400 is wholly held above the maximum liquid level L1 in the liquid tank 2300. This configuration advantageously makes it less likely that the liquid flows out from the liquid containing chamber 2360 to the buffer chamber 2430 and also makes it likely that the liquid is returned from the buffer chamber 2430 to the liquid containing chamber 2360. Additionally, this configuration advantageously enables the connection flow path member 2510 to be readily attached in manufacture of the liquid supply device 2500. The connection port 2330 configured to connect the liquid tank 2300 with the buffer tank 2400 is provided in the upper air chamber 2350. This configuration advantageously makes it less likely that the liquid flows out from the liquid tank 2300 even when the temperature rises and the internal pressure of the liquid tank 2300 is increased.

Figure 34:
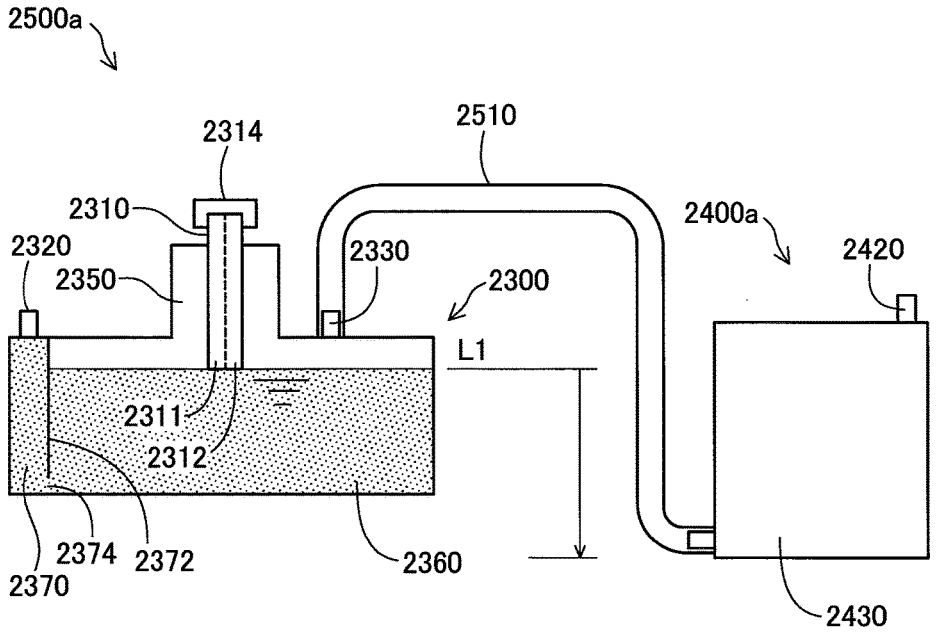
FIG. 34 is a diagram illustrating a modification of the liquid supply device.

FIG. 34 is a diagram illustrating a modification of the liquid supply device 2500. The carriage 2200 and its connection flow path member 2520 shown in FIG. 33 are omitted from the illustration of FIG. 34. A liquid supply device 2500*a* shown in FIG. 34 differs from the liquid supply device 2500 shown in FIG. 33 by the following configuration but is otherwise similar to the liquid supply device 2500:

(1) A buffer tank 2400*a* is configured such that a bottom face of a buffer chamber 2430 is located at a position lower than the maximum liquid level L1 in the liquid tank 2300;

(2) Inside of the buffer tank 2400*a* is not divided into the buffer chamber 2430 and the air chamber 2440 (shown in FIG. 33), and the buffer chamber 2430 also serves as the air chamber; and (3) A connection flow path member 2510 is arranged to pass through a position higher than the maximum liquid level L1 in the liquid tank 2300 and connect the liquid tanks 2300 with the buffer tanks 2400*a*.

In this liquid supply device 2500*a*, the connection flow path member 2510 is arranged to pass through the position higher than the maximum liquid level L1 (first liquid level) and connect the liquid tanks 2300 with the buffer tanks 2400*a*. This configuration advantageously makes it less likely that the liquid flows out from the liquid containing chamber 2360 to the buffer chamber 2430. A connection port 2330 configured to connect the liquid tank 2300 with the buffer tank 2400*a* is provided at a position above the maximum liquid level L1 (first liquid level). This configuration advantageously makes it less likely that the liquid flows out from the liquid tank 2300 even when the temperature rises and the internal pressure of the liquid tank 2300 is increased.

Figure 35:
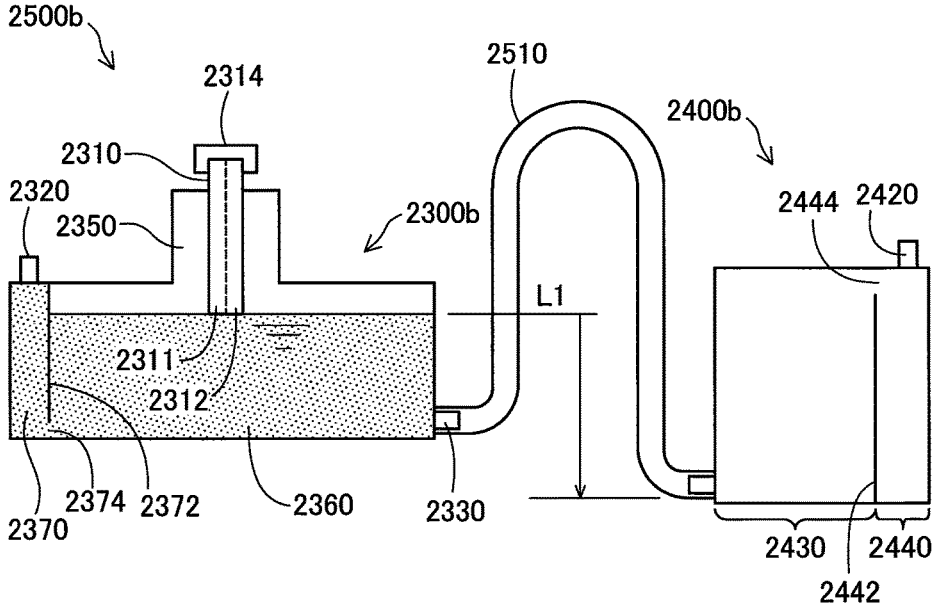
FIG. 35 is a diagram illustrating another modification of the liquid supply device.

FIG. 35 is a diagram illustrating another modification of the liquid supply device 2500. A liquid supply device 2500*b* shown in FIG. 35 differs from the liquid supply device 2500*a* shown in FIG. 34 by the following configuration but is otherwise similar to the liquid supply device 2500*a:*

(1) A connection port 2330 configured to connect a liquid tank 2300*b* with a buffer tank 2400*b* is provided at a position lower than the maximum liquid level L1 (first liquid level); and (2) Inside of the buffer tank 2400*b* includes a buffer chamber 2430 and an air chamber 2440 that are partitioned by a partition wall 2442 to communicate with each other via an opening 2444 provided above the partition wall 2442.

The configuration of the liquid supply device 2500*b* of FIG. 35 that a connection flow path member 2510 is arranged to pass through a position higher than the maximum liquid level L1 in the liquid tank 2300*b* and connect the liquid tanks 2300*b* with the buffer tanks 2400*b* is similar to the configuration in the modification shown in FIG. 34. This configuration thus advantageously makes it likely that the liquid flows out from a liquid containing chamber 2360 to the buffer chamber 2430.

Figure 36:
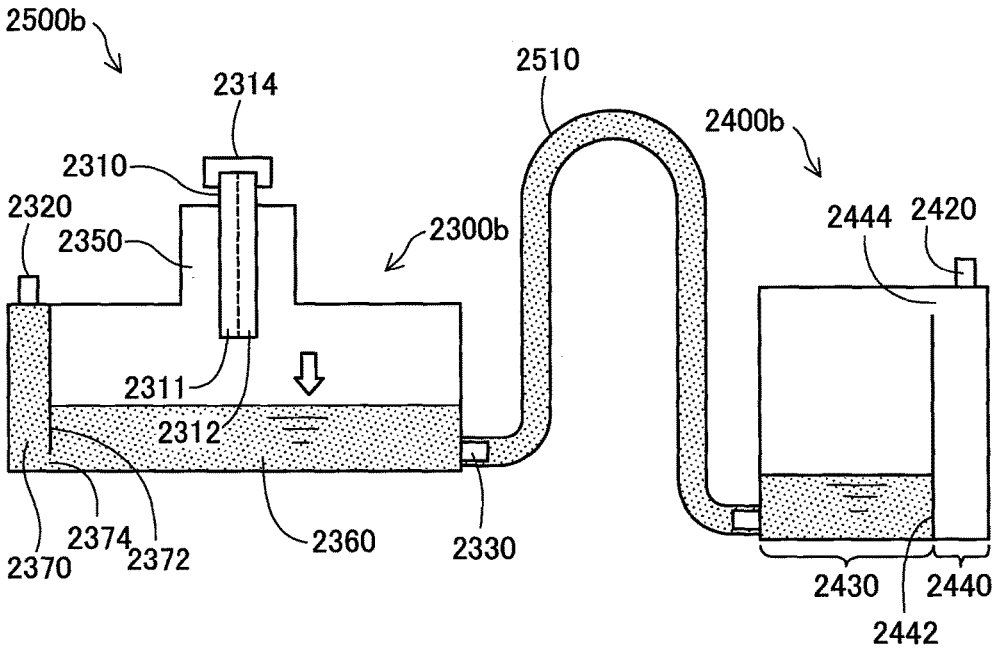
FIG. 36 is a diagram illustrating the another modification of the liquid supply device.

FIG. 36 illustrates the state that the liquid flows out from the liquid tank 2300*b* to the buffer chamber 2430 in response to an increase in the internal pressure of the liquid tank 2300*b* from the state of FIG. 35. Flowing out the liquid from the liquid tank 2300*b* decreases the internal pressure of the liquid tank 2300*b*. The liquid outflow is stopped when the internal pressure of the liquid tank 2300*b* becomes a negative pressure. In this buffer tank 2400*b*, the air chamber 2440 is partitioned from the buffer chamber 2430 by the partition wall 2442. This configuration reduces the possibility that the liquid flows out from an air outlet port 2420. The opening 2444 configured to communicate the buffer chamber 2430 with the air chamber 2440 is provided above the partition wall 2442. This configuration suppresses the liquid from flowing out to the air chamber 2440 unless the liquid is filled up to the upper part of the buffer chamber 2430 and thereby advantageously makes it less likely that the liquid flows out from the air outlet port 2420.

The modifications of FIGS. 34 to 36 may employ the buffer tank 2400 shown in FIG. 33. In the description below, when there is no need to distinguish the buffer tanks 2400, 2400*a* and 2400*b* from one another, these buffer tanks are simply called "buffer tank 2400".

Figure 37:
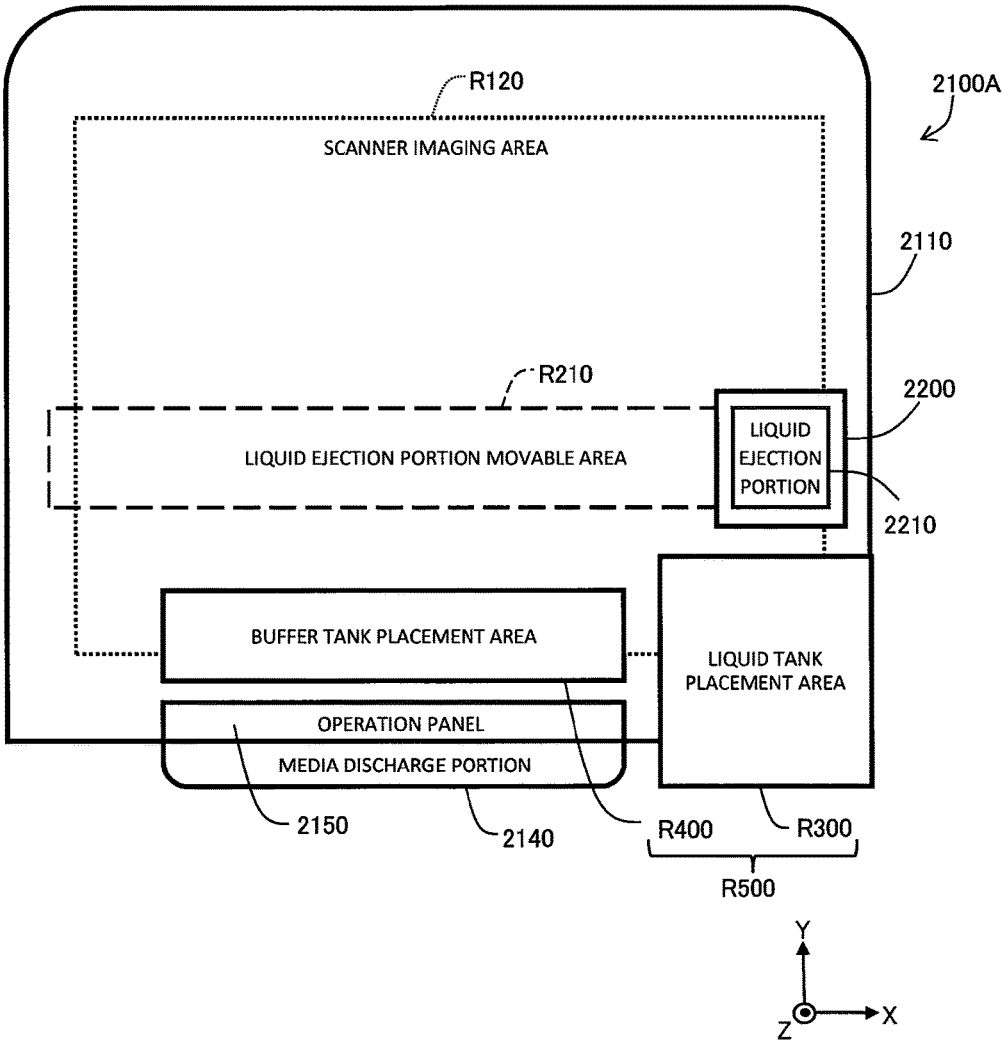
FIG. 37 is a diagram illustrating the planar arrangement of the respective components of the printer according to the fourth embodiment.

FIG. 37 is a diagram illustrating the planar arrangement of the respective components of the printer 2100A according to the fourth embodiment. As described above, the media discharge portion 2140 and the operation panel 2150 are provided on the front face of the printer main body 2110. The liquid tanks 2300 are placed beside of the media discharge portion 2140 and the operation panel 2150. The buffer tanks 2400 are placed behind (on the +Y direction side of) the operation panel 2150. In FIG. 37, an area where the liquid tanks 2300 are placed is shown as "liquid tank placement area R300", and an area where the buffer tanks 2400 are placed is shown as "buffer tank placement area R400". The liquid supply device 2500 (shown in FIG. 26) includes the liquid tanks 2300 and the buffer tanks 2400. Accordingly the liquid tank placement area R300 and the buffer tank placement area R400 respectively form parts of a placement area R500 of the liquid supply device 2500.

The carriage 2200 equipped with the liquid ejection portion 2210 is placed behind the liquid tank placement area R300. The carriage 2200 is moved back and forth along the X direction. Accordingly a liquid ejection portion movable area R210 in which the liquid ejection portion 2210 is moved is provided as a long area along the X direction. This liquid ejection portion movable area R210 is behind the liquid tank placement area R300 and the buffer tank placement area R400.

The scanner unit 2120 (shown in FIG. 24) is configured to scan an image in a scanner imaging area R120 shown in FIG. 37 and form a scanned image. In this illustrated example, the scanner imaging area R120 is an area including part of the liquid ejection portion movable area R210, part of the liquid tank placement area R300 and part of the buffer tank placement area R400.

The respective areas shown in FIG. 37 are areas in the downward view of the projection of the printer 2100A. In the illustrated downward view of the projection of the configuration of the printer 2100A other than the liquid supply device 2500, at least part of the liquid supply device 2500 (i.e., at least part of its placement area R500) is included inside of the outer circumference of the printer 2100A. The configuration that the entire liquid supply device 2500 is not provided outside of the printer 2100A but part or the entirety of the liquid supply device 2500 is provided inside of the outer circumference of the printer 2100A advantageously suppresses excessive expansion of the placement area of the printer 2100A.

In the arrangement of FIG. 37, the liquid tanks 2300 are placed on the same side as the media discharge portion 2140 relative to the liquid ejection portion movable area R210, and the buffer tanks 2400 are placed between the operation panel 2150 and the liquid ejection portion movable area R210. This configuration suppresses size expansion of the printer 2100A in the discharge direction of printing media (in the −Y direction). Vacant spaces are likely to be present in the periphery of the liquid ejection portion movable area R210. The above configuration thus enables the liquid tanks 2300 and the buffer tanks 2400 to be placed by using such vacant spaces. Additionally, in this printer 2100A, the liquid tanks 2300 are placed on the same side as the media discharge portion 2140 relative to the liquid ejection portion movable area R210. This configuration reduces the distance between the liquid tanks 2300 and the liquid ejection portion 2210 and thereby advantageously makes it easier to supply the liquid to the liquid ejection portion 2210.

The configuration that the liquid tanks 2300 are entirely placed on the same side as the media discharge portion 2140 relative to the liquid ejection portion movable area R210 may be replaced by a configuration that only part of the liquid tanks 2300 is placed on the same side as the media discharge portion 2140 relative to the liquid ejection portion movable area R210. The configuration that the buffer tanks 2400 are entirely placed between the operation panel 2150 and the liquid ejection portion movable area R210 may be replaced by a configuration that only part of the buffer tanks 2400 is placed between the operation panel 2150 and the liquid ejection portion movable area R210. These modified configurations have similar advantages to those described above.

Additionally, in the arrangement of FIG. 37, the buffer tanks 2400 are placed in a location overlapping with the scanner imaging area R120. This configuration suppresses expansion of the placement area of the printer 2100A. The configuration that the buffer tanks 2400 are entirely placed in the location overlapping with the scanner imaging area R120 may be replaced by a configuration that only part of the buffer tanks 2400 is placed in the location overlapping with the scanner imaging area R120. This modified configuration similarly suppresses expansion of the placement area of the printer 2100A.

As described above, according to the fourth embodiment, the buffer tanks 2400 are connected with the liquid tanks 2300. This configuration advantageously reduces the possibility of leakage of the liquid to the outside. As described above with reference to FIG. 33, the configuration that the bottom face of the buffer chamber 2430 of the buffer tank 2400 is located at the position higher than the maximum liquid level L1 in the liquid tank 2300 advantageously makes it less likely that the liquid flows out from the liquid containing chamber 2360 to the buffer chamber 2430. This configuration also makes it likely that the liquid flowing out from the liquid containing chamber 2360 to the buffer chamber 2430 is returned to the liquid containing chamber 2360 and thereby reduces the amount of the unused liquid. Additionally, the liquid tank 2300 and the buffer tank 2400 are provided as different bodies. This configuration advantageously enables each of the volume of the liquid containing chamber 2360 and the volume of the buffer chamber 2430 to be readily increased and decreased.

According to the fourth embodiment, the plurality of liquid tanks 2300 are arrayed in the X direction (first direction), and the plurality of buffer tanks 2400 are arrayed in the direction parallel to the X direction (first direction). This configuration suppresses excessive size expansion of the liquid supply device 2500 in a direction intersecting with the X direction (first direction).

The configuration of the liquid supply device 2500 that the bottom face of the buffer chamber 2430 of the buffer tank 2400 is located at the position higher than the maximum liquid level L1 in the liquid tank 2300 may be replaced by the configuration of the liquid supply device 2500*a* shown in FIG. 34 or by the configuration of the liquid supply device 2500*b* shown in FIGS. 35 and 36. More specifically, the buffer tank 2400 may be placed such that the bottom face of the buffer chamber 2430 of the buffer tank 2400 is located at a position lower than the first liquid level L1 that is set as the guide indicating the upper limit of the liquid capacity of the liquid tank 2300. In this modified configuration, it is preferable that the connection flow path member 2510 is arranged to pass through a position higher than the first liquid level L1 and connect the liquid tanks 2300 with the buffer tanks 2400. In these liquid supply devices 2500*a* and 2500*b*, the connection flow path member 2510 is arranged to pass through the position higher than the first liquid level L1 and connect the liquid tanks 2300 with the buffer tanks 2400. This configuration advantageously makes it less likely that the liquid flows out from the liquid containing chamber 2360 to the buffer chamber 2430.

G. Fifth Embodiment (Configuration that the Direction of Array of Liquid Tanks Intersects with the Direction of Array of Buffer Tanks)

Figure 38:
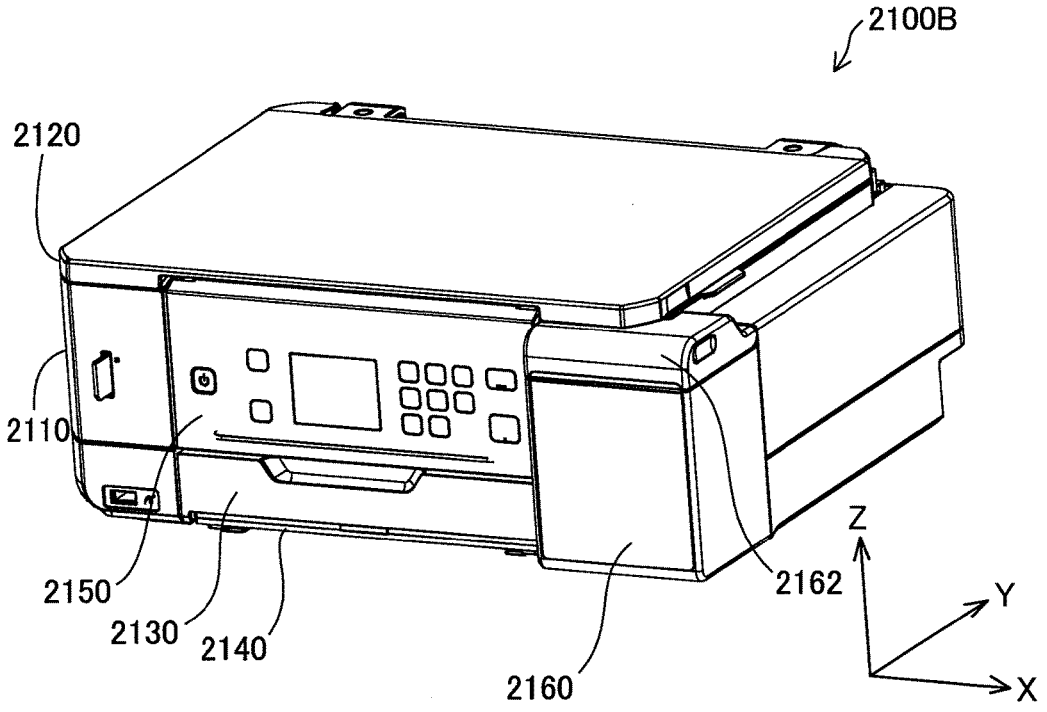
FIG. 38 is a perspective view illustrating a printer according to a fifth embodiment.
Figure 39:
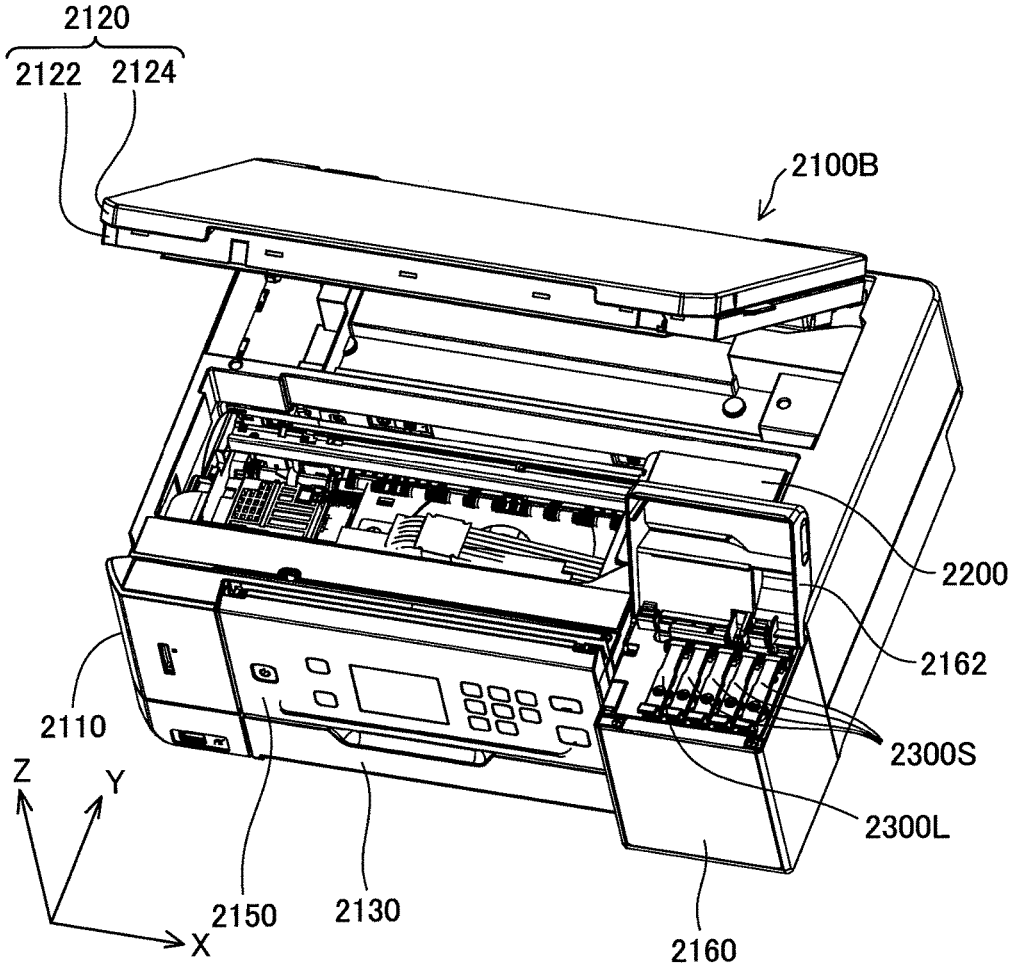
FIG. 39 is a perspective view illustrating the printer of the fifth embodiment.

FIG. 38 is a perspective view illustrating a printer 2100B as a liquid ejection apparatus according to a fifth embodiment. FIG. 39 is a perspective view illustrating the printer 2100B in the state that a scanner unit 2120 and a cover 2162 of a liquid container unit 2160 are opened. The respective components of the printer 2100B may have slightly different configurations to those of the corresponding components of the printer 2100A of the fourth embodiment. As a matter of convenience, however, in the description below, the corresponding components of the printer 2100B are expressed by the like reference signs.

Like the printer 2100A of the fourth embodiment, this printer 2100B includes a printer main body 2110 and a scanner unit 2120 provided on the printer main body 2110 to be openable and closable. The scanner unit 2120 includes a scanner base 2122 including a glass plate (not shown) and a scanner cover 2124. A scanning optical system of the scanner unit 2120 is provided inside of the printer main body 2110. A media discharge portion 2140, a media storage portion 2130 and an operation panel 2150 are provided on a front face of the printer main body 2110 to be arranged sequentially from the bottom. The media storage portion 2130 is configured to store printing media and supplies each of the printing media to a media conveyance mechanism (not shown). The media discharge portion 2140 is configured to discharge in the −Y direction each of the printing media printed by ejection of the liquid by a liquid ejection portion (described later). A liquid container unit 2160 is provided at a right end (+X direction end) on the front face of the printer 2110. The liquid container unit 2160 has a cover 2162 that is provided in an upper part thereof to be openable and closable.

A plurality of liquid tanks 2300 (2300S and 2300L) are placed in the liquid container unit 2160. A carriage 2200 equipped with a print head serving as a liquid ejection portion is also provided in the printer main body 2110.

Figure 40:
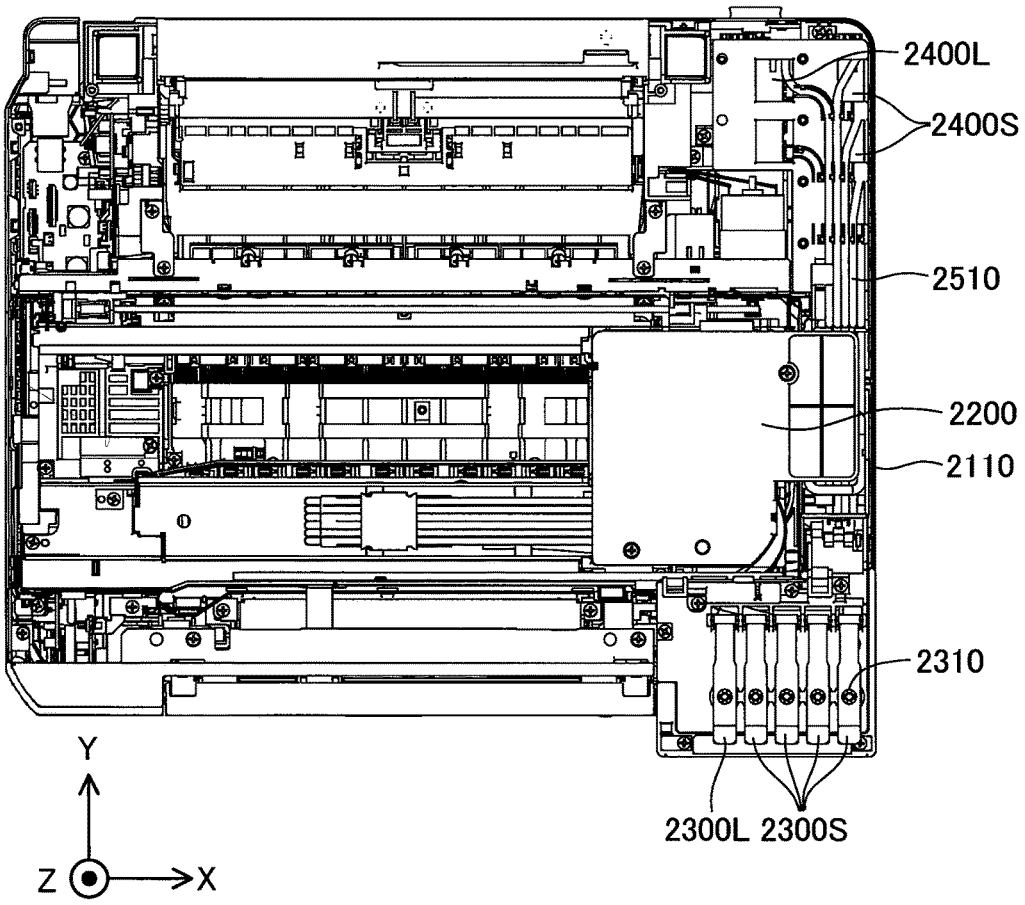
FIG. 40 is a plan view illustrating the internal configuration of the printer of the fifth embodiment.

FIG. 40 is a plan view illustrating the internal configuration of the printer 2100B. Part of components, for example, the scanner unit 2120 are omitted from the illustration. A liquid injection portion 2310 is provided on a top face of each liquid tank 2300 to inject the liquid into the liquid tank 2300.

A plurality of buffer tanks 2400 (2400S and 2400L) are provided behind the printer main body 2110. In this illustrated example, the buffer tanks 2400 are placed in a location behind the liquid tanks 2300. These buffer tanks 2400 are individually connected with the corresponding liquid tanks 2300 by means of a connection flow path member 2510. The plurality of liquid tanks 2300, the plurality of buffer tanks 2400 and the connection flow path member 2510 constitute a liquid supply device configured to supply the liquid to the liquid ejection portion (print head) of the printer 2100B.

According to the fifth embodiment, the buffer tanks 2400 are connected with the liquid tanks 2300. This configuration advantageously reduces the possibility of leakage of the liquid to the outside. Additionally, the liquid tank 2300 and the buffer tank 2400 are provided as different bodies. This configuration advantageously enables each of the volume of the liquid tank 2300 and the volume of the buffer tank 2400 to be readily increased and decreased.

According to the fifth embodiment, the plurality of liquid tanks 2300 are arrayed in the X direction (first direction). The plurality of buffer tanks 2400 are, on the other hand, arrayed in a direction intersecting with the X direction (in the Y direction). This arrangement suppresses the size of the liquid supply device 2500 from being excessively expanded in the X direction (first direction). In the description hereof, the term "intersection" of two directions is not limited to the angle of 90 degrees but means that an angle formed by two directions is not 0 degree. Accordingly, the Y direction is one of the directions intersecting with the X direction.

Figure 41:
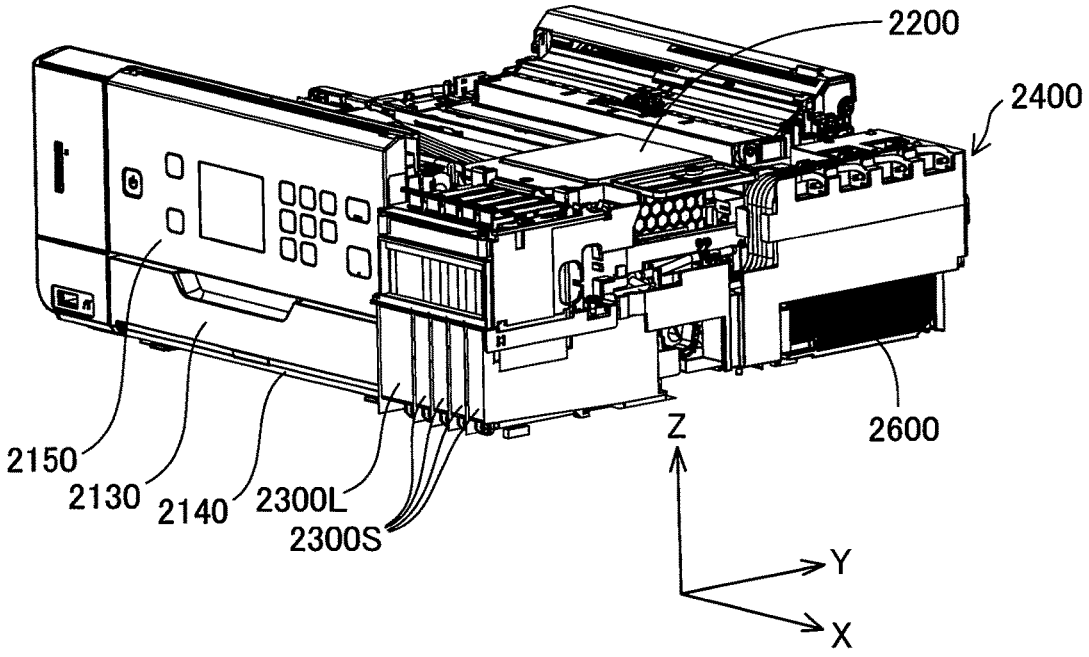
FIG. 41 is a perspective view illustrating the internal configuration of the printer of the fifth embodiment.

FIG. 41 is a perspective view illustrating the internal configuration of the printer 2100B. A waste tank 2600 is provided as a waste containing portion below the buffer tank 2400. The waste tank 2600 serves as the waste containing portion configured to store the waste (waste ink) that is supplied to the liquid ejection portion 2210 but is not used for printing. The waste may be transferred to the waste tank 2600 by, for example, a waste pump (not shown). The arrangement of the buffer tank 2400 and the waste tank 2600 will be described later. The waste tank 2600 may be replaced by another type of waste containing portion, such as a waste tray.

Figure 42:
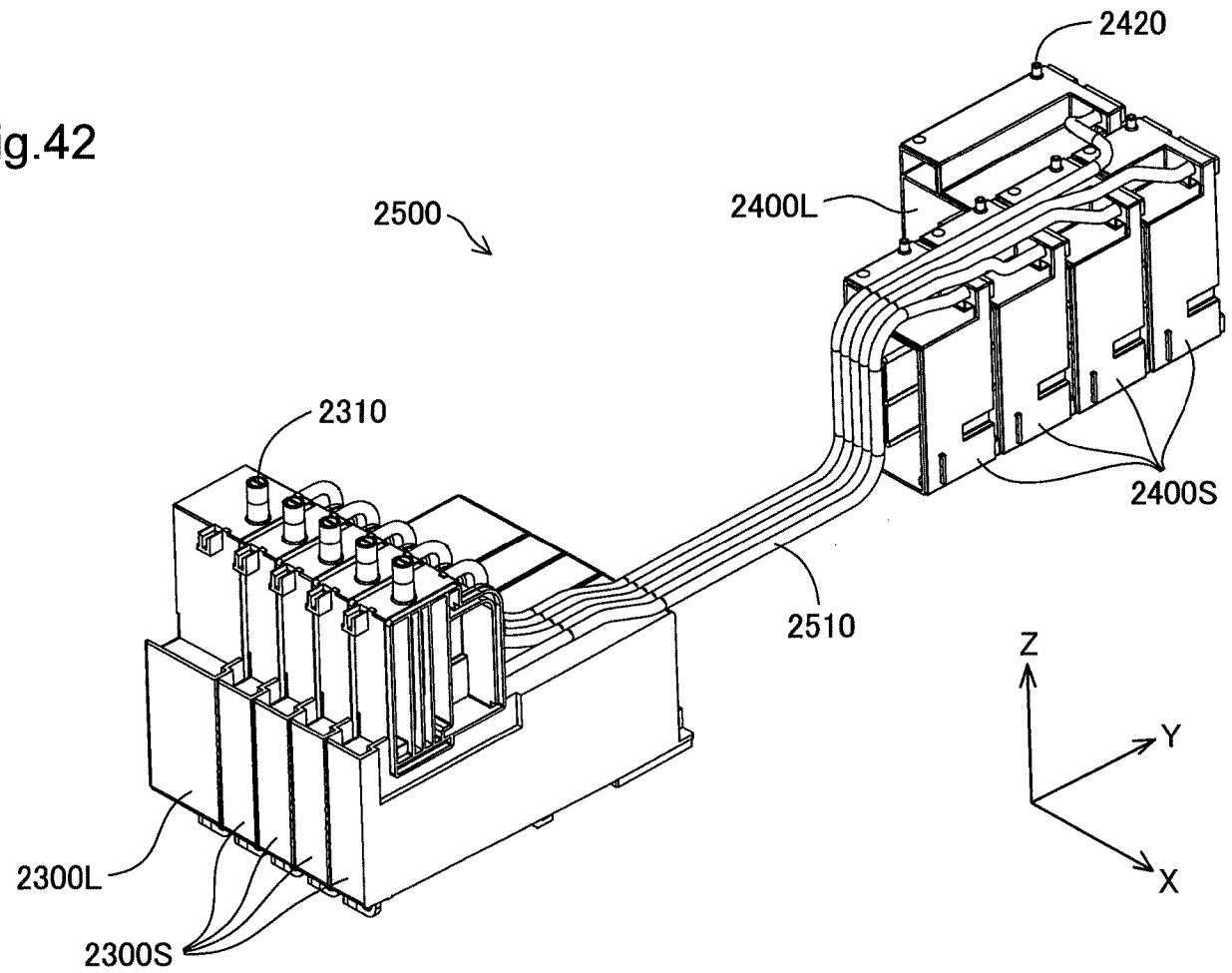
FIG. 42 is a perspective view illustrating a liquid supply device according to the fifth embodiment.
Figure 43:
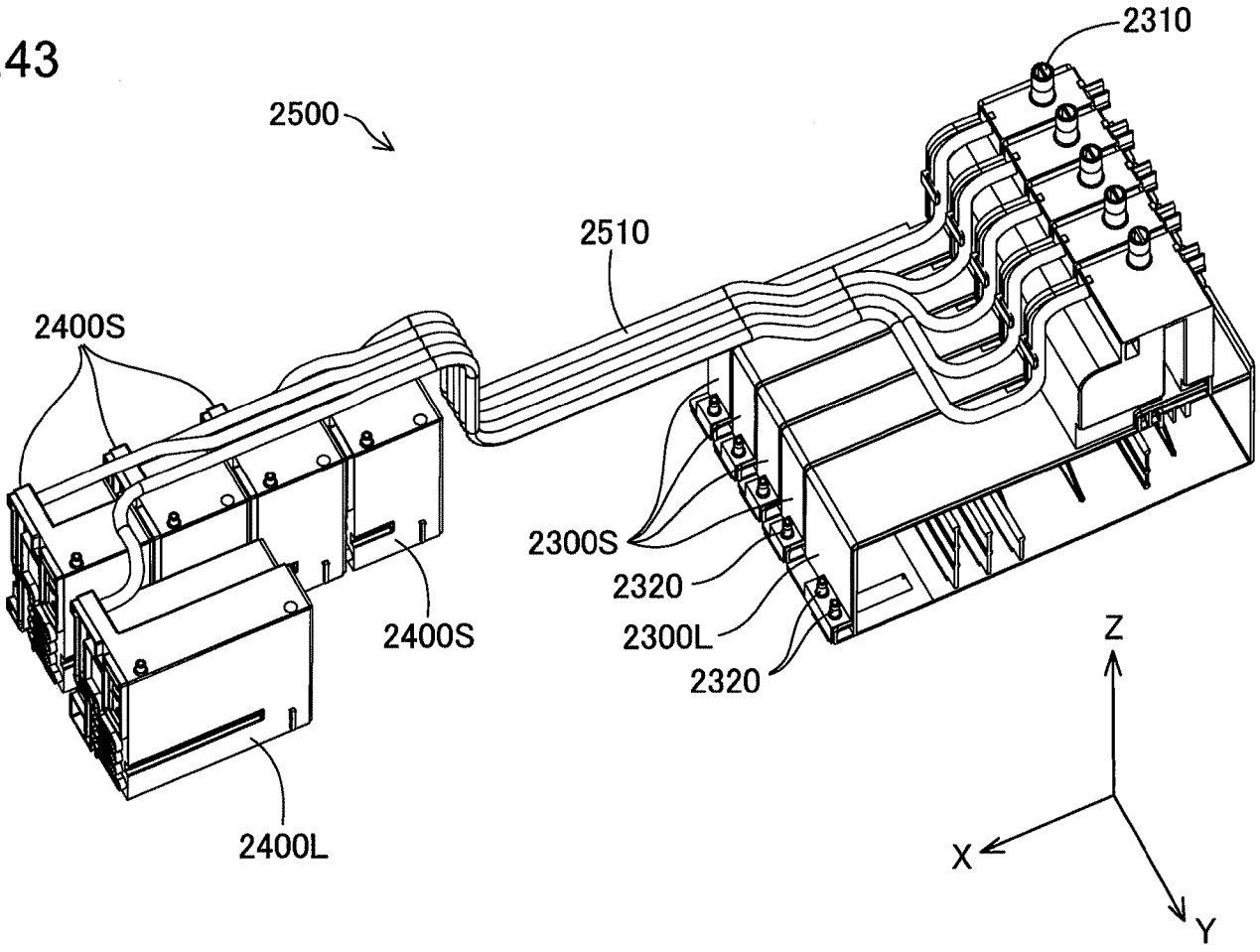
FIG. 43 is a perspective view illustrating the liquid supply device of the fifth embodiment.

FIGS. 42 and 43 are perspective views illustrating the liquid supply device 2500. As described above, the liquid supply device 2500 includes the liquid tanks 2300, the buffer tanks 2400 and the connection flow path member 2510. The general configuration of the liquid supply device 2500 is substantially similar to the configuration of the fourth embodiment shown in FIGS. 27 and 28, except that the buffer tanks 2400 are mostly arrayed along the Y direction. More specifically, a plurality of smaller-capacity buffer tanks 2400S are arrayed along the Y direction, but a larger-capacity buffer tank 2400L is arranged in a direction intersecting with the Y direction (i.e., in the −X direction) relative to the smaller-capacity buffer tanks 2400S. This arrangement aims to suppress excessive expansion of the entire placement area of the buffer tanks 2400 in the Y direction. As clearly understood from FIG. 40, excessive expansion of the entire placement area of the buffer tanks 2400 provides the possibility that that buffer tanks 2400 interfere with the carriage 2200. This general configuration that part of the buffer tanks 2400 is arranged along the X direction as described above is included in the configuration that the plurality of buffer tanks 2400 (more specifically, the buffer tanks 2400S) are arrayed in the direction (Y direction) intersecting with the direction of array of the liquid tanks 2300 (X direction). The plurality of buffer tanks 2400 may not be necessarily arrayed in the Y direction but may be arrayed in a direction that is inclined to both the Y direction and the X direction (this direction also corresponds to the direction intersecting with the X direction).

The configuration of the liquid tank 2300 of the fifth embodiment is slightly different from the configuration of the liquid tank 2300 of the fourth embodiment shown in FIGS. 29 to 32. The liquid tank 2300 of the fifth embodiment, however, has the similar primary configuration and functions and is thus not specifically described.

The configuration described above with reference to FIG. 33 may be employed as the height relationship between the liquid tank 2300 and the buffer tank 2400 according to the fifth embodiment. More specifically, like the fourth embodiment, the bottom face of the buffer chamber 2430 is located at a position higher than the maximum liquid level L1 in the liquid tank 2300. This configuration advantageously makes it less likely that the liquid flows out from the liquid containing chamber 2360 to the buffer chamber 2430. This configuration also makes it likely that the liquid flowing out from the liquid containing chamber 2360 to the buffer chamber 2430 is returned to the liquid containing chamber 2360 and thereby reduces the amount of the unused liquid.

In the fifth embodiment, the configurations shown in FIGS. 34 to 36 may be employed, instead of the configuration of FIG. 33, as the configuration of the liquid supply device 2500.

Figure 44:
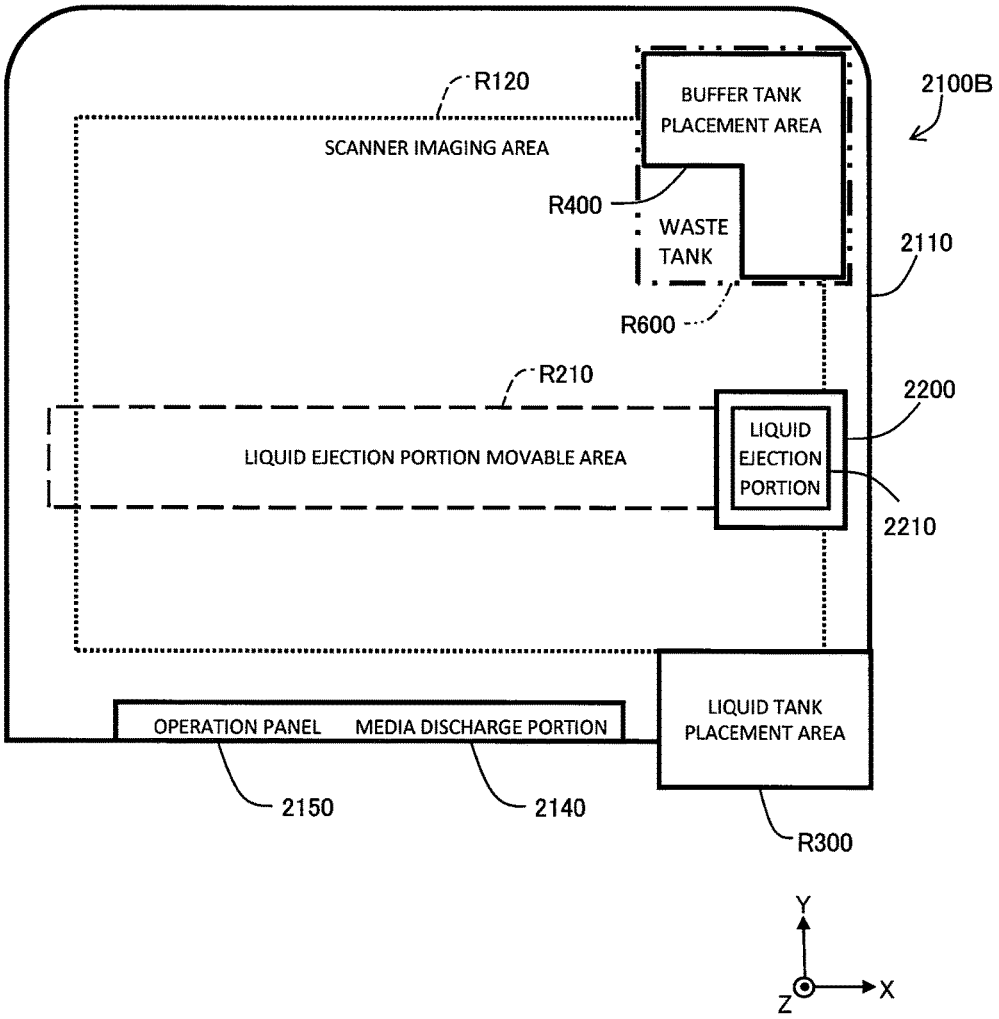
FIG. 44 is a diagram illustrating the planar arrangement of the respective components of the printer according to the fifth embodiment.

FIG. 44 is a diagram illustrating the planar arrangement of the respective components of the printer 2100B according to the fifth embodiment. As described above, the media discharge portion 2140 and the operation panel 2150 are provided on the front face of the printer main body 2110. For convenience of illustration, the media discharge portion 2140 and the operation panel 2150 are illustrated in the same location in FIG. 44. A liquid tank placement area R300 is provided beside the media discharge portion 2140 and the operation panel 2150. A buffer tank placement area R400 is provided in a rear part of the printer main body 2110 to be arranged behind the liquid tank placement area R300. According to the fifth embodiment, the buffer tank placement area R400 is present behind (on the +Y direction side of) a liquid ejection portion movable area R210. The waste tank 2600 is placed below the buffer tank placement area R400 to be arranged in an area overlapping with the buffer tank placement area R400. The placement area of the waste tank 2600 (shown by the two-dot chain line) is called "waste tank placement area R600".

Like the fourth embodiment, according to the fifth embodiment, in the downward view of the projection of the configuration of the printer 2100B other than the liquid supply device 2500, it is preferable that at least part of the liquid supply device 2500 is included inside of the outer circumference of the printer 2100B. This configuration advantageously suppresses excessive expansion of the placement area of the printer 2100B.

According to the fifth embodiment, the liquid tanks 2300 are placed on the same side as the media discharge portion 2140 relative to the liquid ejection portion movable area R210, and the buffer tanks 2400 are placed on the opposite side to the media discharge portion 2140 relative to the liquid ejection portion movable area R210. This configuration suppresses size expansion of the printer 2100B in the X direction (first direction) that is the moving direction of the liquid ejection portion 2210. Vacant spaces are likely to be present in the periphery of the liquid ejection portion movable area R210. The above configuration thus enables the liquid tanks 2300 and the buffer tanks 2400 to be placed by using such vacant spaces. Additionally, in this printer 2100B, the liquid tanks 2300 are placed on the same side as the media discharge portion 2140 relative to the liquid ejection portion movable area R210. This configuration reduces the distance between the liquid tanks 2300 and the liquid ejection portion 2210 and thereby advantageously makes it easier to supply the liquid to the liquid ejection portion 2210.

The configuration that the liquid tanks 2300 are entirely placed on the same side as the media discharge portion 2140 relative to the liquid ejection portion movable area R210 may be replaced by a configuration that only part of the liquid tanks 2300 is placed on the same side as the media discharge portion 2140 relative to the liquid ejection portion movable area R210. The configuration that the buffer tanks 2400 are entirely placed on the opposite side to the media discharge portion 2140 relative to the liquid ejection portion movable area R210 may be replaced by a configuration that only part of the buffer tanks 2400 is placed on the opposite side to the media discharge portion 2140 relative to the liquid ejection portion movable area R210.

Additionally, like the arrangement of FIG. 37 of the fourth embodiment, in the arrangement of FIG. 44, part of the buffer tanks 2400 is placed in a location overlapping with the scanner imaging area R120. This configuration suppresses expansion of the placement area of the printer 2100B. According to another embodiment, the buffer tanks 2400 may be entirely placed in the location overlapping with the scanner imaging area R120.

Figure 45:
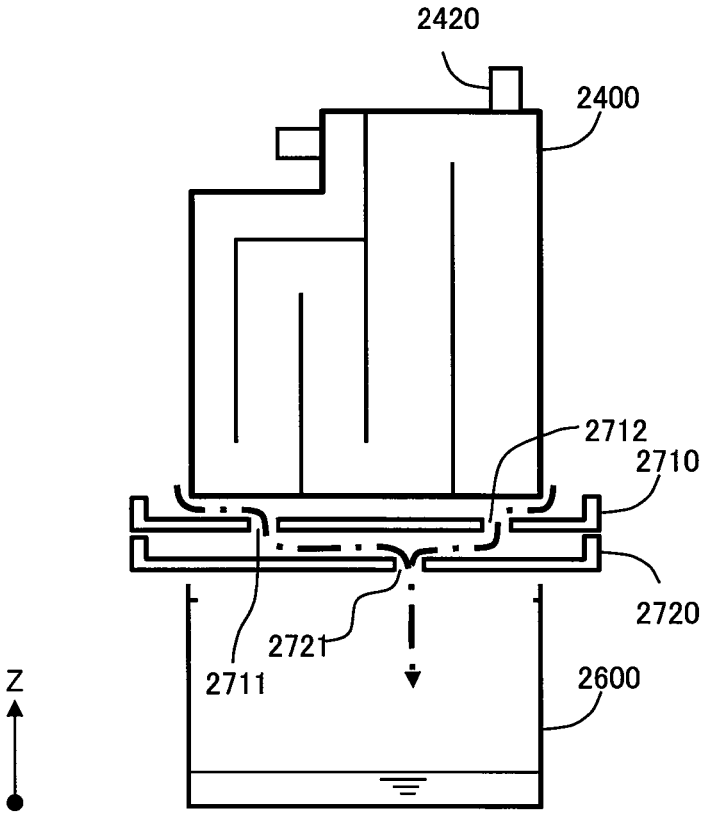
FIG. 45 is a diagram illustrating one example of arrangement of buffer tanks and a waste tank.

FIG. 45 is a diagram illustrating one example of the arrangement of the buffer tanks 2400 and the waste tank 2600. FIG. 45 illustrates only the Z direction (vertical direction) by an arrow with omission of the X direction and the Y direction. A waste absorber formed from a porous material such as sponge or nonwoven fabric or formed from a liquid-absorbing macromolecular polymer may be placed inside of the waste tank 2600. In the illustrated example of FIG. 45, a top face of the waste tank 2600 is not closed by a wall member but is open.

Partition walls 2710 and 2720 are provided between the buffer tanks 2400 and the waste tank 2600 to partition the buffer tanks 2400 and the waste tank 2600 from each other in the height direction. The planar sizes of the partition walls 2710 and 2720 are preferably set such as to cover below and over the entire placement area of the buffer tanks 2400. The waste tank 2600 is preferably placed in a location below at least part of the buffer tanks 2400.

Two openings 2711 and 2712 are provided in the upper partition wall 2710. One opening 2721 is provided in the lower partition wall 2720. These partition walls 2710 and 2720 are provided for leakage of an undesired liquid from an air outlet port 2420 of the buffer tank 2400 and are configured to introduce the leaked liquid to the waste tank 260. As shown by the one-dot chain line in FIG. 45, the liquid leaked out from the buffer tank 2400 passes through the opening 2711, 2712 and 2721 and is stored in the waste tank 2600. The partition walls 2710 and 2720 may be omitted, but it is preferable to provide one or more partition walls. When one or more partition walls 2710 and 2720 are provided, it is preferable that the opening 2721 is formed in the partition wall 2720 placed closer to the waste tank 2600 to be arranged at a position opposed to the waste tank 2600.

Even in the case of leakage of the liquid from the buffer tank 2400, the configuration that the waste tank 2600 is placed below the buffer tanks 2400 as shown in FIG. 45 makes it likely that the leaked liquid is stored in the waste tank 2600. This configuration thus advantageously reduces the possibility that the liquid flows out of the printer 2100B. More specifically in the configuration of FIG. 45, the partition walls 2710 and 2720 are provided to partition the buffer tank 2400 and the waste tank 2600 from each other in the height direction, and the opening 2721 is formed in the partition wall 2720 to be arranged at a position opposed to the waste tank 2600. Even in the case of leakage of the liquid from the buffer tank 2400, this configuration makes it likely that the leaked liquid is stored in the waste tank 2600 via the opening 2721 of the partition wall 2720. The partition walls 2710 and 2720 are placed between the buffer tanks 2400 and the waste tank 2600, except the locations corresponding to the openings 2711, 2712 and 2721 of the partition walls 2710 and 2720. This configuration advantageously reduces the possibility that the liquid flows out.

Figure 46:
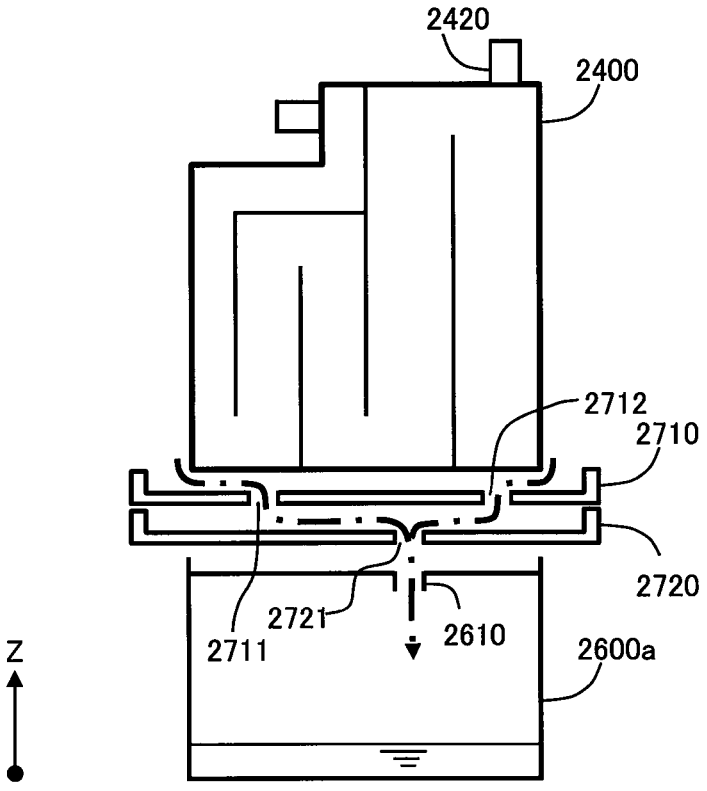
FIG. 46 is a diagram illustrating another example of arrangement of the buffer tanks and the waste tank.

FIG. 46 is a diagram illustrating another example of the arrangement of the buffer tanks 2400 and the waste tank 2600*a*. The configuration of FIG. 46 differs from the configuration of FIG. 45 by only that a top face of a waste tank 2600*a* is closed by a wall member and a relatively small opening 2610 is formed in the wall member, and is otherwise similar to the configuration of FIG. 45. The opening 2610 formed in the top wall of the waste stank 2600*a* is provided at a position opposed to the opening 2721 of the partition wall 2720 placed closer to the waste tank 2600*a*. This configuration has the similar advantageous effects to those of the configuration of FIG. 45.

Figure 47:
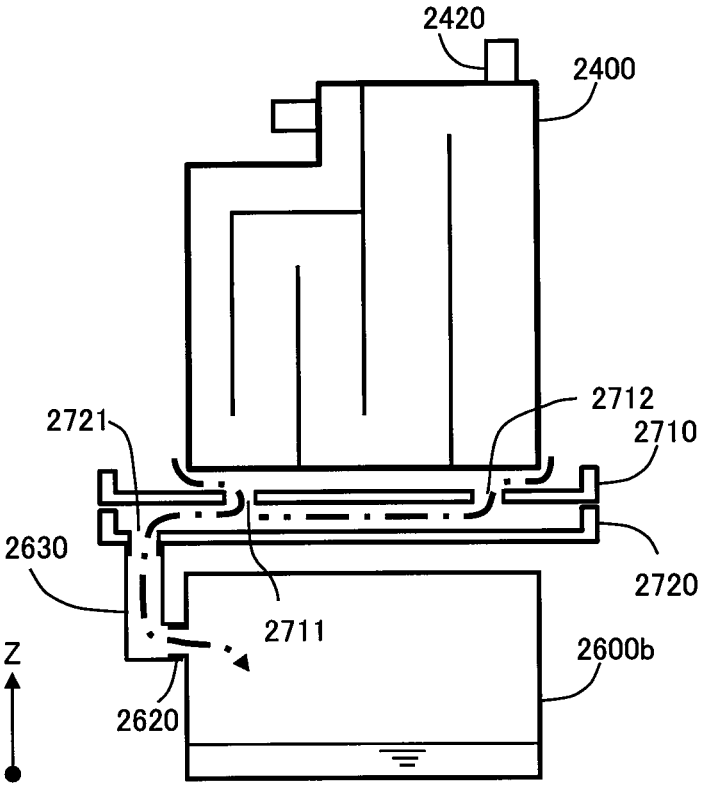
FIG. 47 is a diagram illustrating another example of arrangement of the buffer tanks and the waste tank.

FIG. 47 is a diagram illustrating another example of the arrangement of the buffer tanks 2400 and the waste tank 2600. The configuration of FIG. 47 differs from the configuration of FIG. 46 by that no opening is formed in a top face of a waste tank 2600*b* but a connection port 2620 is provided in a side face of the waste tank 2600*b* and that the connection port 2620 is connected with the opening 2721 of the partition wall 2720 by a liquid guide member 2630, and is otherwise similar to the configuration of FIG. 46. The liquid guide member 2630 may be a flow path member having any of various configurations, for example, a tube or a flow path configured by sealing a groove formed in a base member with a film. This configuration has the similar advantageous effects to those of the configuration of FIG. 45 and the configuration of FIG. 46.

FIGS. 45 to 47 illustrate the examples of arrangement where the waste tank 2600 is provided below the buffer tanks 2400. The waste tank 2600 may, however, be provided below the liquid tanks 2300, in addition to below the buffer tanks 2400 or in place of below the buffer tanks 2400. Accordingly the waste tank 2600 may be placed below at least part of the liquid tanks 2300 and the buffer tanks 2400. Even in the case of leakage of the liquid from the liquid tank 2300 and/or the buffer tank 2400, this configuration makes it likely that the leaked liquid is stored in the waste tank 2600. This configuration thus advantageously reduces the possibility that the liquid flows out of the printer. Any of the various arrangements and configurations described above with regard to the waste tank 2600 and the partition walls 2710 and 2720 may be similarly applicable to the fourth embodiment.

As described above, like the fourth embodiment, according to the fifth embodiment, the buffer tanks 2400 are connected with the liquid tanks 2300. This configuration has the similar advantageous effects to those described in the fourth embodiment, for example, suppression of leakage of the liquid to the outside.

According to the fifth embodiment, the plurality of liquid tanks 2300 are arrayed in the X direction (first direction), and the plurality of buffer tanks 2400 are arrayed in the Y direction (second direction) intersecting with the X direction (first direction). This configuration suppresses excessive size expansion of the printer 2100B in the X direction (first direction).

H. Other Modifications

The disclosure is not limited to any of the embodiments and the modifications described above but may be implemented by a diversity of other aspects without departing from the scope of the disclosure. Some of possible modifications are given below.

The disclosure is not limited to the liquid ejection system, the inkjet printer or the liquid supply device or the liquid container unit configured to supply ink to the inkjet printer but is also applicable to any liquid ejection apparatus configured to eject any liquid other than ink and a liquid supply device configured to contain the liquid therein. For example, the disclosure may be applied to any of various liquid ejection apparatuses and their liquid supply devices given below:

(1) image recording apparatus such as a facsimile machine;

(2) color material ejection apparatus configured to eject a color material used for manufacturing color filters for an image display apparatus such as a liquid crystal display;

(3) electrode material ejection apparatus configured to eject an electrode material used for forming electrodes of, for example, an organic EL (electroluminescence) display and a field emission display (FED);

(4) liquid ejection apparatus configured to eject a bioorganic material-containing liquid used for manufacturing biochips;

(5) sample ejection apparatus used as a precision pipette;

(6) ejection apparatus of lubricating oil;

(7) ejection apparatus of a resin solution;

(8) liquid ejection apparatus for pinpoint ejection of lubricating oil on precision machines such as watches and cameras;

(9) liquid ejection apparatus configured to eject a transparent resin solution, such as an ultraviolet curable resin solution, onto a substrate in order to manufacture a hemispherical microlens (optical lens) used for, for example, optical communication elements;

(10) liquid ejection apparatus configured to eject an acidic or alkaline etching solution in order to etch a substrate or the like; and

(11) liquid ejection apparatus equipped with a liquid ejection head configured to eject a very small volume of droplets of any other liquid.

The "droplet" herein means the state of liquid ejected from the liquid injection recording apparatus or the liquid injection apparatus and may include a granular shape, a teardrop shape and a tapered threadlike shape. The "liquid" herein may be any material ejectable from the liquid injection recording apparatus or the liquid injection apparatus. The "liquid" may be any material in the liquid phase. For example, liquid-state materials of high viscosity or low viscosity, sols, aqueous gels and other liquid-state materials including inorganic solvents, organic solvents, solutions, liquid resins and liquid metals (metal melts) are included in the "liquid". The "liquid" is not limited to the liquid state as one of the three states of matter but includes solutions, dispersions and mixtures of the functional solid material particles, such as pigment particles or metal particles, solved in, dispersed in or mixed with a solvent. Typical examples of the liquid include ink described in the above embodiments and liquid crystal. The ink herein includes general water-based inks and oil-based inks, as well as various liquid compositions, such as gel inks and hot-melt inks. In an application that UV ink curable by UV radiation is contained in a liquid container body and is connected with the printer, the liquid container body is away from the placement surface. This reduces the likelihood that the UV ink is cured by transmission of heat from the placement surface to the liquid container body.

The disclosure is not limited to any of the embodiments, the configurations, the examples and the modifications described above but may be implemented by a diversity of other configurations without departing from the scope of the disclosure. For example, the technical features of any of the embodiments, the configurations, the examples and the modifications corresponding to the technical features of each of the aspects described in Summary may be replaced or combined appropriately, in order to solve part or all of the problems described above or in order to achieve part or all of the advantageous effects described above. Any of the technical features may be omitted appropriately unless the technical feature is described as essential herein.

What is claimed is:

1. A liquid supply device configured to supply a liquid to a liquid ejection head, comprising:

a liquid containing chamber configured to contain the liquid;

an air communication path configured to include a first connection portion at one end that is connected with the liquid containing chamber and an air outlet port at the other end that is open to the atmosphere; and a buffer chamber provided in the middle of the air communication path, wherein the air communication path includes a connection path that is located on a downstream side of the buffer chamber in the air communication path in a flow direction of a fluid from the air outlet port toward the liquid containing chamber and is configured to include a second connection portion at an upstream end connected with the buffer chamber, when the first connection portion is exposed to the liquid in the liquid containing chamber, the second connection portion is placed in a lower area in a vertical direction of the buffer chamber, wherein a plurality of the buffer chambers are provided in series in the middle of the air communication path, a plurality of the connection paths are provided corresponding to the respective buffer chambers, respective second connection portions of the respective connection paths are located on identical sides in a horizontal direction and in the vertical direction in the respective buffer chambers, each of the buffer chambers is formed in an approximately rectangular parallelepiped shape, the plurality of connection paths include a middle connection path that is arranged to connect adjacent buffer chambers with each other in the flow direction and is configured to include the second connection portion at the upstream end connected with an adjacent buffer chamber on an upstream side and a third connection portion at a downstream end connected with an adjacent buffer chamber on a downstream side, and the air communication path includes a most upstream-side communication path configured to include the air outlet port and an air-side connection portion that is connected with a most upstream-side buffer chamber located on a most upstream side in the flow direction out of the plurality of buffer chambers, wherein in the most upstream-side buffer chamber, the air-side connection portion is arranged diagonally to a most upstream-side second connection portion that is the second connection portion connected with the most upstream-side buffer chamber, and in a downstream-side buffer located on a downstream side of the most upstream-side buffer chamber in the flow direction out of the plurality of buffer chambers, the third connection portion and the second connection portion are arranged diagonally to each other.

2. A liquid ejection system, comprising:

the liquid supply device according to claim 1;

the liquid ejection head; and a liquid supply flow path configured to make the liquid supply device communicate with the liquid ejection head.

* * * * *